US008532984B2

(12) United States Patent
Rajendran et al.

(10) Patent No.: US 8,532,984 B2
(45) Date of Patent: Sep. 10, 2013

(54) SYSTEMS, METHODS, AND APPARATUS FOR WIDEBAND ENCODING AND DECODING OF ACTIVE FRAMES

(75) Inventors: Vivek Rajendran, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1749 days.

(21) Appl. No.: 11/830,842

(22) Filed: Jul. 30, 2007

(65) Prior Publication Data

US 2008/0027715 A1 Jan. 31, 2008

Related U.S. Application Data

(60) Provisional application No. 60/834,683, filed on Jul. 31, 2006.

(51) Int. Cl.
*G10L 19/14* (2006.01)
*G10L 11/06* (2006.01)

(52) U.S. Cl.
USPC ..... 704/205; 704/208

(58) Field of Classification Search
USPC ..... 704/205, 208
See application file for complete search history.

(56) References Cited

U.S. PATENT DOCUMENTS

| | | | | |
|---|---|---|---|---|
| 5,504,773 | A | 4/1996 | Padovani et al. | |
| 5,568,483 | A | 10/1996 | Padovani et al. | |
| 5,704,003 | A | 12/1997 | Kleijn et al. | |
| 6,249,197 | B1 | 6/2001 | Zindler et al. | |
| 6,330,532 | B1 | 12/2001 | Manjunath et al. | |
| 6,349,197 | B1 | 2/2002 | Oestreich | |
| 6,691,084 | B2 | 2/2004 | Manjunath et al. | |
| 6,738,391 | B1 * | 5/2004 | Kim et al. | 370/468 |
| 6,879,955 | B2 | 4/2005 | Rao | |
| 2004/0098255 | A1 | 5/2004 | Kovesi et al. | |
| 2005/0065783 | A1 * | 3/2005 | Ojala et al. | 704/205 |
| 2006/0171419 | A1 | 8/2006 | Spindola et al. | |
| 2006/0271356 | A1 | 11/2006 | Vos | |
| 2006/0277038 | A1 | 12/2006 | Vos et al. | |
| 2006/0277042 | A1 | 12/2006 | Vos et al. | |
| 2006/0282262 | A1 | 12/2006 | Vos et al. | |
| 2006/0282263 | A1 | 12/2006 | Vos et al. | |
| 2007/0088541 | A1 | 4/2007 | Vos et al. | |

(Continued)

FOREIGN PATENT DOCUMENTS

| | | | |
|---|---|---|---|
| CN | 1178617 | A | 4/1998 |
| CN | 1692408 | A | 11/2005 |

(Continued)

OTHER PUBLICATIONS

3rd Generation Partnership Project 2 ("3GPP2"), Enhanced Variable Rate Codec, Speech Service Option 3 and 68 for Wideband Spread Spectrum Digital Systems, 3GPP2 C.S0014-B, ver. 1.0, May 2006.

(Continued)

*Primary Examiner* — Angela A Armstrong
(74) *Attorney, Agent, or Firm* — Heejong Yoo

(57) ABSTRACT

Applications of dim-and-burst techniques to coding of wideband speech signals are described. Reconstruction of a high-band portion of a frame of a wideband speech signal using information from a previous frame is also described.

47 Claims, 28 Drawing Sheets

(56) References Cited

U.S. PATENT DOCUMENTS

| | | | |
|---|---|---|---|
| 2007/0088542 | A1 | 4/2007 | Vos et al. |
| 2007/0088558 | A1 | 4/2007 | Vos et al. |
| 2007/0171931 | A1 | 7/2007 | Manjunath et al. |

FOREIGN PATENT DOCUMENTS

| | | | | |
|---|---|---|---|---|
| EP | 0918407 | A2 | | 5/1999 |
| EP | 1290679 | A1 | | 3/2003 |
| EP | 1 788 556 | | * | 5/2007 |
| EP | 1788556 | | | 5/2007 |
| EP | 1808684 | | | 7/2007 |
| RU | 2197776 | | | 1/2003 |
| RU | 2214047 | | | 10/2003 |
| RU | 2223555 | | | 2/2004 |
| RU | 2005102831 | | | 7/2005 |
| RU | 2005106296 | | | 8/2005 |
| TW | 514867 | | | 12/2002 |
| TW | 548630 | | | 8/2003 |
| TW | I253056 | | | 4/2006 |
| WO | WO0013174 | A1 | | 3/2000 |
| WO | 0030075 | A1 | | 5/2000 |
| WO | 0186635 | | | 11/2001 |
| WO | 02058052 | | | 7/2002 |
| WO | 2004006226 | | | 1/2004 |
| WO | WO 2004/006226 | | * | 1/2004 |
| WO | WO2004015689 | | | 2/2004 |
| WO | 2005101372 | | | 10/2005 |
| WO | WO 2005/101372 | | * | 10/2005 |
| WO | 2006028009 | | | 3/2006 |
| WO | WO 2006/028009 | | * | 3/2006 |
| WO | 2006049205 | | | 5/2006 |
| WO | 2006107837 | A1 | | 10/2006 |

OTHER PUBLICATIONS

3rd Generation Partnership Project 2 ("3GPP2"), Enhanced Variable Rate Codec, Speech Service Options 3, 68, and 70 for Wideband Spread Spectrum Digital Systems, 3GPP2 C.S0014-C, ver. 1.0, Jan. 2007.

European Telecommunications Standards Institute (ETSI) 3rd Generation Partnership Project (3GPP), Digital cellular telecommunications system (Phase 2+), Universal Mobile Telecommunications System (UMTS), AMR speech Codec, comfort noise for AMR Speech Traffic Channels, ETSI TS 126.092, ver. 6.0.0 (3GPP TS 26.092 version 6.0.0 Release 6), Dec. 2004.

European Telecommunications Standards Institute (ETSI) 3rd Generation Partnership Project (3GPP), Digital cellular telecommunications system (Phase 2+), Universal Mobile Telecommunications System (UMTS), Mandatory Speech Codec speech processing functions AMR Wideband Speech Codec, Comfort noise aspects, ETSI TS 126 192, ver.6.0.0 (3GPP TS 26.192 version 6.0.0 Release 6), Dec. 2004.

European Telecommunications Standards Institute (ETSI) 3rd Generation Partnership Project (3GPP), Digital cellular telecommunications system (Phase 2+), Full rate speech, Transcoding, ETSI EN 300 961, ver. 8.1.1 (GSM 06.10 version 8.1.1 Release 1999), Nov. 2000.

European Telecommunications Standards Institute (ETSI) 3rd Generation Partnership Project (3GPP), Digital cellular telecommunications system (Phase 2+), Enhanced Full Rate (EFR) speech transcoding, ETSI EN 300 726, ver. 8.0.1 (GSM 06.60, ver. 8.0.1, Release 1999), Nov. 2000.

International Telecommunications Union, Telecommunication Standardization Sector of ITU ("ITU-T"), Series G: Transmission Systems and Media, Digital Systems and Networks, Digital transmission systems—Terminal equipments—Coding of analogue signals by methods other than PCM, Coding of speech at 8 kbit/s using Conjugate-Structure Algebraic-Code-Excited Linear-Prediction (CS-ACELP), Annex E: 11.8 kbit/s CS-ACELP speech coding algorithm ("G.729 Annex E"), Sep. 1998.

International Telecommunications Union, Telecommunication Standardization Sector of ITU ("ITU-T"), Series G: Transmission Systems and Media, Digital Systems and Networks, Digital terminal equipments—Coding of analogue signals by methods other than PCM, Wideband coding of speech at around 16 kbit/s using Adaptive Multi-Rate Wideband (AMR-WB), (ITU-T Recommendation "G.722.2"), Jul. 2003.

International Telecommunications Union, Telecommunication Standardization Sector of ITU ("ITU-T"), Series G: Transmission Systems and Media, Digital Systems and Networks, Digital transmission systems—Terminal equipments—Coding of analogue signals by methods other than PCM, Coding of speech at 8 kbit/s using conjugate structure algebraic-code-excited linear-prediction (CS-ACELP), Annex B: A silence compression scheme for G.729 optimized for terminals conforming to Recommendation V.70 ("G.729 Annex B"), Nov. 1996.

Telecommunications Industry Association, TIA/EIA Interim Standard, Enhanced Variable Rate Code, Speech Service Option 3 for Wideband Spread Spectrum Digital Systems, TIA-EIA-IS-127, Telecommunications Industry Association and Electronic Industries Association, Jan. 1997.

Telecommunications Industry Association, TIA Standard, Enhanced Variable Rate Codec Speech Option 3 for Wideband Spread Spectrum Digital Systems, TIA-127-A (Revision of TIA/EIA/IS-127), Telecommunications Industry Association, May 2004.

Telecommunications Industry Association, TIA Standard, Enhanced Variable Rate Codec Speech Service Option 3 and YY for Wideband Spread Spectrum Digital Systems, TIA-127-B (Revision of TIA-127-A), Telecommunications Industry Association, Dec. 2006.

Telecommunications Industry Association, TIA/EIA Interim Standard, TDMA Cellular/PCS—Radio Interface—Enhanced Full-Rate Speech Codec, TIA/EIA/IS-641, Telecommunications Industry Association, May 1996.

Telecommunications Industry Association, TR45, TIA/EIA IS-641-A, TDMA CelluladPCS—Radio Interface, Enhanced Full-Rate Voice Codec, Revision A, Telecommunications Industry Association, Sep. 1997.

Wei, B. et al.: "Range Extension and Short Range Performance Enhancement in TDMA Digital Cellular," 36th Asilomar Conference on Signals, Systems & Computers, vol. 1, Nov. 3, 2002, pp. 553-557, XP01063827 ISBN: 978-0-7803-7576-5.

International Search Report, PCT/US2007/074868—Internatlonal Search Authority—European Patent Office—Jun. 24, 2008.

Written Opinion, PCT/US2007/074868—International Search Authority—European Patent Office—Jun. 24, 2008.

Taiwanese Search report—096128123—TIPO—Jul. 13, 2010.

* cited by examiner

| | narrowband | high band | available for other use | speech type |
|---|---|---|---|---|
| coding scheme 1: full-rate CELP (171 bits) | 153 bits (28 for spectral, 125 for excitation) | 16 bits (8 for spectral, 8 for temporal) | 2 bits | voiced |
| coding scheme 2: half-rate CELP (80 bits) | 80 bits (22 for spectral, 58 for temporal) | (no bits) | (no bits) | voiced |
| coding scheme 3: half-rate NELP (80 bits) | 47 bits (28 for spectral, 19 for temporal) | 27 bits (12 for spectral, 15 for temporal) | 6 bits | unvoiced |
| coding scheme 4: eighth-rate NELP (16 bits) | 15 bits (10 for spectral, 5 for temporal) | (no bits) | 1 bit | inactive |

FIG. 12

| parameter (value) | number of bits | bit index in packet |
|---|---|---|
| delay index | 7 | P0-P6 |
| LSP indices (four) | 6, 6, 9, 7 | P7-P34 |
| adaptive codebook gain indices (three) | 3, 3, 3 | P35-P43 |
| fixed codebook pulse index delay adjust | 94 | P44-P137 |
| fixed codebook gain indices (three) | 5, 5, 5 | P138-P152 |
| highband LSP index | 8 | P153-P160 |
| highband gain shape index | 4 | P161-P164 |
| highband gain frame index | 4 | P165-P168 |
| mode bit (CELP/MDCT) | 1 | P169 |
| EVRC-B I/O flag | 1 | P170 |

FIG. 13

| parameter (value) | number of bits | bit index in packet |
|---|---|---|
| delay index | **7** | P0-P6 |
| LSP indices (three) | 7, 7, 8 | P7-P28 |
| adaptive codebook gain indices (three) | 3, 3, 3 | P29-P37 |
| fixed codebook pulse indices (three) | 10, 10, 10 | P38-P67 |
| fixed codebook gain indices (three) | 4, 4, 4 | P68-P79 |

FIG. 14

SYSTEMS, METHODS, AND APPARATUS FOR WIDEBAND ENCODING AND DECODING OF ACTIVE FRAMES

RELATED APPLICATIONS

This application claims benefit of U.S. Provisional Patent Application No. 60/834,683, filed Jul. 31, 2006 and entitled "DIM AND BURST SIGNALING FOR 4GV WIDEBAND." This application is also related to U.S. patent application Ser. No. 11,830,812, filed Jul. 30, 2007 and entitled "SYSTEMS, METHODS, AND APPARATUS FOR WIDEBAND ENCODING AND DECODING OF INACTIVE FRAMES."

FIELD

This disclosure relates to processing of speech signals.

BACKGROUND

Transmission of voice by digital techniques has become widespread, particularly in long distance telephony, packet-switched telephony such as Voice over IP (also called VoIP, where IP denotes Internet Protocol), and digital radio telephony such as cellular telephony. Such proliferation has created interest in reducing the amount of information used to transfer a voice communication over a transmission channel while maintaining the perceived quality of the reconstructed speech.

Devices that are configured to compress speech by extracting parameters that relate to a model of human speech generation are called "speech coders." A speech coder (also called a speech codec or vocoder) generally includes a speech encoder and a speech decoder. The speech encoder typically divides the incoming speech signal (a digital signal representing audio information) into segments of time called "frames," analyzes each frame to extract certain relevant parameters, and quantizes the parameters into an encoded frame. The encoded frames are transmitted over a transmission channel (i.e., a wired or wireless network connection) to a receiver that includes a speech decoder. The speech decoder receives and processes encoded frames, dequantizes them to produce the parameters, and recreates speech frames using the dequantized parameters.

Speech encoders are usually configured to distinguish frames of the speech signal that contain speech ("active frames") from frames of the speech signal that contain only silence or background noise ("inactive frames"). A speech encoder may be configured to use different coding modes and/or rates to encode active and inactive frames. For example, speech encoders are typically configured to use fewer bits to encode an inactive frame than to encode an active frame. A speech coder may use a lower bit rate for inactive frames, and/or different bit rates for different types of active frames, to support transfer of the speech signal at a lower average bit rate with little to no perceived loss of quality.

Voice communications over the public switched telephone network (PSTN) have traditionally been limited in bandwidth to the frequency range of 300-3400 kilohertz (kHz). More recent networks for voice communications, such as networks that use cellular telephony and/or VoIP, may not have the same bandwidth limits, and it may be desirable for apparatus using such networks to have the ability to transmit and receive voice communications that include a wideband frequency range. For example, it may be desirable for such apparatus to support an audio frequency range that extends down to 50 Hz and/or up to 7 or 8 kHz. It may also be desirable for such apparatus to support other applications, such as high-quality audio or audio/video conferencing, delivery of multimedia services such as music and/or television, etc., that may have audio speech content in ranges outside the traditional PSTN limits.

Extension of the range supported by a speech coder into higher frequencies may improve intelligibility. For example, the information in a speech signal that differentiates fricatives such as 's' and 'f' is largely in the high frequencies. Highband extension may also improve other qualities of the decoded speech signal, such as presence. For example, even a voiced vowel may have spectral energy far above the PSTN frequency range.

SUMMARY

A method of processing a speech signal according to a configuration includes producing, based on a first active frame of the speech signal, a first speech packet that includes a description of a spectral envelope, over (A) a first frequency band and (B) a second frequency band that extends above the first frequency band, of a portion of the speech signal that includes the first active frame. This method also includes producing, based on a second active frame of the speech signal, a second speech packet that includes a description of a spectral envelope, over the first frequency band, of a portion of the speech signal that includes the second active frame. In this method, the second speech packet does not include a description of a spectral envelope over the second frequency band.

A speech encoder according to another configuration includes a packet encoder and a frame formatter. The packet encoder is configured to produce, based on a first active frame of a speech signal and in response to a first state of a rate control signal, a first speech packet that includes a description of a spectral envelope over (1) a first frequency band and (2) a second frequency band that extends above the first frequency band. The packet encoder is also configured to produce, based on a second active frame of the speech signal and in response to a second state of the rate control signal different than the first state, a second speech packet that includes a description of a spectral envelope over the first frequency band. The frame formatter is arranged to receive the first and second speech packets. The frame formatter is configured to produce, in response to a first state of a dimming control signal, a first encoded frame that contains the first speech packet. The frame formatter is also configured to produce, in response to a second state of the dimming control signal different than the first state, a second encoded frame that contains the second speech packet and a burst of an information signal that is separate from the speech signal. In this encoder, the first and second encoded frames have the same length, the first speech packet occupies at least eighty percent of the first encoded frame, the second speech packet occupies not more than half of the second encoded frame, and the second active frame occurs immediately after the first active frame in the speech signal.

A method of processing speech packets according to another configuration includes obtaining, based on information from a first speech packet from an encoded speech signal, a description of a spectral envelope of a first frame of a speech signal over (A) a first frequency band and (B) a second frequency band different than the first frequency band. This method also includes obtaining, based on information from a second speech packet from the encoded speech signal, a description of a spectral envelope of a second frame of the speech signal over the first frequency band. This method also includes obtaining, based on information from the first speech packet, a description of a spectral envelope of the second frame over the second frequency band. This method also includes obtaining, based on information from the second speech packet, information relating to a pitch component of the second frame for the first frequency band.

A speech decoder according to another configuration is configured to calculate a decoded speech signal based on an encoded speech signal. This speech decoder includes control logic and a packet decoder. The control logic is configured to generate a control signal comprising a sequence of values that is based on coding indices of speech packets from the encoded speech signal, each value of the sequence corresponding to a frame period of the decoded speech signal. The packet decoder is configured to calculate, in response to a value of the control signal having a first state, a corresponding decoded frame based on a description of a spectral envelope of the decoded frame over (1) a first frequency band and (2) a second frequency band that extends above the first frequency band, the description being based on information from a speech packet from the encoded speech signal. The packet decoder is also configured to calculate, in response to a value of the control signal having a second state different than the first state, a corresponding decoded frame based on (1) a description of a spectral envelope of the decoded frame over the first frequency band, the description being based on information from a speech packet from the encoded speech signal, and (2) a description of a spectral envelope of the decoded frame over the second frequency band, the description being based on information from at least one speech packet that occurs in the encoded speech signal before the speech packet.

BRIEF DESCRIPTION OF THE DRAWINGS

FIG. 12 is a table that shows one set of four different coding schemes that a speech encoder configured to perform an implementation of method M100 may use.

FIG. 13 is a table describing the bit allocations of a 171-bit wideband FCELP packet.

FIG. 14 is a table describing the bit allocations of an 80-bit narrowband HCELP packet.

In the figures and accompanying description, the same reference labels refer to the same or analogous elements or signals.

DETAILED DESCRIPTION

The configurations described below reside in a wireless telephony communication system configured to employ a CDMA over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels. It is expressly contemplated and hereby disclosed that such configurations may be adapted for use in networks that are packet-switched (for example, wired and/or wireless networks arranged to carry voice transmissions according to protocols such as VoIP) and/or circuit-switched.

Configurations described herein may be applied in a wideband speech coding system to support dimming of active frames. For example, such configurations may be applied to support the use of dim-and-burst techniques for transferring signaling and/or secondary traffic information in a wideband speech coding system.

Unless expressly limited by its context, the term "calculating" is used herein to indicate any of its ordinary meanings, such as computing, evaluating, generating, and/or selecting from a set of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "A is based on B" is used to indicate any of its ordinary meanings, including the cases (i) "A is based on at least B" and (ii) "A is equal to B" (if appropriate in the particular context).

Unless indicated otherwise, any disclosure of a speech encoder having a particular feature is also expressly intended to disclose a method of speech encoding having an analogous feature (and vice versa), and any disclosure of a speech encoder according to a particular configuration is also expressly intended to disclose a method of speech encoding according to an analogous configuration (and vice versa). Unless indicated otherwise, any disclosure of a speech decoder having a particular feature is also expressly intended to disclose a method of speech decoding having an analogous feature (and vice versa), and any disclosure of a speech decoder according to a particular configuration is also expressly intended to disclose a method of speech decoding according to an analogous configuration (and vice versa).

Figure 1:
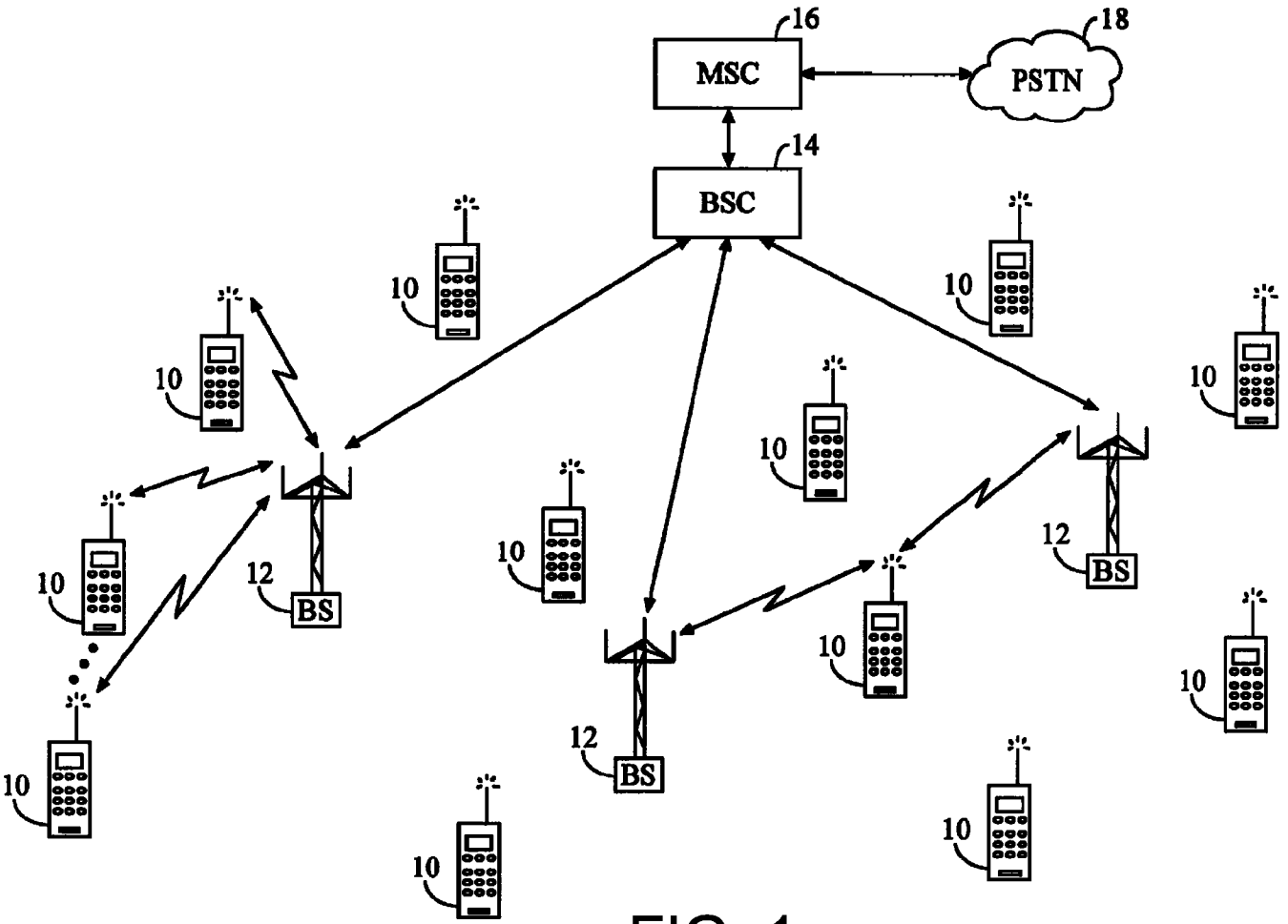
FIG. 1 shows a diagram of a wireless telephone system that is interfaced with the PSTN.

As illustrated in FIG. 1, a CDMA wireless telephone system generally includes a plurality of mobile subscriber units 10 configured to communicate wirelessly with a radio access network that includes a plurality of base stations 12 and one or more base station controllers (BSCs) 14. Such a system also generally includes a mobile switching center (MSC) 16, coupled to the BSCs 14, that is configured to interface the radio access network with a conventional public switched telephone network (PSTN) 18 (possibly via a media gateway). The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL.

Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 are typically cellular or PCS telephones 10. Such a system may be configured for use in accordance with one or more versions of the IS-95 standard (e.g., IS-95, IS-95A, IS-95B, cdma2000; as published by the Telecommunications Industry Alliance, Arlington, Va.).

During typical operation of the cellular telephone system, the base stations 12 receive sets of reverse link signals from sets of mobile subscriber units 10. The mobile subscriber units 10 are conducting telephone calls or other communications. Each reverse link signal received by a given base station 12 is processed within that base station 12. The resulting data is forwarded to the BSCs 14. The BSCs 14 provides call resource allocation and mobility management functionality including the orchestration of soft handoffs between base stations 12. The BSCs 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile subscriber units 10.

Figure 2:
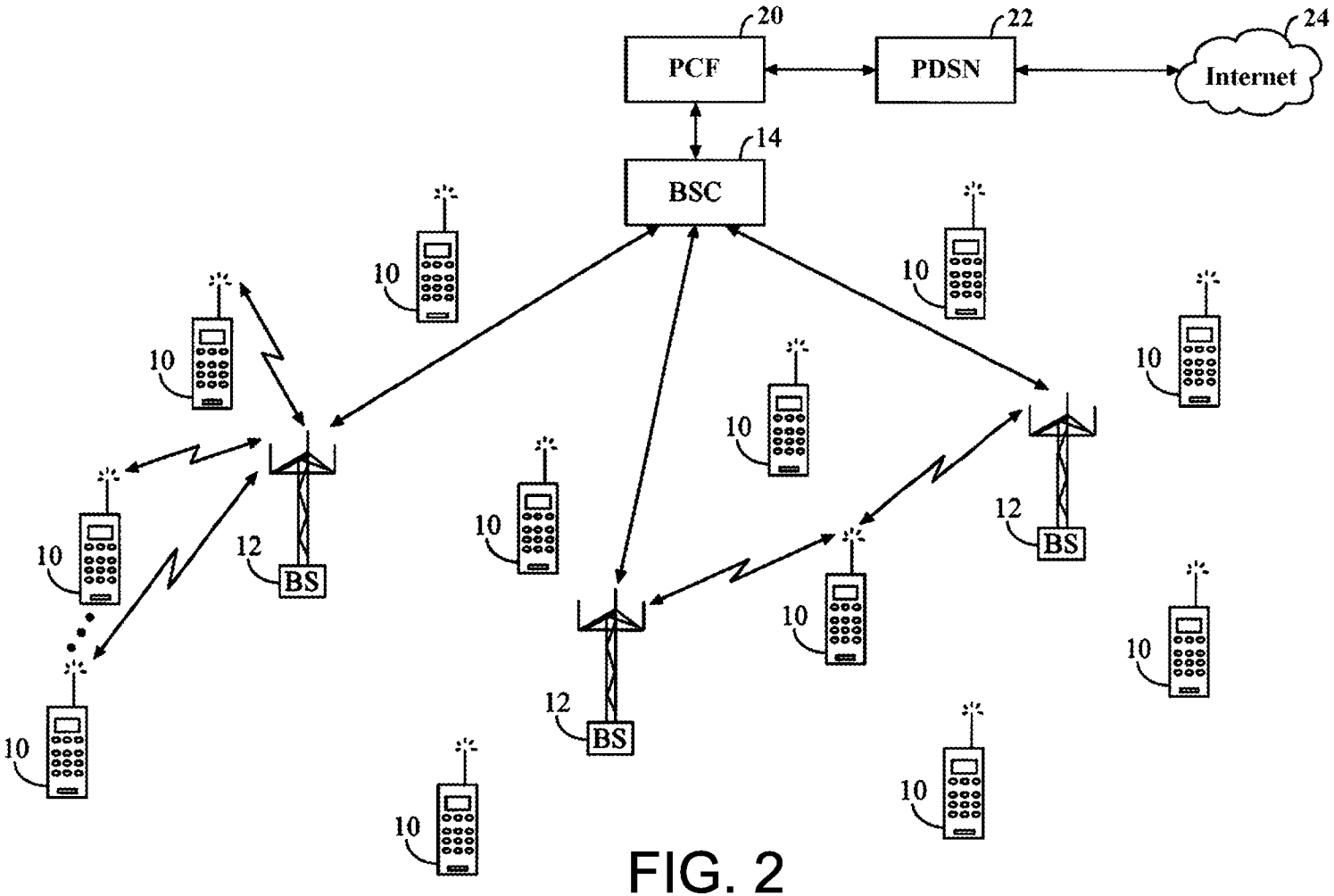
FIG. 2 shows a diagram of a wireless telephone system that is interfaced with the Internet.

Elements of a cellular telephony system as shown in FIG. 1 may also be configured to support packet-switched data communications. As shown in FIG. 2, packet data traffic is generally routed between mobile subscriber units 10 and an external packet data network (e.g., a public network such as the Internet) using a packet data serving node (PDSN) that is coupled to a gateway router connected to the packet data network. The PDSN in turn routes data to one or more packet control functions (PCFs), which each serve one or more BSCs and act as a link between the packet data network and the radio access network. Such a system may be configured to carry a telephone call or other communication as packet data traffic between mobile subscriber units on different radio access networks (e.g., via one or more protocols such as VoIP) without ever entering the PSTN.

Figure 3A:
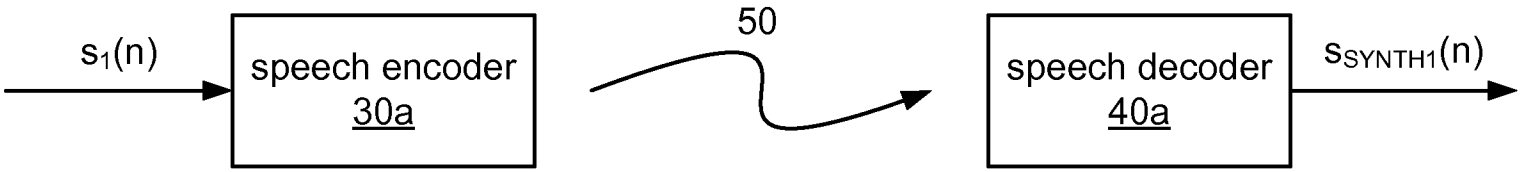
FIG. 3 shows a block diagram of two speech encoder/decoder pairs.
Figure 3B:
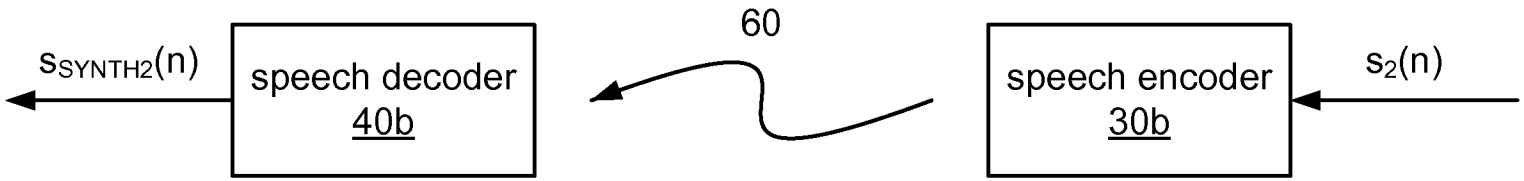

FIG. 3A shows a first speech encoder 30*a* that is arranged to receive a digitized speech signal $s_1(n)$ and to encode the signal for transmission on a communication channel 50 (e.g., over a transmission medium) to a first speech decoder 40*a*. The first speech decoder 40*a* is arranged to decode the encoded speech signal and to synthesize an output speech signal $s_{SYNTH1}(n)$. FIG. 3B shows a second speech encoder 30*b* arranged to encode a digitized speech signal $s_2(n)$ for transmission in the opposite direction on a communication channel 60 (e.g., over the same or a different transmission medium) to a second speech decoder 40*b*. Speech decoder 40*b* is arranged to decode this encoded speech signal, generating a synthesized output speech signal $s_{SYNTH2}(n)$. The first speech encoder 30*a* and the second speech decoder 40*b* (similarly, the second speech encoder 30*b* and the first speech decoder 40*a*) may be used together in any communication device for transmitting and receiving speech signals, including, for example, the subscriber units, BTSs, or BSCs described above with reference to FIGS. 1 and 2.

The speech signals $s_1(n)$ and $s_2(n)$ represent analog signals that have been digitized and quantized in accordance with any of various methods known in the art, such as pulse code modulation (PCM), companded mu-law, or A-law. As known in the art, a speech encoder receives the digital samples of a speech signal as frames of input data, wherein each frame comprises a predetermined number of samples. The frames of a speech signal are typically short enough that the spectral envelope of the signal may be expected to remain relatively stationary over the frame. One typical frame length is twenty milliseconds, although any frame length deemed suitable for the particular application may be used. A frame length of twenty milliseconds corresponds to 140 samples at a sampling rate of seven kilohertz (kHz), 160 samples at a sampling rate of eight kHz, and 320 samples at a sampling rate of 16 kHz, although any sampling rate deemed suitable for the particular application may be used. Another example of a sampling rate that may be used for speech coding is 12.8 kHz, and further examples include other rates in the range of from 12.8 kHz to 38.4 kHz.

Typically all frames of a speech signal have the same length, and a uniform frame length is assumed in the particular examples described herein. However, it is also expressly contemplated and hereby disclosed that nonuniform frame lengths may be used. In some applications, the frames are nonoverlapping, while in other applications, an overlapping frame scheme is used. For example, it is common for a speech coder to use an overlapping frame scheme at the encoder and a nonoverlapping frame scheme at the decoder. It is also possible for an encoder to use different frame schemes for different tasks. For example, a speech encoder or method of speech encoding may use one overlapping frame scheme for encoding a description of a spectral envelope of a frame and a different overlapping frame scheme for encoding a description of temporal information of the frame.

It may be desirable to configure a speech encoder to use different bit rates to encode active frames and inactive frames. It may also be desirable for a speech encoder to use different bit rates to encode different types of active frames. In such cases, lower bit rates may be selectively employed for frames containing relatively less speech information. Examples of bit rates commonly used to encode active frames include 171 bits per frame, eighty bits per frame, and forty bits per frame; and examples of bit rates commonly used to encode inactive frames include sixteen bits per frame. In the context of cellular telephony systems (especially systems that are compliant with Interim Standard (IS)-95 as promulgated by the Telecommunications Industry Association, Arlington, Va., or a similar industry standard), these four bit rates are also referred to as "full rate," "half rate," "quarter rate," and "eighth rate," respectively.

It may be desirable to classify each of the active frames of a speech signal as one of several different types. These different types may include frames of voiced speech (e.g., speech representing a vowel sound), transitional frames (e.g., frames that represent the beginning or end of a word), and frames of unvoiced speech (e.g., speech representing a fricative sound). It may be desirable to configure a speech encoder to use different coding modes to encode different types of speech frames. For example, frames of voiced speech tend to have a periodic structure that is long-term (i.e., that continues for more than one frame period) and is related to pitch, and it is typically more efficient to encode a voiced frame (or a sequence of voiced frames) using a coding mode that encodes a description of this long-term spectral feature. Examples of such coding modes include code-excited linear prediction (CELP) and prototype pitch period (PPP). Unvoiced frames and inactive frames, on the other hand, usually lack any significant long-term spectral feature, and a speech encoder may be configured to encode these frames using a coding mode that does not attempt to describe such a feature. Noise-excited linear prediction (NELP) is one example of such a coding mode.

A speech encoder or method of speech encoding may be configured to select among different combinations of bit rates and coding modes (also called "coding schemes"). For example, a speech encoder may be configured to use a full-rate CELP scheme for frames containing voiced speech and for transitional frames, a half-rate NELP scheme for frames containing unvoiced speech, and an eighth-rate NELP scheme for inactive frames. Alternatively, such a speech encoder may be configured to use a full-rate PPP scheme for frames containing voiced speech.

A speech encoder may also be configured to support multiple coding rates for one or more coding schemes, such as full-rate and half-rate CELP schemes and/or full-rate and quarter-rate PPP schemes. Frames in a series that includes a period of stable voiced speech tend to be largely redundant, for example, such that at least some of them may be encoded at less than full rate without a noticeable loss of perceptual quality.

Multi-scheme speech coders (including speech coders that support multiple coding rates and/or coding modes) typically provide efficient speech coding at low bit rates. Skilled artisans will recognize that increasing the number of coding schemes will allow greater flexibility when choosing a coding scheme, which can result in a lower average bit rate. However, an increase in the number of coding schemes will correspondingly increase the complexity within the overall system. The particular combination of available schemes used in any given system will be dictated by the available system resources and the specific signal environment. Examples of multi-scheme coding techniques are described in, for example, U.S. Pat. No. 6,691,084, entitled "VARIABLE RATE SPEECH CODING," and in U.S. patent application Ser. No. 11/625,788 (Manjunath et al.), entitled "ARBITRARY AVERAGE DATA RATES FOR VARIABLE RATE CODERS."

A multi-scheme speech encoder typically includes an open-loop decision module that examines the input speech frame and makes a decision regarding which coding scheme to apply to the frame. This module is typically configured to classify frames as active or inactive and may also be configured to classify an active frame as one of two or more different types, such as voiced, unvoiced, or transitional. The frame classification may be based on one or more features of the current frame, and/or of one or more previous frames, such as overall frame energy, frame energy in each of two or more different frequency bands, signal-to-noise ratio (SNR), periodicity, and zero-crossing rate. Such classification may include comparing a value or magnitude of such a factor to a threshold value and/or comparing the magnitude of a change in such a factor to a threshold value.

Figure 4:
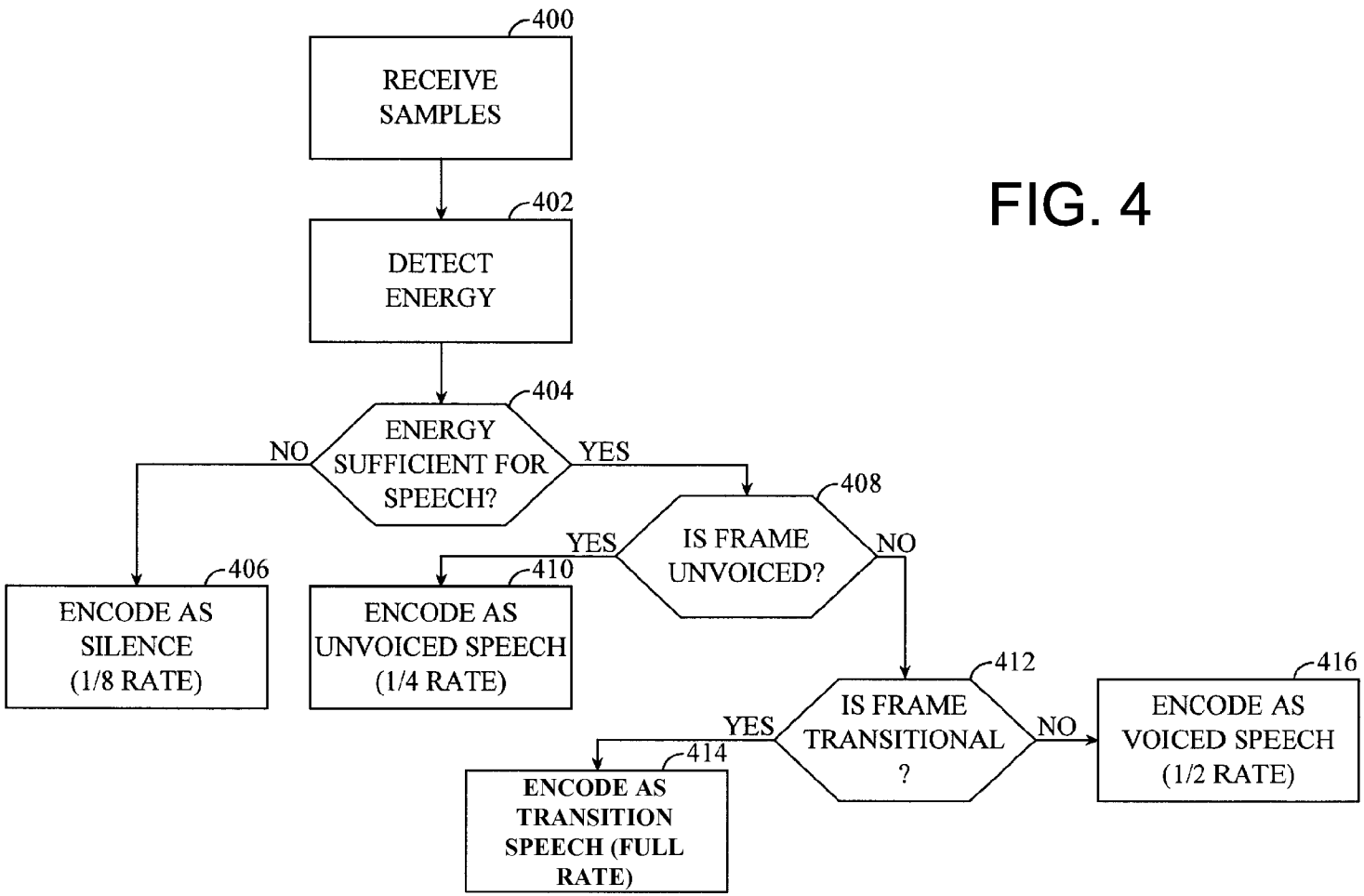
FIG. 4 shows one example of a decision tree that a speech encoder or method of speech encoding may use to select a bit rate.

FIG. 4 shows one example of a decision tree that an open-loop decision module may use to select a bit rate at which to encode a particular frame according to the type of speech the frame contains. In other cases, the bit rate selected for a particular frame may also depend on such criteria as a desired average bit rate, a desired pattern of bit rates over a series of frames (which may be used to support a desired average bit rate), and/or the bit rate selected for a previous frame.

A multi-scheme speech encoder may also perform a closed-loop coding decision, in which one or more measures of encoding performance are obtained after full or partial encoding using the open-loop selected bit rate. Performance measures that may be considered in the closed-loop test include, for example, SNR, SNR prediction in encoding schemes such as the PPP speech coder, prediction error quantization SNR, phase quantization SNR, amplitude quantization SNR, perceptual SNR, and normalized cross-correlation between current and past frames as a measure of stationarity. If the performance measure falls below a threshold value, the coding rate and/or mode may be changed to one that is expected to give better quality. Examples of closed-loop classification schemes that may be used to maintain the quality of a variable-rate speech coder are described in U.S. application Ser. No. 09/191,643, entitled CLOSED-LOOP VARIABLE-RATE MULTIMODE PREDICTIVE SPEECH CODER, filed on Nov. 13, 1998, and in U.S. Pat. No. 6,330,532.

A speech encoder is typically configured to encode a frame of a speech signal as a speech packet, where the size and format of the speech packet correspond to the particular coding scheme selected for that frame. A speech packet typically contains a set of speech parameters from which a corresponding frame of the speech signal may be reconstructed. This set of speech parameters typically includes spectral information, such as a description of the distribution of energy within the frame over a frequency spectrum. Such a distribution of energy is also called a "frequency envelope" or "spectral envelope" of the frame. The description of a spectral envelope of a frame may have a different form and/or length depending on the particular coding scheme used to encode the corresponding frame.

A speech encoder is typically configured to calculate a description of a spectral envelope of a frame as an ordered sequence of values. In some cases, the speech encoder is configured to calculate the ordered sequence such that each value indicates an amplitude or magnitude of the signal at a corresponding frequency or over a corresponding spectral region. One example of such a description is an ordered sequence of Fourier transform coefficients.

In other cases, the speech encoder is configured to calculate the description of a spectral envelope as an ordered sequence of values of parameters of a coding model, such as a set of values of coefficients of a linear prediction coding (LPC) analysis. An ordered sequence of LPC coefficient values is typically arranged as one or more vectors, and the speech encoder may be implemented to calculate these values as filter coefficients or as reflection coefficients. The number of coefficient values in the set is also called the "order" of the LPC analysis, and examples of a typical order of an LPC analysis as performed by a speech encoder of a communications device (such as a cellular telephone) include four, six, eight, ten, 12, 16, 20, 24, 28, and 32.

A speech encoder is typically configured to transmit the description of a spectral envelope across a transmission channel in quantized form (e.g., as one or more indices into corresponding lookup tables or "codebooks"). Accordingly, it may be desirable for a speech encoder to calculate a set of LPC coefficient values in a form that may be quantized efficiently, such as a set of values of line spectral pairs (LSPs), line spectral frequencies (LSFs), immittance spectral pairs (ISPs), immittance spectral frequencies (ISFs), cepstral coefficients, or log area ratios. A speech encoder may also be configured to perform other operations, such as perceptual weighting, on the ordered sequence of values before conversion and/or quantization.

In some cases, a description of a spectral envelope of a frame also includes a description of temporal information of the frame (e.g., as in an ordered sequence of Fourier transform coefficients). In other cases, the set of speech parameters of a speech packet may also include a description of temporal information of the frame. The form of the description of temporal information may depend on the particular coding mode used to encode the frame. For some coding modes (e.g., for a CELP coding mode), the description of temporal information may include a description of an excitation signal to be used by a speech decoder to excite an LPC model (e.g., as defined by the description of the spectral envelope). A description of an excitation signal typically appears in a speech packet in quantized form (e.g., as one or more indices into corresponding codebooks). The description of temporal information may also include information relating to at least one pitch component of the excitation signal. For a PPP coding mode, for example, the encoded temporal information may include a description of a prototype to be used by a speech decoder to reproduce a pitch component of the excitation signal. A description of information relating to a pitch component typically appears in a speech packet in quantized form (e.g., as one or more indices into corresponding codebooks).

For other coding modes (e.g., for a NELP coding mode), the description of temporal information may include a description of a temporal envelope of the frame (also called an "energy envelope" or "gain envelope" of the frame). A description of a temporal envelope may include a value that is based on an average energy of the frame. Such a value is typically presented as a gain value to be applied to the frame during decoding and is also called a "gain frame." In some cases, the gain frame is a normalization factor based on a ratio between (A) the energy of the original frame $E_{orig}$ and (B) the energy of a frame synthesized from other parameters of the speech packet (e.g., including the description of a spectral envelope) $E_{synth}$. For example, the gain frame may be expressed as $E_{orig}/E_{synth}$ or as the square root of $E_{orig}/E_{synth}$. Gain frames and other aspects of temporal envelopes are described in more detail in, for example, U.S. Pat. Appl. Pub. 2006/0282262 (Vos et al.), "SYSTEMS, METHODS, AND APPARATUS FOR GAIN FACTOR ATTENUATION," published Dec. 14, 2006.

Alternatively or additionally, a description of a temporal envelope may include relative energy values for each of a number of subframes of the frame. Such values are typically presented as gain values to be applied to the respective subframes during decoding and are collectively called a "gain profile" or "gain shape." In some cases, the gain shape values are normalization factors, each based on a ratio between (A) the energy of the original subframe i $E_{orig.i}$ and (B) the energy of the corresponding subframe i of a frame synthesized from other parameters of the encoded frame (e.g., including the description of a spectral envelope) $E_{synth.i}$. In such cases, the energy $E_{synth.i}$ may be used to normalize the energy $E_{orig.i}$. For example, a gain shape value may be expressed as $E_{orig.i}/E_{synth.i}$ or as the square root of $E_{orig.i}/E_{synth.i}$. One example of a description of a temporal envelope includes a gain frame and a gain shape, where the gain shape includes a value for each of five four-millisecond subframes of a twenty-millisecond frame. Gain values may be expressed on a linear scale or on a logarithmic (e.g., decibel) scale. Such features are described in more detail in, for example, U.S. Pat. Appl. Pub. 2006/0282262 cited above.

Figure 5A:
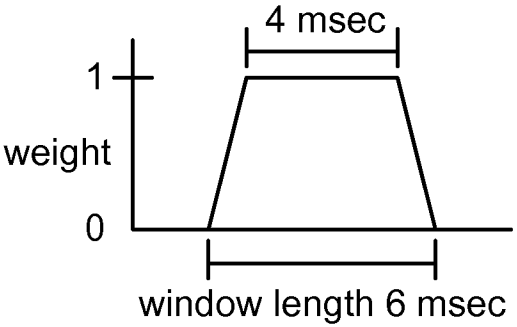
FIG. 5A shows a plot of a trapezoidal windowing function that may be used to calculate gain shape values.
Figure 5B:
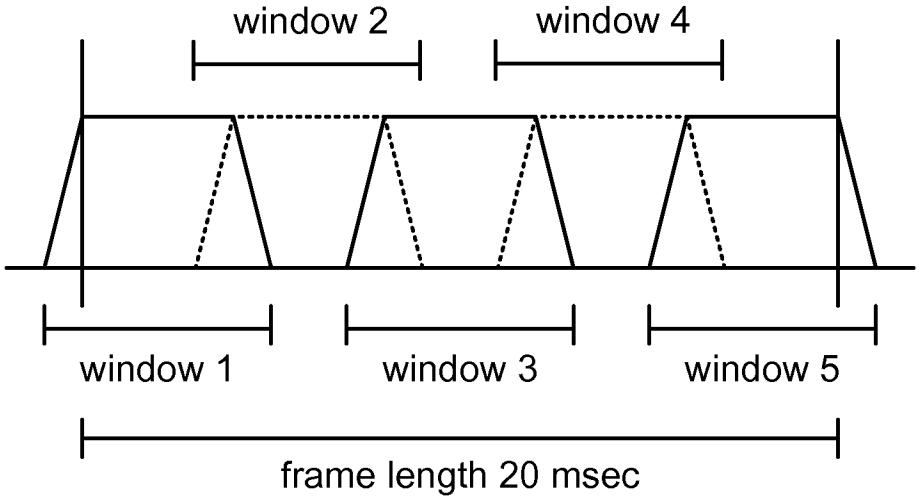
FIG. 5B shows an application of the windowing function of FIG. 6A to each of five subframes of a frame.

In calculating the value of a gain frame (or values of a gain shape), it may be desirable to apply a windowing function that overlaps adjacent frames (or subframes). Gain values produced in this manner are typically applied in an overlap-add manner at the speech decoder, which may help to reduce or avoid discontinuities between frames or subframes. FIG. 5A shows a plot of a trapezoidal windowing function that may be used to calculate each of the gain shape values. In this example, the window overlaps each of the two adjacent subframes by one millisecond. FIG. 5B shows an application of this windowing function to each of the five subframes of a twenty-millisecond frame. Other examples of windowing functions include functions having different overlap periods and/or different window shapes (e.g., rectangular or Hamming) which may be symmetrical or asymmetrical. It is also possible to calculate values of a gain shape by applying different windowing functions to different subframes and/or by calculating different values of the gain shape over subframes of different lengths.

A speech packet that includes a description of a temporal envelope typically includes such a description in quantized form as one or more indices into corresponding codebooks, although in some cases an algorithm may be used to quantize and/or dequantize the gain frame and/or gain shape without using a codebook. One example of a description of a temporal envelope includes a quantized index of eight to twelve bits that specifies five gain shape values for the frame (e.g., one for each of five consecutive subframes). Such a description may also include another quantized index that specifies a gain frame value for the frame.

As noted above, it may be desirable to transmit and receive a speech signal having a frequency range that exceeds the PSTN frequency range of 300-3400 kHz. One approach to coding such a signal is to encode the entire extended frequency range as a single frequency band. Such an approach may be implemented by scaling a narrowband speech coding technique (e.g., one configured to encode a PSTN-quality frequency range such as 0-4 kHz or 300-3400 Hz) to cover a wideband frequency range such as 0-8 kHz. For example, such an approach may include (A) sampling the speech signal at a higher rate to include components at high frequencies and (B) reconfiguring a narrowband coding technique to represent this wideband signal to a desired degree of accuracy. One such method of reconfiguring a narrowband coding technique is to use a higher-order LPC analysis (i.e., to produce a coefficient vector having more values). A wideband speech coder that encodes a wideband signal as a single frequency band is also called a "full-band" coder.

It may be desirable to implement a wideband speech coder such that at least a narrowband portion of the encoded signal may be sent through a narrowband channel (such as a PSTN channel) without the need to transcode or otherwise significantly modify the encoded signal. Such a feature may facilitate backward compatibility with networks and/or apparatus that only recognize narrowband signals. It may be also desirable to implement a wideband speech coder that uses different coding modes and/or rates for different frequency bands of the speech signal. Such a feature may be used to support increased coding efficiency and/or perceptual quality. A wideband speech coder that is configured to produce speech packets having portions that represent different frequency bands of the wideband speech signal (e.g., separate sets of speech parameters, each set representing a different frequency band of the wideband speech signal) is also called a "split-band" coder.

Figure 6B:
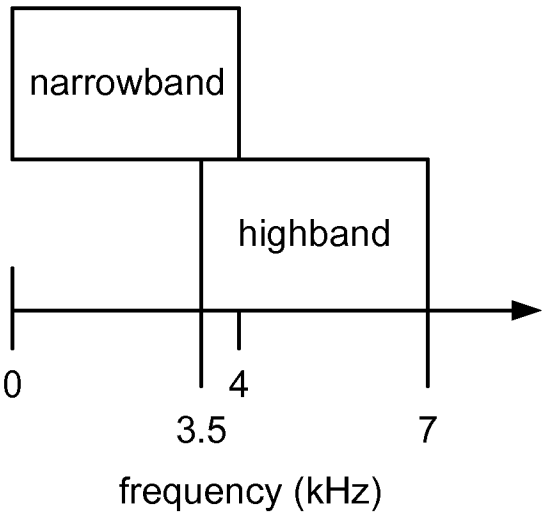
FIG. 6B shows one example of an overlapping frequency band scheme that may be used by a split-band encoder to encode wideband speech content.
Figure 6A:
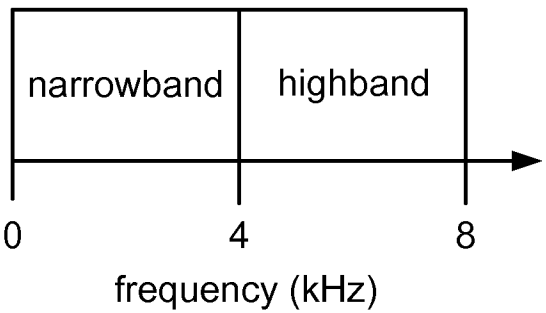
FIG. 6A shows one example of a nonoverlapping frequency band scheme that may be used by a split-band encoder to encode wideband speech content.

FIG. 6A shows one example of a nonoverlapping frequency band scheme that may be used by a split-band speech encoder to encode wideband speech content across a range of from 0 Hz to 8 kHz. This scheme includes a first frequency band that extends from 0 Hz to 4 kHz (also called a narrowband range) and a second frequency band that extends from 4 to 8 kHz (also called an extended, upper, or highband range). FIG. 6B shows one example of an overlapping frequency band scheme that may be used by a split-band speech encoder to encode wideband speech content across a range of from 0 Hz to 7 kHz. This scheme includes a first frequency band that extends from 0 Hz to 4 kHz (the narrowband range) and a second frequency band that extends from 3.5 to 7 kHz (the extended, upper, or highband range).

Other examples of frequency band schemes include those in which the narrowband range only extends down to about 300 Hz. Such a scheme may also include another frequency band that covers a lowband range from about 0 or 50 Hz up to about 300 or 350 Hz. One particular example of a split-band speech encoder is configured to perform a tenth-order LPC analysis for the narrowband range and a sixth-order LPC analysis for the highband range.

A speech packet encoded using a full-band coding scheme contains a description of a single spectral envelope that extends over the entire wideband frequency range, while a speech packet encoded using a split-band coding scheme has two or more separate portions that represent information in different frequency bands (e.g., a narrowband range and a highband range) of the wideband speech signal. For example, typically each of these separate portions of a split-band-encoded speech packet contains a description of a spectral envelope of the speech signal over the corresponding frequency band. A split-band-encoded speech packet may contain one description of temporal information of the frame for the entire wideband frequency range, or each of the separate portions of the split-band-encoded speech packet may contain a description of temporal information of the speech signal for the corresponding frequency band.

Figure 7A:
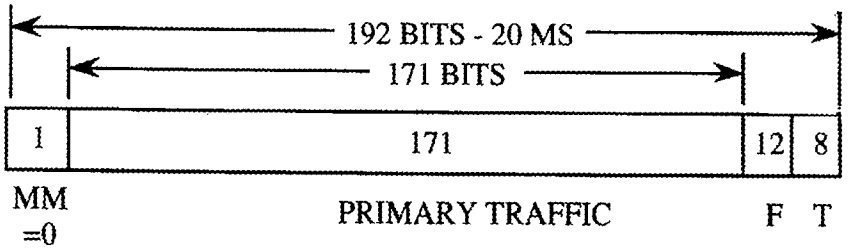
FIGS. 7A-7C show three different formats for a 192-bit encoded frame.

A speech encoder is typically configured to produce a series of encoded frames, each encoded frame including a speech packet and possibly one or more associated bits. FIG. 7A illustrates one example of a format for an encoded frame having a length of 192 bits. In this example, the encoded frame includes a 171-bit full-rate speech packet that represents a frame of the speech signal (i.e., the primary traffic). An encoded frame may also include one or more check bits. In this example, the encoded frame includes a twelve-bit frame quality indicator F, which may include parity check bits or cyclic redundancy check (CRC) bits, and an eight-bit set of tail bits T, which may be used to terminate and initialize a convolutional code that generates the CRC bits. An encoded frame may also include one or more bits that indicate the presence of data other than the speech packet (e.g., an information burst). In this example, the encoded frame includes a mixed-mode bit MM, which in this case is cleared (i.e., has a value of zero).

It may be desirable, occasionally or periodically, to include within an encoded frame information that is not part of the speech signal. For example, it may be desirable for an encoded frame to carry a burst of signaling information between the mobile station and another entity in the network, such as a BTS, BSC, MSC, PCF, or PDSN. A signaling information burst may carry at least part of a request to perform an action, such as to increase transmitting power or to measure a parameter (e.g., pilot strength), or a response to such a request (e.g., a measured parameter value). A signaling information burst relating to a handoff within the radio access network or from one radio access network to another may include updated network information, such as values for a network identifier (NID), a system identifier (SID), and/or a packet zone identifier (PZID). In some cases, the signaling information burst includes at least part of an In-System Traffic Parameters message that contains one or more of these handoff parameter values.

Alternatively, it may be desirable for an encoded frame to carry a burst of secondary traffic. A secondary traffic burst may include information that is occasionally updated, such as at least part of a geographical position information (e.g., Global Positioning System or GPS information) update. In another case, a secondary traffic burst may include at least part of a low-bit-rate data transmission, such as a paging message, a short messaging service (SMS) message, or an e-mail message.

In such cases, it may be desirable for the speech encoder to configure the encoded frame such that some bits are available to carry the other information. For example, it may be desirable for the speech encoder to encode the frame into a smaller speech packet by using a lower bit rate than the one indicated by the rate selection mechanism. Such an operation is called "dimming" or "source-level dimming." In one typical example of source-level dimming, the speech encoder is forced to use a half-rate scheme to encode a frame for which a full-rate scheme has otherwise been selected, although source-level dimming in general may include any rate reduction. A variable-rate speech encoder may be configured to perform a dim-and-burst technique to produce an encoded frame that includes a dimmed speech packet and a burst of other information. A description of such techniques may be found in, e.g., U.S. Pat. No. 5,504,773 (Padovani et al.).

Figure 7B:
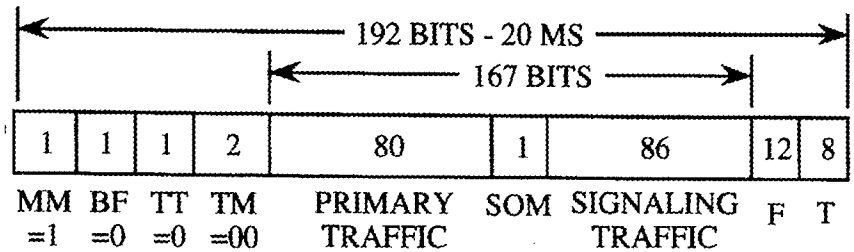
Figure 7C:
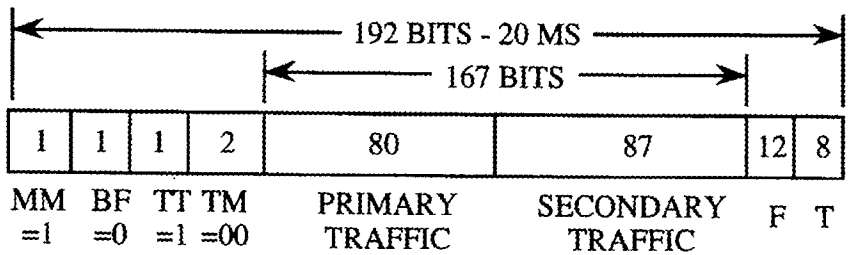

An encoded frame produced using a dim-and-burst technique may include one or more bits that indicate whether it includes signaling information or secondary traffic. FIG. 7B shows a format for an encoded frame that a dim-and-burst technique may use to include a half-rate speech packet (80 bits) of primary traffic and an 86-bit burst of signaling information. This frame includes a burst format bit BF which indicates whether a dim-and-burst or blank-and-burst format is used, a traffic type bit TT which indicates whether the burst contains signaling traffic or secondary traffic, and two traffic mode bits TM which may be used to indicate different numbers of bits for the primary traffic and/or for the signaling or secondary traffic, all of which are cleared in this case. The frame also includes a start-of-message bit SOM, which indicates whether the following bit is the first bit of the signaling message. FIG. 7C shows a format for an encoded frame that a dim-and-burst technique may use to include a half-rate packet of the speech signal and an 87-bit burst of secondary traffic. In this case, the frame format does not include a start-of-message bit, and traffic-type bit TT is set.

Excessive use of dimming may cause degradation in the quality of the encoded speech signal. In general, the use of dimming is limited to not more than five percent of full-rate frames, although more typically not more than one or possibly two percent of such frames are dimmed. In some cases, the speech encoder is configured to select the frames to be dimmed according to a binary mask file, where each bit of the mask file corresponds to a frame and the state of the bit indicates whether the frame is to be dimmed. In other cases, the speech encoder is configured to avoid dimming if possible by waiting until a half-rate frame is scheduled.

It may be desirable to implement a wideband coding system as an upgrade to an existing narrowband coding system. For example, it may be desirable to minimize changes to the network by using the same bit rates and packet sizes, with additional packet formats to support the additional wideband coding schemes. One existing type of narrowband speech codec, which uses IS-95-compliant frame formats as shown in FIGS. 7A-7C, is the Enhanced Variable Rate Codec, Release B (EVRC-B), as described in the Third Generation Partnership Project 2 (3GPP2) document C.S0014-B v1.0 (May 2006), available online at 3gpp2.org. It may be desirable to upgrade a system that supports EVRC-B to also support the Enhanced Variable Rate Codec, Release C (EVRC-C, also called EVRC-WB), as described in the 3GPP2 document C.S0014-C v1.0 (January 2007), also available online at 3gpp2.org.

As noted above, existing narrowband coding systems support the use of dim-and-burst techniques. It may be desirable to support dim-and-burst techniques in a wideband coding system. One approach to dimming of a wideband frame involves designing and implementing a lower-bit-rate (e.g., half-rate) wideband coding scheme for use with dimmed frames. A wideband speech encoder could be configured to encode dimmed frames according to such a scheme or, alternatively, to create a speech packet having the format of such a scheme by using selected bits of a speech packet encoded using a higher-bit-rate wideband coding scheme. In either case, however, designing a lower-bit-rate wideband coding scheme to have acceptable perceptual quality would be expensive. Implementing such a coding scheme would also be likely to consume more resources of the speech encoder, such as processing cycles and storage. Implementing an additional coding scheme would also increase system complexity.

Another approach to dimming of a wideband frame is to use a lower-bit-rate narrowband coding scheme to encode the dimmed wideband frame. Although such an approach involves the loss of highband information, it may be easier to implement within a wideband upgrade to an existing narrowband installation, as it may be configured to use an existing narrowband coding scheme (e.g., half-rate CELP). A corresponding speech decoder may be configured to reconstruct the missing highband information from highband information of one or more previous frames.

Figure 8A:
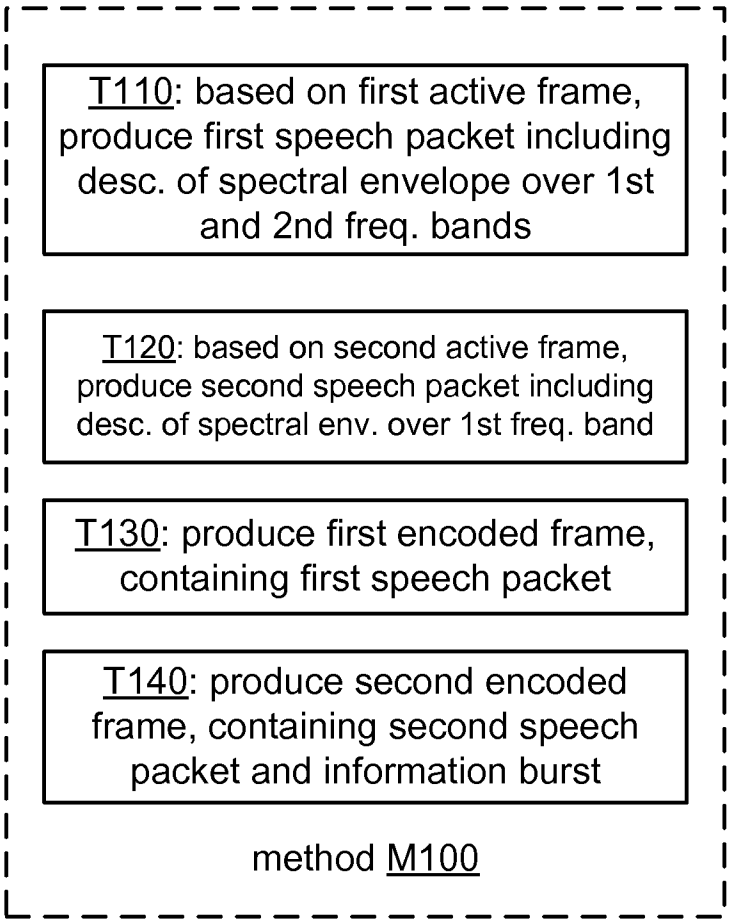
FIG. 8A is a flowchart for a method M100 according to a general configuration.

FIG. 8A shows a flowchart of a method M100 according to a general configuration that includes tasks T110, T120, T130, and T140. Task T110 is configured to produce a first speech packet based on a first active frame of a speech signal. The first speech packet includes a description of a spectral envelope over (A) a first frequency band and (B) a second frequency band that extends above the first frequency band. This description may be a single description that extends over both frequency bands, or it may include separate descriptions that each extend over a respective one of the frequency bands. Task T110 may also be configured to produce the first speech packet to contain a description of a temporal envelope over the first and second frequency bands. This description may be a single description that extends over both frequency bands, or it may include separate descriptions that each extend over a respective one of the frequency bands. It is expressly noted that the range of implementations of method M100 also include implementations in which task T110 is configured to produce the first speech packet based on an inactive frame of a speech signal.

Figure 9:
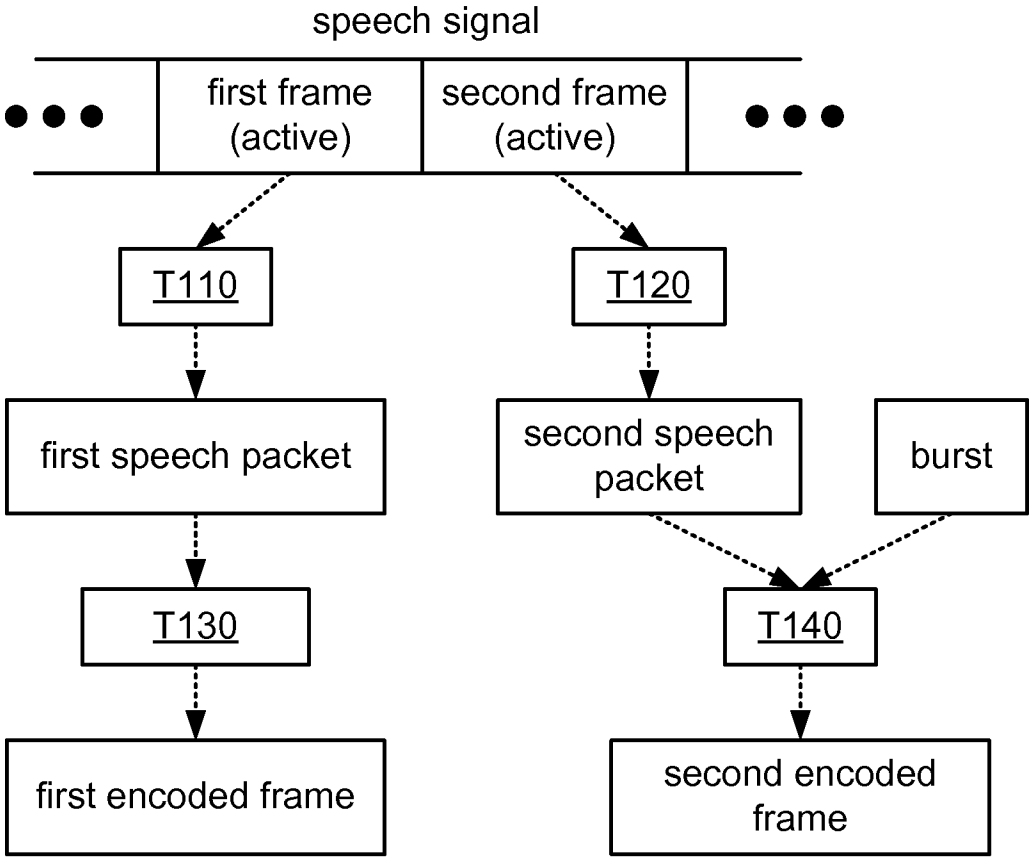
FIG. 9 illustrates an operation of encoding two successive active frames of a speech signal using an implementation of method M100.

Task T120 is configured to produce a second speech packet based on a second active frame of the speech signal that occurs in the speech signal after the first active frame (e.g., an active frame that immediately follows the first active frame, or an active frame that is separated from the first active frame by one or more other active frames). The second speech packet includes a description of a spectral envelope over the first frequency band. Task T120 may also be configured to produce the second speech packet to contain a description of temporal information for the first frequency band. Task T130 is configured to produce a first encoded frame that contains the first speech packet, and task T140 is configured to produce a second encoded frame that contains the second speech packet and a burst of an information signal that is separate from the speech signal. The first and second speech packets may also include descriptions of temporal information based on the respective frames. FIG. 9 illustrates an application of method M100.

Tasks T130 and T140 are configured to produce the first and second encoded frames to have the same size (e.g., 192 bits). Task T110 may be configured to produce the first speech packet to have a length that is greater than half the length of the first encoded frame. For example, task T110 may be configured to produce the first speech packet to have a length that is at least sixty, seventy, seventy-five, eighty, or eighty-five percent of the length of the first encoded frame. In one particular such example, task T110 is configured to produce the first speech packet to have a length of 171 bits. Alternatively, task T110 may be configured to produce the first speech packet to have a length that is not more than fifty, forty-five, or forty-two percent of the length of the first encoded frame. In one particular such example, task T110 is configured to produce the first speech packet to have a length of eighty bits.

Task T120 is configured to produce the second speech packet to have a length that is not greater than sixty percent of the length of the second encoded frame. For example, task T120 may be configured to produce the second speech packet to have a length that is not more than fifty, forty-five, or forty-two percent of the length of the second encoded frame. In one particular example, task T120 is configured to produce the second speech packet to have a length of eighty bits. Task T120 may also be configured such that the second speech packet does not include a description of a spectral envelope over the second frequency band and/or a description of temporal information for the second frequency band.

Method M100 is typically performed as part of a larger method of speech encoding, and speech encoders and methods of speech encoding that are configured to perform method M100 are expressly contemplated and hereby disclosed. Such an encoder or method may be configured to encode an active frame in the speech signal that follows the second frame (e.g., an active frame that immediately follows the second frame, or an active frame that is separated from the second frame by one or more other active frames) using the same format as the first encoded frame or using the same format as the second encoded frame. Alternatively, such an encoder or method may be configured to encode an unvoiced or inactive frame following the second frame using a different coding scheme. A corresponding speech decoder may be configured to use information that has been decoded from the first encoded frame to supplement the decoding of an active frame from another encoded frame that occurs in the encoded speech signal after the first encoded frame. Elsewhere in this description, speech decoders and methods of decoding frames of a speech signal are disclosed that use information that has been decoded from the first encoded frame in decoding one or more subsequent active frames.

Figure 10:
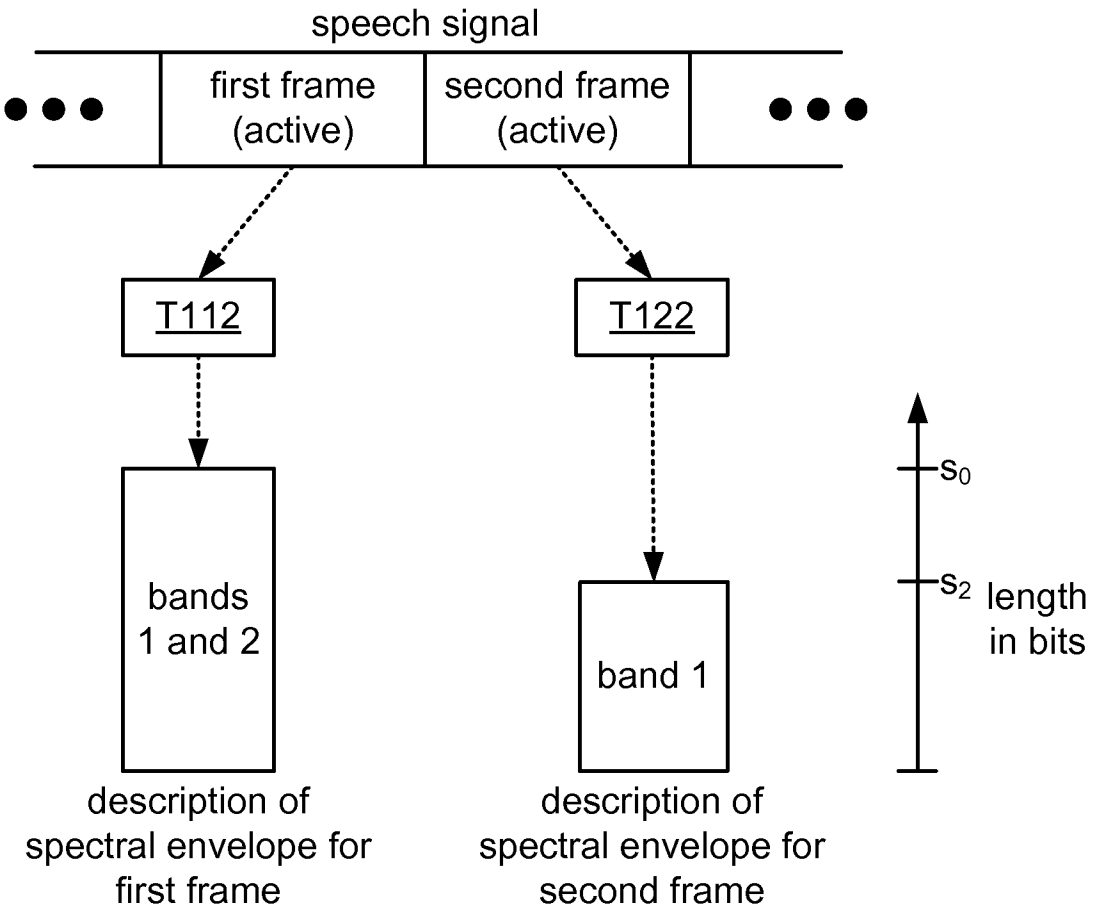
FIG. 10 illustrates an operation of tasks T110 and T120 of method M100.

One or both of tasks T110 and T120 may be configured to calculate the respective descriptions of a spectral envelope. FIG. 10 shows an application of a subtask T112 of such an implementation of task T110 that is configured to calculate, based on the first frame, a description of a spectral envelope over the first and second frequency bands. FIG. 10 also shows an application of a subtask T122 of such an implementation of task T120 that is configured to calculate, based on the second frame, a description of a spectral envelope over the first frequency band. Tasks T110 and T120 may also be configured to calculate descriptions of temporal information based on the respective frames, which descriptions may be included in the respective speech packets.

Tasks T110 and T120 may be configured such that the second speech packet includes a description of a spectral envelope over the first frequency band, where the length of the description is not less than half the length of the description of a spectral envelope over the first and second frequency bands that is included in the first speech packet. For example, tasks T110 and T120 may be configured such that the length of the description of a spectral envelope over the first frequency band in the second speech packet is at least fifty-five or sixty percent of the length of the description of a spectral envelope over the first and second frequency bands that is included in the first speech packet. In one particular example, the length of the description of a spectral envelope over the first frequency band in the second speech packet is twenty-two bits, and the length of the description of a spectral envelope over the first and second frequency bands that is included in the first speech packet is thirty-six bits.

The second frequency band is different than the first frequency band, although method M110 may be configured such that the two frequency bands overlap. Examples of a lower bound for the first frequency band include zero, fifty, 100, 300, and 500 Hz, and examples of an upper bound for the first frequency band include three, 3.5, four, 4.5, and 5 kHz. Examples of a lower bound for the second frequency band include 2.5, 3, 3.5, 4, and 4.5 kHz, and examples of an upper bound for the second frequency band include 7, 7.5, 8, and 8.5 kHz. All five hundred possible combinations of the above bounds are expressly contemplated and hereby disclosed, and application of any such combination to any implementation of method M110 is also expressly contemplated and hereby disclosed. In one particular example, the first frequency band includes the range of about fifty Hz to about four kHz and the second frequency band includes the range of about four to about seven kHz. In another particular example, the first frequency band includes the range of about 100 Hz to about four kHz and the second frequency band includes the range of about 3.5 to about seven kHz. In a further particular example, the first frequency band includes the range of about 300 Hz to about four kHz and the second frequency band includes the range of about 3.5 to about seven kHz. In these examples, the term "about" indicates plus or minus five percent, with the bounds of the various frequency bands being indicated by the respective 3-dB points.

Figure 8B:
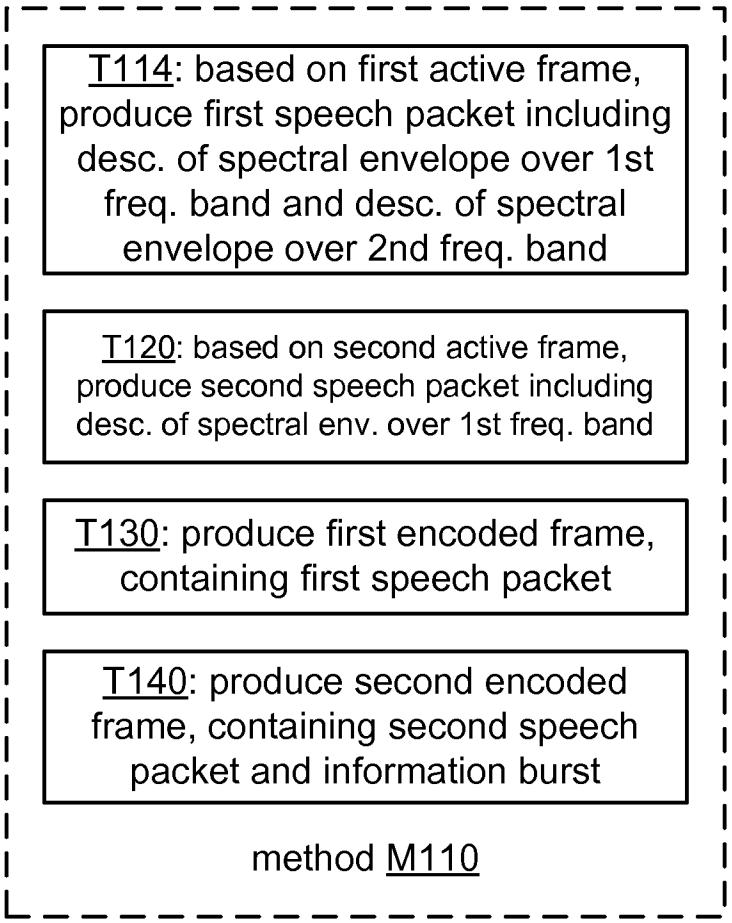
FIG. 8B is a flowchart for an implementation M110 of method M100.

As noted above, for wideband applications a split-band coding scheme may have advantages over a full-band coding scheme, such as increased coding efficiency and support for backward compatibility. It may be desirable to implement method M100 to produce the first encoded frame using a split-band coding scheme rather than a full-band coding scheme. FIG. 8B shows a flowchart for an implementation M110 of method M100 that includes an implementation T114 of task T110. As an implementation of task T110, task T114 is configured to produce a first speech packet that includes a description of a spectral envelope over the first and second frequency bands. In this case, task T114 is configured to produce the first speech packet to include a description of a spectral envelope over the first frequency band and a description of a spectral envelope over the second frequency band, such that the two descriptions are separate from one another (although possibly adjacent to one another in the speech packet).

Figure 11:
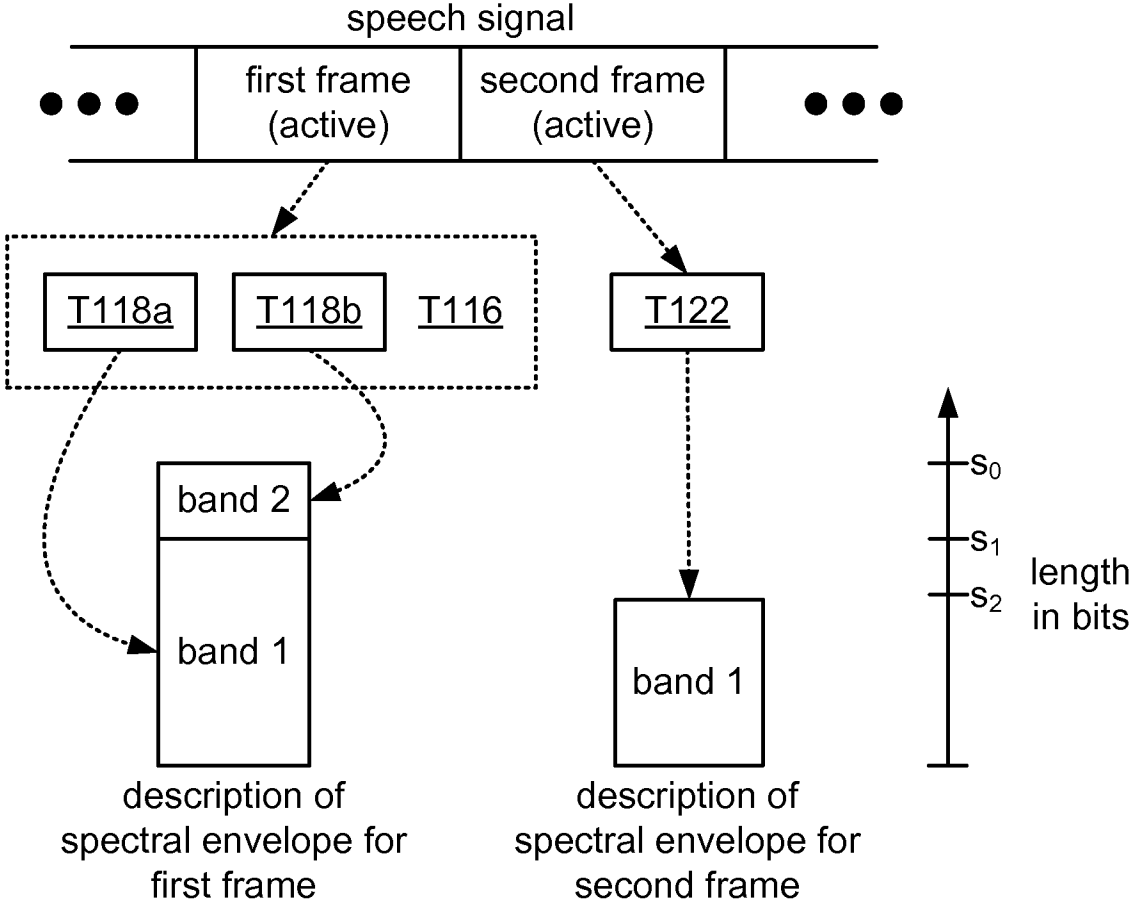
FIG. 11 illustrates an operation of an implementation of task T112 and task T120 of method M110.

Task T114 may be configured to calculate the descriptions of a spectral envelope using a split-band coding scheme. FIG. 11 shows an application of a subtask T116 of such an implementation of task T114, where subtask T116 is a split-band implementation of subtask T112. Subtask T116 includes a subtask T118*a* that is configured to calculate, based on the first frame, the description of a spectral envelope over the first frequency band. Subtask T116 also includes a subtask T118*b* that is configured to calculate, based on the first frame, the description of a spectral envelope over the second frequency band. Tasks T118*a* and T118*b* may also be configured to calculate separate descriptions of temporal information over the two frequency bands.

Calculation of descriptions of spectral and/or temporal information for a frame may be based on information from one or more previous frames. In such a case, using a narrowband coding scheme to encode the second frame may reduce encoding performance for one or more subsequent frames.

Task T120 may include a subtask T124 (not shown) that is configured to calculate, based on the second frame, a description of a spectral envelope over the second frequency band and/or a description of temporal information for the second frequency band. For example, task T120 may be configured to encode the second frame using a wideband coding scheme. As noted above, task T120 may be configured such that the second speech packet does not include a description of a spectral envelope over the second frequency band or a description of temporal information for the second frequency band. Even in such case, however, calculating such information for the second frequency band, so that it may be available at the encoder for use in encoding one or more subsequent frames on the basis of such historical information, may provide better perceptual quality over those frames than encoding them without such information. Alternatively, task T120 may be configured to use a narrowband coding scheme to encode the first frequency band of the second frame and to initialize the histories for the second frequency band of the next frame (e.g., by resetting a memory that stores past spectral and/or temporal information). In a further alternative, task T120 is configured to use a narrowband coding scheme to encode the first frequency band of the second frame and to estimate a description of a spectral envelope over the second frequency band (and/or a description of temporal information for the second frequency band) for the second frame using an erasure handling routine. For example, such an implementation of task T120 may be configured to estimate a description of a spectral envelope over the second frequency band (and/or a description of temporal information for the second frequency band) for the second frame based on information from the first frame and possibly from one or more previous frames.

Tasks T118*a* and T118*b* may be configured to calculate descriptions of spectral envelopes over the two frequency bands that have the same length, or one of the tasks T118*a* and T118*b* may be configured to calculate a description that is longer than the description calculated by the other task. For example, tasks T118*a* and T118*b* may be configured such that the length of the description of a spectral envelope over the second frequency band in the first speech packet as calculated by task T118*b* is not more than fifty, forty, or thirty percent of the length of the description of a spectral envelope over the first frequency band in the first speech packet as calculated by task T118*a*. In one particular example, the length of the description of a spectral envelope over the first frequency band in the first speech packet is twenty-eight bits, and the length of the description of a spectral envelope over the second frequency band in the first speech packet is eight bits. Tasks T118*a* and T118*b* may also be configured to calculate separate descriptions of temporal information for the two frequency bands.

Tasks T118*a* and T122 may be configured to calculate descriptions of spectral envelopes over the first frequency band that have the same length, or one of the tasks T118*a* and T122 may be configured to calculate a description that is longer than the description calculated by the other task. For example, tasks T118*a* and T122 may be configured such that the length of the description of a spectral envelope over the first frequency band in the second speech packet as calculated by task T122 is at least fifty, sixty, seventy, or seventy-five percent of the length of the description of a spectral envelope over the first frequency band in the first speech packet as calculated by task T118*a*. In one particular example, the length of the description of a spectral envelope over the first frequency band in the first speech packet is twenty-eight bits, and the length of the description of a spectral envelope over the first frequency band in the second speech packet is twenty-two bits.

The table of FIG. 13 shows one set of four different coding schemes that a speech encoder may use to perform a method of speech encoding that includes an implementation of method M100. In this example, a full-rate wideband CELP coding scheme ("coding scheme 1") is used to encode voiced frames. This coding scheme uses 153 bits to encode the narrowband portion of the frame and 16 bits to encode the highband portion. For the narrowband, coding scheme 1 uses 28 bits to encode a description of the spectral envelope (e.g., as one or more quantized LSP vectors) and 125 bits to encode a description of the excitation signal. For the highband, coding scheme 1 uses 8 bits to encode the spectral envelope (e.g., as one or more quantized LSP vectors) and 8 bits to encode a description of the temporal envelope.

It may be desirable to configure coding scheme 1 to derive the highband excitation signal from the narrowband excitation signal, such that no bits of the encoded frame are needed to carry the highband excitation signal. It may also be desirable to configure coding scheme 1 to calculate the highband temporal envelope relative to the temporal envelope of the highband signal as synthesized from other parameters of the encoded frame (e.g., including the description of a spectral envelope over the second frequency band). Such features are described in more detail in, for example, U.S. Pat. Appl. Pub. 2006/0282262 cited above.

In an example according to the table of FIG. 12, a half-rate narrowband CELP coding scheme ("coding scheme 2") is used to encode dimmed frames. This coding scheme uses 80 bits to encode the narrowband portion of the frame (and no bits to encode the highband portion). Coding scheme 2 uses 22 bits to encode a description of the spectral envelope (e.g., as one or more quantized LSP vectors) and 58 bits to encode a description of the excitation signal.

As compared to a voiced speech signal, an unvoiced speech signal typically contains more of the information that is important to speech comprehension in the highband. Thus it may be desirable to use more bits to encode the highband portion of an unvoiced frame than to encode the highband portion of a voiced frame, even for a case in which the voiced frame is encoded using a higher overall bit rate. In an example according to the table of FIG. 12, a half-rate wideband NELP coding scheme ("coding scheme 3") is used to encode unvoiced frames. Instead of 16 bits as is used by coding scheme 1 to encode the highband portion of a voiced frame, this coding scheme uses 27 bits to encode the highband portion of the frame: 12 bits to encode a description of the spectral envelope (e.g., as one or more quantized LSP vectors) and 15 bits to encode a description of the temporal envelope (e.g., as a quantized gain frame and/or gain shape). To encode the narrowband portion, coding scheme 3 uses 47 bits: 28 bits to encode a description of the spectral envelope (e.g., as one or more quantized LSP vectors) and 19 bits to encode a description of the temporal envelope (e.g., as a quantized gain frame and/or gain shape).

In an example according to the table of FIG. 12, an eighth-rate narrowband NELP coding scheme ("coding scheme 4") is used to encode inactive frames at a rate of 16 bits per frame, with 10 bits to encode a description of the spectral envelope (e.g., as one or more quantized LSP vectors) and 5 bits to encode a description of the temporal envelope (e.g., as a quantized gain frame and/or gain shape). Another example of coding scheme 4 uses 8 bits to encode the description of the spectral envelope and 6 bits to encode the description of the temporal envelope.

In an example according to FIG. 12, coding scheme 2 and/or coding scheme 4 may be a legacy coding scheme from an underlying narrowband installation. Such a speech encoder or method of speech encoding may also be configured to support other legacy coding schemes and/or new coding schemes. The table of FIG. 13 shows a set of bit allocations for a full-rate packet (171 bits) as produced by an example of wideband CELP coding scheme 1. The table of FIG. 14 shows a set of bit allocations for a half-rate packet (eighty bits) as produced by an example of narrowband CELP coding scheme 2. One particular example of task T110 uses a full-rate CELP coding scheme (e.g., according to coding scheme 1 in the table of FIG. 12) to produce the first speech packet based on a voiced or transitional frame of the speech signal. Another particular example of task T110 uses a half-rate NELP coding scheme (e.g., according to coding scheme 3 in the table of FIG. 12) to produce the first speech packet based on an unvoiced frame of the speech signal. A further particular example of task T110 uses an eighth-rate NELP coding scheme (e.g., according to coding scheme 4 in the table of FIG. 12) to produce the first speech packet based on an inactive frame of the speech signal.

In a typical application of an implementation of method M100, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.) that is readable and/or executable by a machine (e.g., a computer) including an array of logic elements (e.g., a processor, microprocessor, microcontroller, or other finite state machine). The tasks of an implementation of method M100 may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to transmit the encoded frames.

A further approach to using a dim-and-burst technique in a wideband context is to use the highband portion of a dimmed packet to carry the information burst. In this case, a higher-bit-rate (e.g., full-rate) wideband coding scheme may be modified such that each speech packet it produces includes a bit reserved for use as a mixed-mode indicator, and the speech encoder may be configured to set the mixed-mode bit to indicate that the highband portion of the speech packet contains signaling information or secondary traffic instead of the usual highband speech information.

Figure 15A:
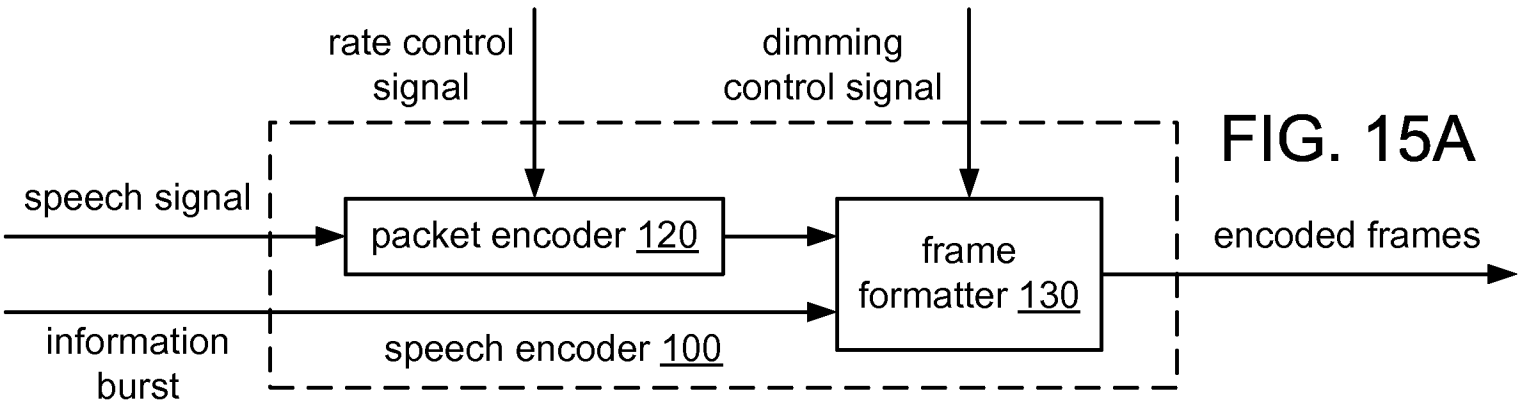
FIG. 15A shows a block diagram of a speech encoder 100 according to a general configuration.

FIG. 15A shows a block diagram of a speech encoder 100 according to a general configuration. Speech encoder 100 includes a packet encoder 120 arranged to receive frames of a speech signal and a rate control signal. Packet encoder 120 is configured to produce speech packets according to a rate indicated by the rate control signal. Speech encoder 100 also includes a frame formatter 130 arranged to receive speech packets, an information burst, and a dimming control signal. Frame formatter 130 is configured to produce encoded frames according to a state of the dimming control signal. A communications device that includes speech encoder 100, such as a cellular telephone, may be configured to perform further processing operations on the encoded frames, such as error-correction and/or redundancy coding, before transmitting them into a wired, wireless, or optical transmission channel.

In this example, speech encoder 100 receives the rate control signal from another module. Speech encoder 100 may also be implemented to include a rate selection module that is configured to generate the rate control signal (e.g., according to an open-loop or open-and-closed loop rate selection algorithm as described above). In such case, the rate selection module may be configured to control a dimming operation (e.g., according to a binary mask file as described above) and to generate the dimming control signal. Alternatively, the rate selection module may be configured to receive an override signal, related to the dimming control signal, from another module that is either within or external to the speech encoder. Speech encoder 100 may also be configured to perform one or more pre-processing operations on the received frames, such as a perceptual weighting or other filtering operation.

Packet encoder 120 is configured to produce, based on a first active frame of the speech signal and in response to a first state of the rate control signal, a first speech packet as described above that includes a description of a spectral envelope over the first and second frequency bands. For example, the first state of the rate control signal may indicate wideband coding scheme 1 according to the example of FIG. 12. Packet encoder 120 is also configured to produce, based on a second active frame of the speech signal and in response to a second state of the rate control signal different than the first state, a second speech packet as described above that includes a description of a spectral envelope over the first frequency band. For example, the second state of the rate control signal may indicate narrowband coding scheme 2 according to the example of FIG. 12.

Figure 15B:
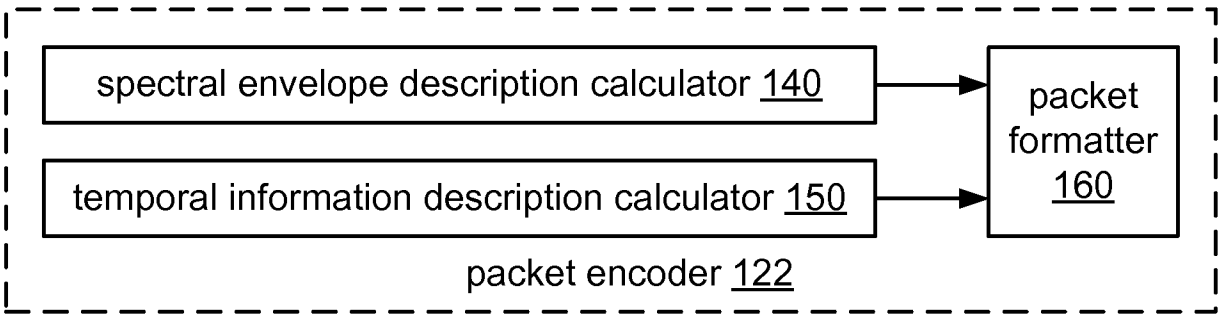
FIG. 15B shows a block diagram of an implementation 122 of packet encoder 120.

FIG. 15B shows a block diagram of an implementation 122 of packet encoder 120 that includes a spectral envelope description calculator 140, a temporal information description calculator 150, and a packet formatter 160. Spectral envelope description calculator 140 is configured to calculate a description of a spectral envelope for each frame to be encoded. Temporal information description calculator 150 is configured to calculate a description of temporal information for each frame to be encoded. Packet formatter 160 is configured to produce a speech packet that includes the calculated description of a spectral envelope and the calculated description of temporal information. Packet formatter 160 may be configured to produce the speech packet according to a desired packet format (e.g., as indicated by the state of the rate control signal), possibly using different formats for different coding schemes. Packet formatter 160 may be configured to produce the speech packet to include additional information, such as a set of one or more bits that identifies the coding scheme, or the coding rate or mode, according to which the frame is encoded (also called a "coding index").

Spectral envelope description calculator 140 is configured to calculate, according to a state of the rate control signal, a description of a spectral envelope for each frame to be encoded. The description is based on the current frame and may also be based on at least part of one or more other frames. For example, calculator 140 may be configured to apply a window that extends into one or more adjacent frames and/or to calculate an average of descriptions (e.g., an average of LSP vectors) of two or more frames.

Figure 15C:
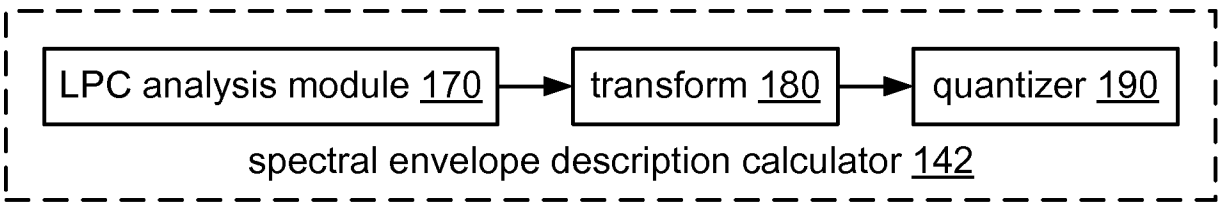
FIG. 15C shows a block diagram of an implementation 142 of spectral envelope description calculator 140.

Calculator 140 may be configured to calculate the description of a spectral envelope for the frame by performing a spectral analysis such as an LPC analysis. FIG. 15C shows a block diagram of an implementation 142 of spectral envelope description calculator 140 that includes an LPC analysis module 170, a transform block 180, and a quantizer 190.

Analysis module 170 is configured to perform an LPC analysis of the frame and to produce a corresponding set of model parameters. For example, analysis module 170 may be configured to produce a vector of LPC coefficients such as filter coefficients or reflection coefficients. Analysis module 170 may be configured to perform the analysis over a window that includes portions of one or more neighboring frames. In some cases, analysis module 170 is configured such that the order of the analysis (e.g., the number of elements in the coefficient vector) is selected according to the coding scheme indicated by coding scheme selector 120.

Transform block 180 is configured to convert the set of model parameters into a form that is more efficient for quantization. For example, transform block 180 may be configured to convert an LPC coefficient vector into a set of LSPs. In some cases, transform block 180 is configured to convert the set of LPC coefficients into a particular form according to the coding scheme indicated by coding scheme selector 120.

Quantizer 190 is configured to produce the description of a spectral envelope in quantized form by quantizing the converted set of model parameters. Quantizer 190 may be configured to quantize the converted set by truncating elements of the converted set and/or by selecting one or more quantization table indices to represent the converted set. It may be desirable to configure quantizer 190 to quantize the converted set into a particular form and/or length according to a state of the rate control signal. For example, quantizer 190 may be implemented to produce a quantized description as described in FIG. 13 in response to the first state of the rate control signal and to produce a quantized description as described in FIG. 14 in response to the second state of the rate control signal.

Temporal information description calculator 150 is configured to calculate a description of temporal information of a frame. The description may be based on temporal information of at least part of one or more other frames as well. For example, calculator 150 may be configured to calculate the description over a window that extends into one or more adjacent frames and/or to calculate an average of descriptions of two or more frames.

Temporal information description calculator 150 may be configured to calculate a description of temporal information that has a particular form and/or length according to the state of the rate control signal. For example, calculator 150 may be configured to calculate, according to the state of the rate control signal, a description of temporal information that includes one or both of (A) a temporal envelope of the frame and (B) an excitation signal of the frame, which may include a description of at least one pitch component (e.g., pitch delay or lag, pitch gain, and/or a description of a prototype). In an LPC coder, pitch lag is typically calculated as the lag value that maximizes the autocorrelation function of an LPC residual of the frame. An excitation signal may also be based on other information such as values from an adaptive codebook (also called a pitch codebook) and/or values from a fixed codebook (also called an innovation codebook and possibly indicating locations of pulses).

Calculator 150 may be configured to calculate a description of temporal information that includes a temporal envelope of the frame (e.g., a gain frame value and/or gain shape values). For example, calculator 150 may be configured to output such a description in response to an indication of a NELP coding scheme. As described herein, calculating such a description may include calculating the signal energy over a frame or subframe as a sum of squares of the signal samples, calculating the signal energy over a window that includes parts of other frames and/or subframes, and/or quantizing the calculated temporal envelope.

Calculator 150 may be configured to calculate a description of temporal information of a frame that includes information relating to pitch or periodicity of the frame. For example, calculator 150 may be configured to output a description that includes pitch information of the frame, such as pitch lag or delay and/or pitch gain, in response to an indication of a CELP coding scheme. In some cases, information relating to a pitch component for a frame, such as an excitation signal or a parameter such as pitch lag, may be obtained from a corresponding speech packet and also from a previous speech packet. Alternatively or additionally, calculator 150 may be configured to output a description of a periodic waveform (also called a "prototype") in response to an indication of a PPP coding scheme. Calculating pitch and/or prototype information typically includes extracting such information from the LPC residual and may also include combining pitch and/or prototype information from the current frame with such information from one or more past frames. Calculator 150 may also be configured to quantize such a description of temporal information (e.g., as one or more table indices).

Calculator 150 may be configured to calculate a description of temporal information of a frame that includes an excitation signal. For example, calculator 150 may be configured to output a description that includes an excitation signal in response to an indication of a CELP coding scheme. The excitation signal may also include a description of a pitch component (e.g., pitch delay or lag, pitch gain, and/or a description of a prototype). Calculating an excitation signal typically includes deriving such a signal from the LPC residual and may also include combining excitation information from the current frame with such information from one or more past frames. Calculator 150 may also be configured to quantize such a description of temporal information (e.g., as one or more table indices). For cases in which speech encoder 132 supports a relaxed CELP (RCELP) coding scheme, calculator 150 may be configured to regularize the excitation signal.

Figure 16A:
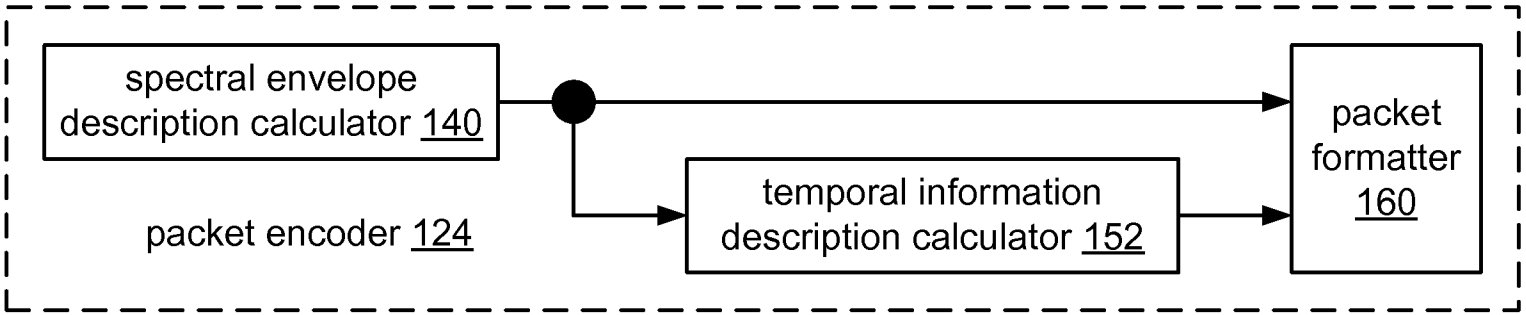
FIG. 16A shows a block diagram of an implementation 124 of packet encoder 122.

FIG. 16A shows a block diagram of an implementation 124 of packet encoder 122 that includes an implementation 152 of temporal information description calculator 150. Calculator 152 is configured to calculate a description of temporal information for a frame (e.g., an excitation signal, pitch and/or prototype information) that is based on a description of a spectral envelope of the frame as calculated by spectral envelope description calculator 140.

Figure 16B:
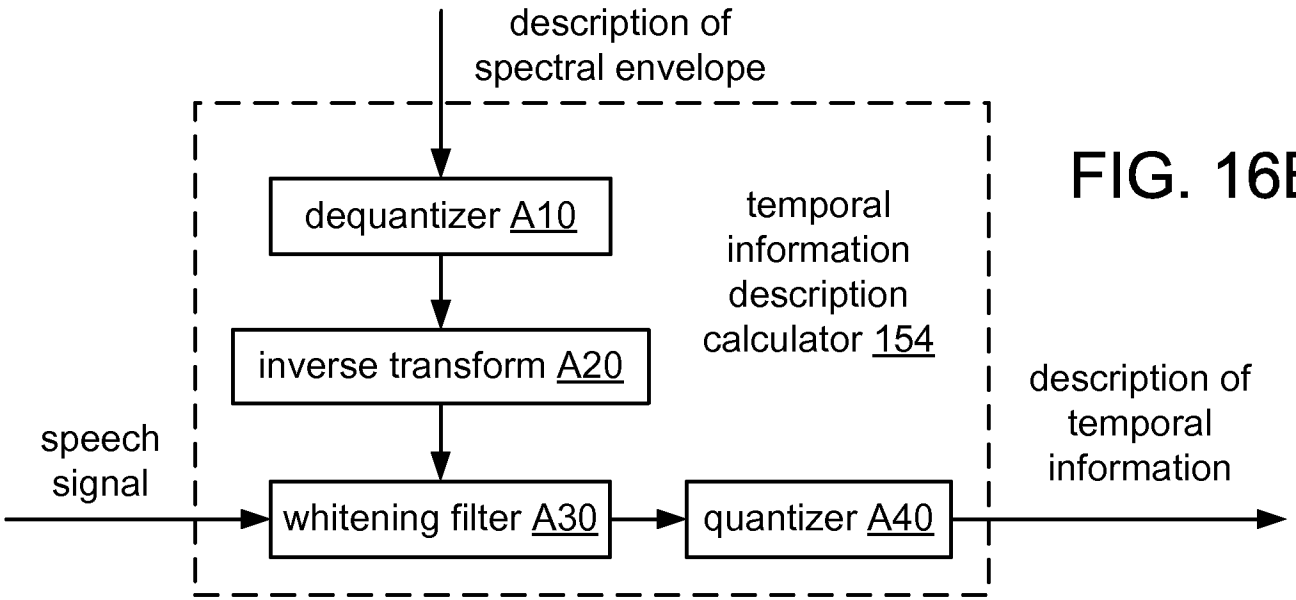
FIG. 16B shows a block diagram of an implementation 154 of temporal information description calculator 152.

FIG. 16B shows a block diagram of an implementation 154 of temporal information description calculator 152 that is configured to calculate a description of temporal information based on an LPC residual for the frame. In this example, calculator 154 is arranged to receive the description of a spectral envelope of the frame as calculated by spectral envelope description calculator 142. Dequantizer A10 is configured to dequantize the description, and inverse transform block A20 is configured to apply an inverse transform to the dequantized description to obtain a set of LPC coefficients. Whitening filter A30 is configured according to the set of LPC coefficients and arranged to filter the speech signal to produce an LPC residual. Quantizer A40 is configured to quantize a description of temporal information for the frame (e.g., as one or more table indices) that is based on the LPC residual and is possibly also based on pitch information for the frame and/or temporal information from one or more past frames.

It may be desirable to use an implementation of packet encoder 122 to encode frames of a wideband speech signal according to a split-band coding scheme. In such case, spectral envelope description calculator 140 may be configured to calculate the various descriptions of spectral envelopes of a frame over the respective frequency bands serially and/or in parallel and possibly according to different coding modes and/or rates. Temporal information description calculator 150 may also be configured to calculate descriptions of temporal information of the frame over the various frequency bands serially and/or in parallel and possibly according to different coding modes and/or rates.

Figure 17A:
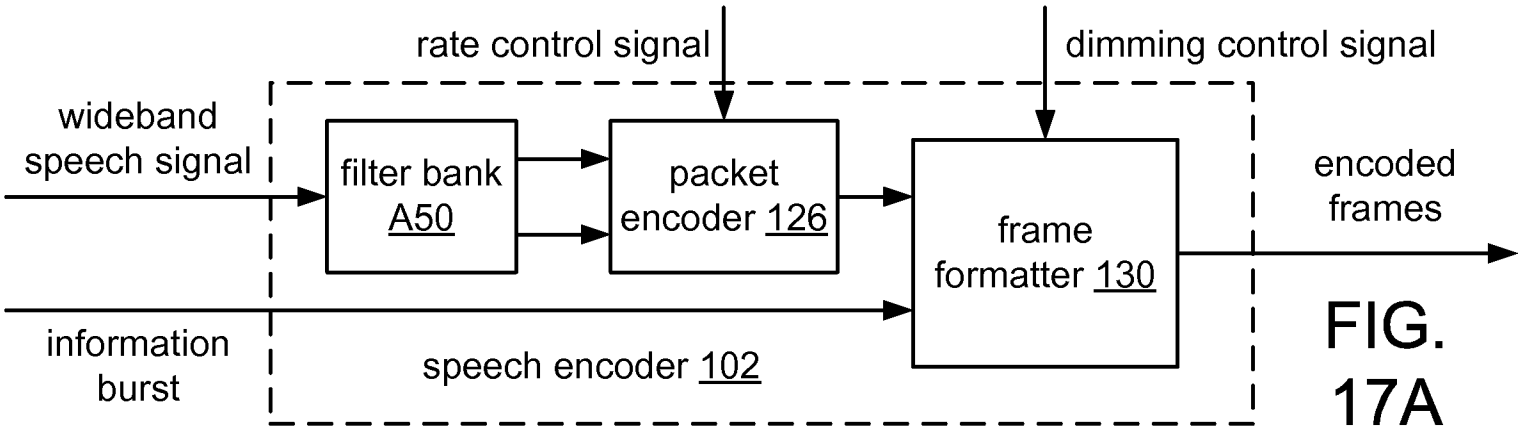
FIG. 17A shows a block diagram of an implementation 102 of speech encoder 100 that is configured to encode a wideband speech signal according to a split-band coding scheme.

FIG. 17A shows a block diagram of an implementation 102 of speech encoder 100 that is configured to encode a wideband speech signal according to a split-band coding scheme. Speech encoder 102 includes a filter bank A50 that is configured to filter the speech signal to produce a subband signal containing content of the speech signal over the first frequency band (e.g., a narrowband signal) and a subband signal containing content of the speech signal over the second frequency band (e.g., a highband signal). Particular examples of such filter banks are described in, e.g., U.S. Pat. Appl. Publ. No. 2007/088558 (Vos et al.), "SYSTEMS, METHODS, AND APPARATUS FOR SPEECH SIGNAL FILTERING," published Apr. 19, 2007. For example, filter bank A50 may include a lowpass filter configured to filter the speech signal to produce a narrowband signal and a highpass filter configured to filter the speech signal to produce a highband signal. Filter bank A50 may also include a downsampler configured to reduce the sampling rate of the narrowband signal and/or of the highband signal according to a desired respective decimation factor, as described in, e.g., U.S. Pat. Appl. Publ. No. 2007/088558 (Vos et al.). Speech encoder 102 may also be configured to perform a noise suppression operation on at least the highband signal, such as a highband burst suppression operation as described in U.S. Pat. Appl. Publ. No. 2007/088541 (Vos et al.), "SYSTEMS, METHODS, AND APPARATUS FOR HIGHBAND BURST SUPPRESSION," published Apr. 19, 2007.

Figure 17B:
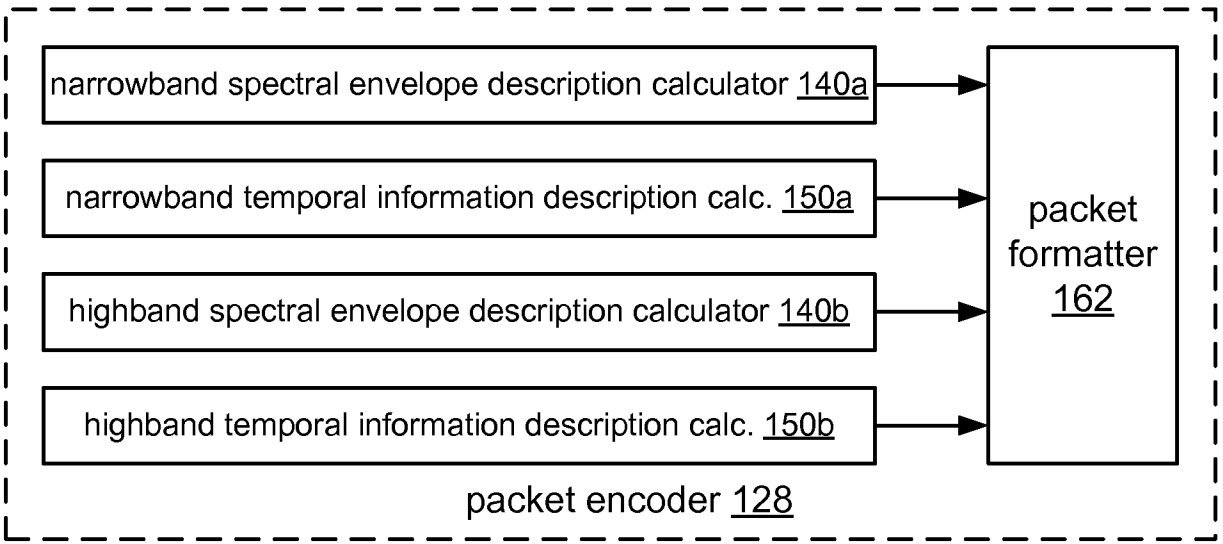
FIG. 17B shows a block diagram of an implementation 128 of packet encoder 126.

Speech encoder 102 also includes an implementation 126 of packet encoder 120 that is configured to encode the separate subband signals according to the state of the rate control signal. FIG. 17B shows a block diagram of an implementation 128 of packet encoder 126. Packet encoder 128 includes a spectral envelope calculator 140*a* (e.g., an instance of calculator 142) and a temporal information calculator 150*a* (e.g., an instance of calculator 152 or 154) that are configured to calculate descriptions of spectral envelopes and temporal information, respectively, based on a narrowband signal produced by filter band A50 and according to a coding scheme as indicated by the state of the rate control signal. Packet encoder 128 also includes a spectral envelope calculator 140*b* (e.g., an instance of calculator 142) and a temporal information calculator 150*b* (e.g., an instance of calculator 152 or 154) that are configured to produce calculated descriptions of spectral envelopes and temporal information, respectively, based on a highband signal produced by filter band A50 and according to a coding scheme as indicated by the state of the rate control signal. Packet encoder 128 also includes an implementation 162 of packet formatter 160 configured to produce a speech packet that includes the calculated descriptions of spectral envelopes and temporal information for one or both of the narrowband and highband signals as indicated by the state of the rate control signal.

Figure 18A:
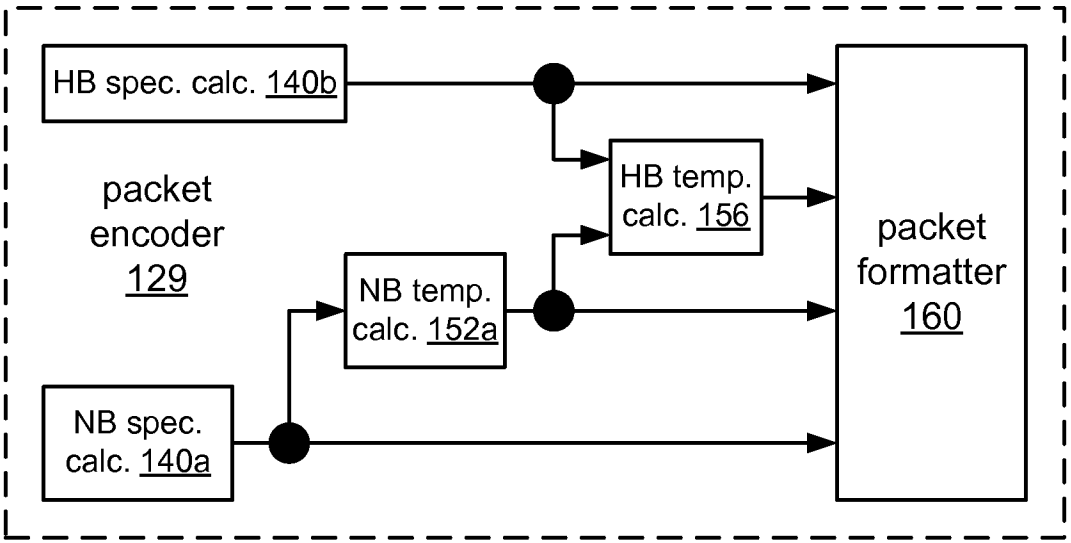
FIG. 18A shows a block diagram of an implementation 129 of packet encoder 126.

As noted above, a description of temporal information for the highband portion of a wideband speech signal may be based on a description of temporal information for the narrowband portion of the signal. FIG. 18A shows a block diagram of a corresponding implementation 129 of packet encoder 126. Like packet encoder 128 described above, packet encoder 129 includes spectral envelope description calculators 140*a* and 140*b* that are arranged to calculate respective descriptions of spectral envelopes. Packet encoder 129 also includes an instance 152*a* of temporal information description calculator 152 (e.g., calculator 154) that is arranged to calculate a description of temporal information based on the calculated description of a spectral envelope for the narrowband signal. Packet encoder 129 also includes an implementation 156 of temporal information description calculator 150. Calculator 156 is configured to calculate a description of temporal information for the highband signal that is based on a description of temporal information for the narrowband signal.

Figure 18B:
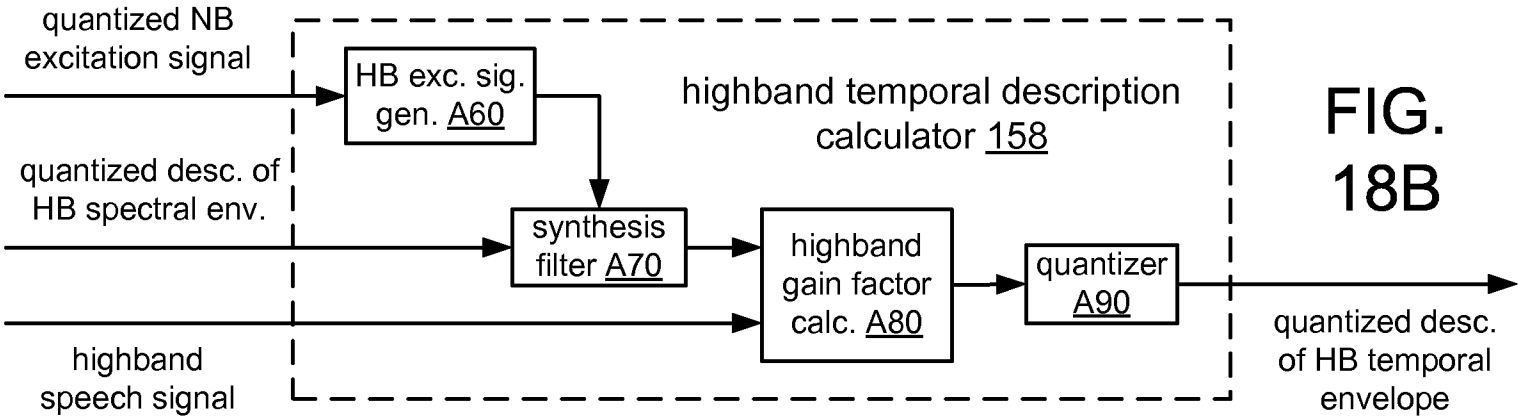
FIG. 18B shows a block diagram of an implementation 158 of temporal description calculator 156.

FIG. 18B shows a block diagram of an implementation 158 of temporal description calculator 156. Calculator 158 includes a highband excitation signal generator A60 that is configured to generate a highband excitation signal based on a narrowband excitation signal as produced by calculator 152*a*. For example, generator A60 may be configured to perform an operation such as spectral extension, harmonic extension, nonlinear extension, spectral folding, and/or spectral translation on the narrowband excitation signal (or one or more components thereof) to generate the highband excitation signal. Additionally or in the alternative, generator A60 may be configured to perform spectral and/or amplitude shaping of random noise (e.g., a pseudorandom Gaussian noise signal) to generate the highband excitation signal. For a case in which generator A60 uses a pseudorandom noise signal, it may be desirable to synchronize generation of this signal by the encoder and the decoder. Such methods of and apparatus for highband excitation signal generation are described in more detail in, for example, U.S. Pat. Appl. Pub. 2007/0088542 (Vos et al.), "SYSTEMS, METHODS, AND APPARATUS FOR WIDEBAND SPEECH CODING," published Apr. 19, 2007. In the example of FIG. 18B, generator A60 is arranged to receive a quantized narrowband excitation signal. In another example, generator A60 is arranged to receive the narrowband excitation signal in another form (e.g., in a pre-quantization or dequantized form).

Calculator 158 also includes a synthesis filter A70 configured to generate a synthesized highband signal that is based on the highband excitation signal and a description of a spectral envelope of the highband signal (e.g., as produced by calculator 140*b*). Filter A70 is typically configured according to a set of values within the description of a spectral envelope of the highband signal (e.g., one or more LSP or LPC coefficient vectors) to produce the synthesized highband signal in response to the highband excitation signal. In the example of FIG. 18B, synthesis filter A70 is arranged to receive a quantized description of a spectral envelope of the highband signal and may be configured accordingly to include a dequantizer and possibly an inverse transform block. In another example, filter A70 is arranged to receive the description of a spectral envelope of the highband signal in another form (e.g., in a pre-quantization or dequantized form).

Calculator 158 also includes a highband gain factor calculator A80 that is configured to calculate a description of a temporal envelope of the highband signal based on a temporal envelope of the synthesized highband signal. Calculator A80 may be configured to calculate this description to include one or more distances between a temporal envelope of the highband signal and the temporal envelope of the synthesized highband signal. For example, calculator A80 may be configured to calculate such a distance as a gain frame value (e.g., as a ratio between measures of energy of corresponding frames of the two signals, or as a square root of such a ratio). Additionally or in the alternative, calculator A80 may be configured to calculate a number of such distances as gain shape values (e.g., as ratios between measures of energy of corresponding subframes of the two signals, or as square roots of such ratios). In the example of FIG. 18B, calculator 158 also includes a quantizer A90 configured to quantize the calculated description of a temporal envelope (e.g., as one or more codebook indices). Various features and implementations of the elements of calculator 158 are described in, for example, U.S. Pat. Appl. Pub. 2007/0088542 (Vos et al.) as cited above.

The various elements of an implementation of speech encoder 100 may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of speech encoder 100 as described herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of speech encoder 100 may also be embodied as one or more computers (e.g., machines including one or more arrays programmed to execute one or more sets or sequences of instructions, also called "processors"), and any two or more, or even all, of these elements may be implemented within the same such computer or computers.

The various elements of an implementation of speech encoder 100 may be included within a device for wireless communications such as a cellular telephone or other device having such communications capability. Such a device may be configured to communicate with circuit-switched and/or packet-switched networks (e.g., using one or more protocols such as VoIP). Such a device may be configured to perform operations on a signal carrying the encoded frames such as interleaving, puncturing, convolution coding, error correction coding, coding of one or more layers of network protocol (e.g., Ethernet, TCP/IP, cdma2000), radio-frequency (RF) modulation, and/or RF transmission.

It is possible for one or more elements of an implementation of speech encoder 100 to be used to perform tasks or execute other sets of instructions that are not directly related to an operation of the apparatus, such as a task relating to another operation of a device or system in which the apparatus is embedded. It is also possible for one or more elements of an implementation of speech encoder 100 to have structure in common (e.g., a processor used to execute portions of code corresponding to different elements at different times, a set of instructions executed to perform tasks corresponding to different elements at different times, or an arrangement of electronic and/or optical devices performing operations for different elements at different times). In one such example, packet encoder 120 and frame formatter 130 are implemented as sets of instructions arranged to execute on the same processor. In another such example, spectral envelope description calculators 140*a* and 140*b* are implemented as the same set of instructions executing at different times.

Figure 19C:
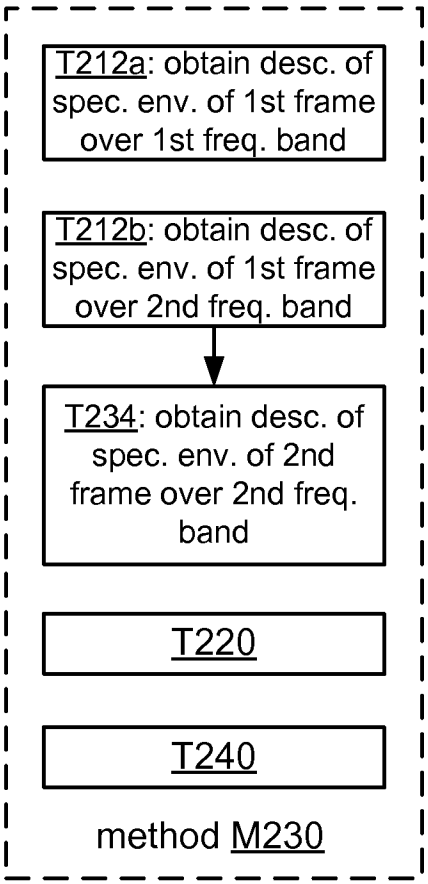
FIG. 19C shows a flowchart of an implementation M230 of method M200.
Figure 19B:
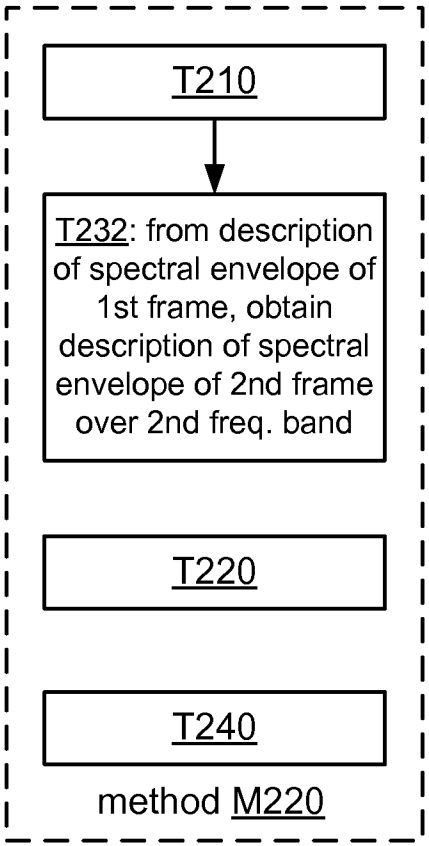
FIG. 19B shows a flowchart of an implementation M220 of method M200.
Figure 19A:
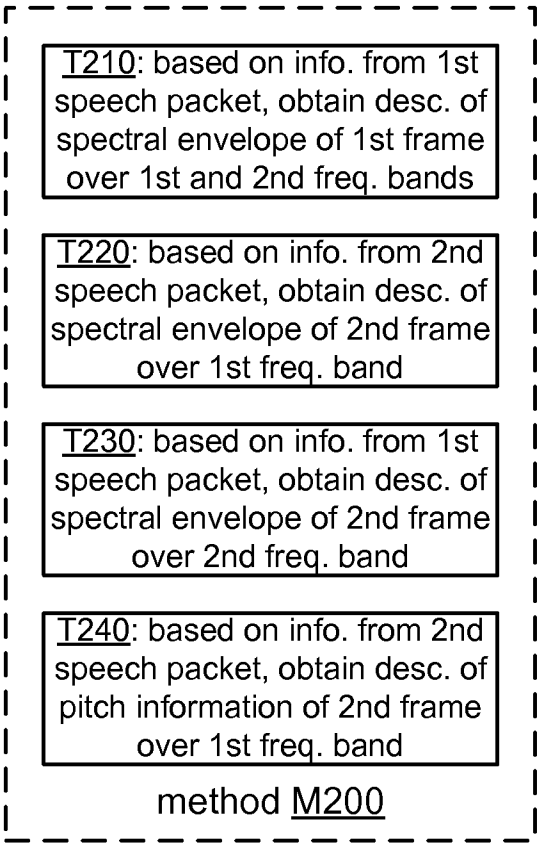
FIG. 19A shows a flowchart of an method M200 according to a general configuration.

FIG. 19A shows a flowchart of a method M200 of processing speech packets from an encoded speech signal according to a general configuration. Method M200 is configured to receive information from two speech packets (e.g., from consecutive encoded frames of the encoded speech signal) and to produce descriptions of spectral envelopes of two corresponding frames of a speech signal. Based on information from the first speech packet (also called the "reference" speech packet), task T210 obtains a description of a spectral envelope of a first frame of the speech signal over the first and second frequency bands. This description may be a single description that extends over both frequency bands, or it may include separate descriptions that each extend over a respective one of the frequency bands. Based on information from the second speech packet, task T220 obtains a description of a spectral envelope of a second frame of the speech signal (also called the "target" frame) over the first frequency band. Based on information from the reference speech packet, task T230 obtains a description of a spectral envelope of the target frame over the second frequency band. Based on information from the second speech packet, task T240 obtains a description of pitch information of the target frame for the first frequency band.

Figure 20:
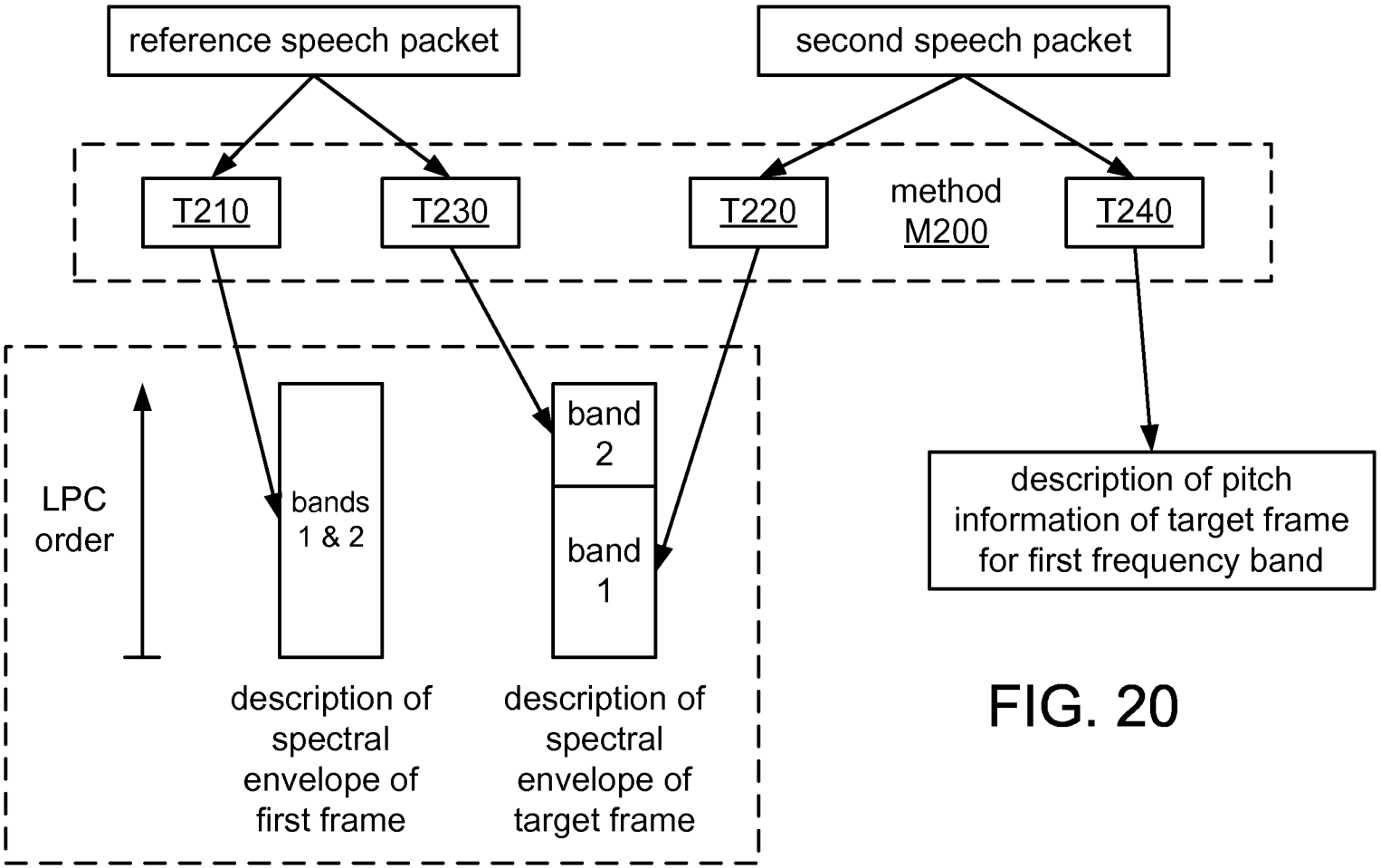
FIG. 20 shows an application of method M200.

FIG. 20 shows an application of method M200. In this example, the descriptions of the spectral envelopes have LPC orders, and the LPC order of the description of the spectral envelope of the target frame over the second frequency band is less than the LPC order of the description of the spectral envelope of the target frame over the first frequency band. In a particular example, the LPC orders of the descriptions of the spectral envelope of the target frame over the first and second frequency bands are, respectively, ten and six. Other examples include cases in which the LPC order of the description of the spectral envelope of the target frame over the second frequency band is at least fifty percent of, at least sixty percent of, not more than seventy-five percent of, not more than eighty percent of, equal to, and greater than the LPC order of the description of the spectral envelope of the target frame over the first frequency band.

FIG. 20 also shows an example in which the LPC order of the description of the spectral envelope of the first frame over the first and second frequency bands is equal to the sum of the LPC orders of the descriptions of the spectral envelope of the target frame over the first and second frequency bands. In another example, the LPC order of the description of the spectral envelope of the first frame over the first and second frequency bands may be greater or less than the sum of the LPC orders of the descriptions of the spectral envelopes of the target frame over the first and second frequency bands.

The reference speech packet may include a quantized description of a spectral envelope over the first and second frequency bands, and the second speech packet may include a quantized description of a spectral envelope over the first frequency band. In one particular example, the quantized description of a spectral envelope over the first and second frequency bands included in the reference speech packet has a length of thirty-six bits, and the quantized description of a spectral envelope over the first frequency band included in the second speech packet has a length of twenty-two bits. In other examples, the length of the quantized description of a spectral envelope over the first frequency band included in the second speech packet is not greater than sixty-five, seventy, seventy-five, or eighty percent of the length of the quantized description of a spectral envelope over the first and second frequency bands included in the reference speech packet.

Each of the tasks T210 and T220 may be configured to include one or both of the following two operations: parsing the speech packet to extract a quantized description of a spectral envelope, and dequantizing a quantized description of a spectral envelope to obtain a set of parameters of a coding model for the frame. Typical implementations of tasks T210 and T220 include both of these operations, such that each task processes a respective speech packet to produce a description of a spectral envelope in the form of a set of model parameters (e.g., one or more LSF, LSP, ISF, ISP, and/or LPC coefficient vectors). In one particular example, the reference speech packet has a length of 171 bits and the second speech packet has a length of eighty bits. In other examples, the length of the second speech packet is not more than fifty, sixty, seventy, or seventy-five percent of the length of the reference speech packet.

The reference speech packet may include a quantized description of temporal information for the first and second frequency bands, and the second speech packet may include a quantized description of temporal information for the first frequency band. In one particular example, a quantized description of temporal information for the first and second frequency bands included in the reference speech packet has a length of 133 bits, and a quantized description of temporal information for the first frequency band included in the second speech packet has a length of fifty-eight bits. In other examples, the length of the quantized description of temporal information for the first frequency band included in the second speech packet is not greater than forty-five, fifty, or sixty percent, or is not less than forty percent, of the length of the quantized description of temporal information for the first and second frequency bands included in the reference speech packet.

Tasks T210 and T220 may also be implemented to produce descriptions of temporal information from the respective speech packets. For example, one or both of these tasks may be configured to obtain, based on information from the respective speech packet, a description of a temporal envelope, a description of an excitation signal, a description of pitch information, or a description of a prototype. As in obtaining the description of a spectral envelope, such a task may include parsing a quantized description of temporal information from the speech packet and/or dequantizing a quantized description of temporal information. Implementations of method M200 may also be configured such that task T210 and/or task T220 obtains the description of a spectral envelope and/or the description of temporal information based on information from one or more other speech packets as well, such as information from speech packets from one or more previous encoded frames. For example, descriptions of excitation signals, descriptions of pitch information, and descriptions of prototypes are typically based on information from previous frames.

Task T240 is configured to obtain a description of pitch information of the target frame for the first frequency band based on information from the second speech packet. The description of pitch information may include a description of one or more of the following: a pitch lag, a pitch gain, a prototype, and an excitation signal. Task T240 may include parsing a quantized description of pitch information from the second speech packet and/or dequantizing a quantized description of pitch information. For example, the second speech packet may include a quantized description of pitch information for the first frequency band whose length is at least five percent and/or at most ten percent of the length of the second speech packet. In one particular example, the second speech packet has a length of eighty bits, and a quantized description of pitch information for the first frequency band (e.g., a pitch lag index) included in the second speech packet has a length of seven bits. Task T240 may also be configured to calculate an excitation signal of the target frame for the first frequency band based on pitch information from the second speech packet. It may also be desirable to configure task T240 to calculate an excitation signal of the target frame for the second frequency band based on an excitation signal of the target frame for the first frequency band as described herein (e.g., with reference to highband excitation generators A60 and 330).

Figure 22:
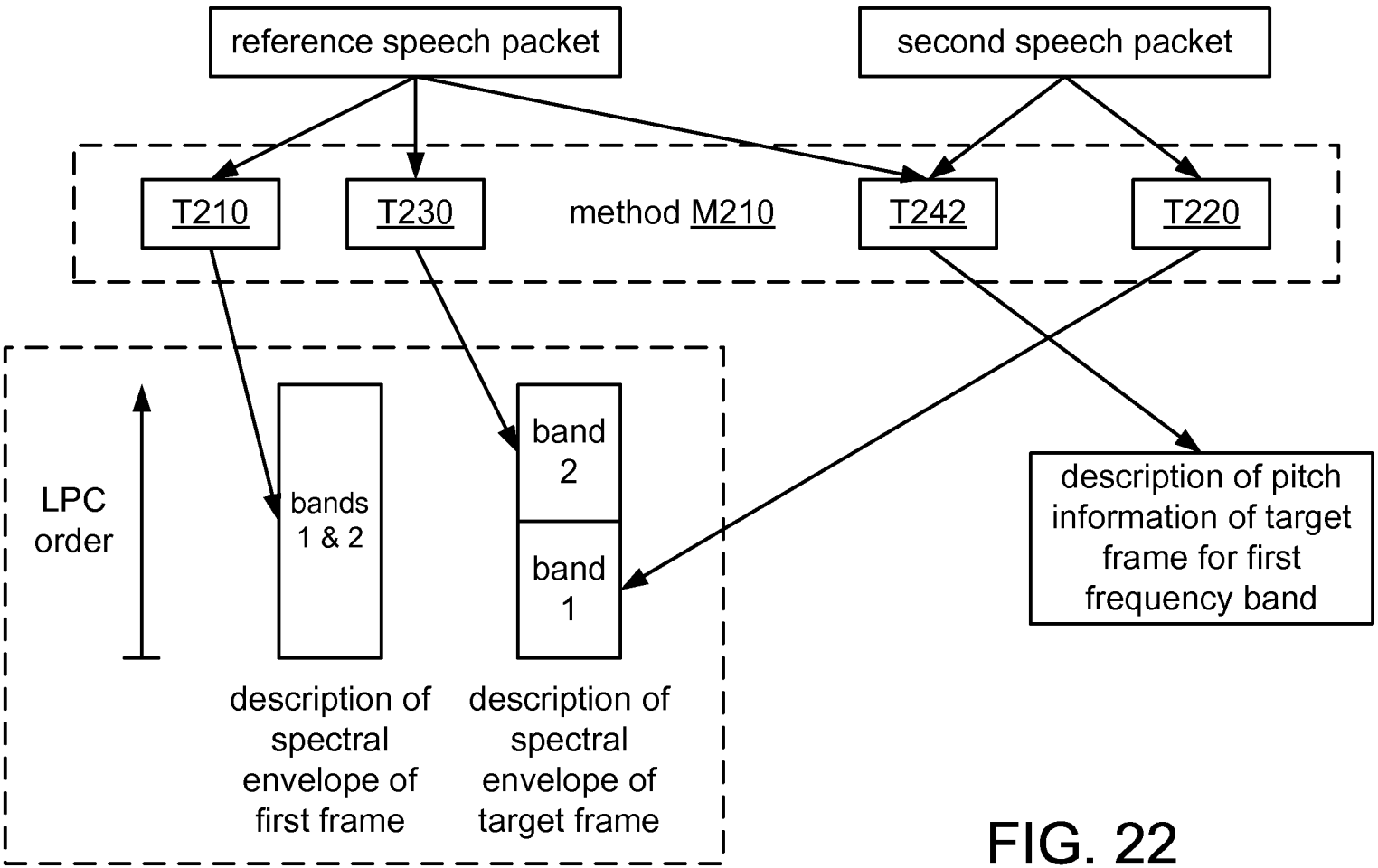
FIG. 22 shows an application of an implementation M210 of method M200.

Implementations of method M200 may also be configured such that task T240 obtains the description of pitch information based on information from one or more other speech packets as well, such as information from speech packets from one or more previous encoded frames. FIG. 22 shows an application of such an implementation M210 of method M200. Method M210 includes an implementation T242 of task T240 that is configured to obtain a description of pitch information of the target frame for the first frequency band based on information from each of the reference and second speech packets. For example, task T242 may be configured to interpolate a delay contour of the target frame for the first frequency band based on a first pitch lag value based on information from the second speech packet and a second pitch lag value based on information from the reference speech packet. Task T242 may also be configured to calculate an excitation signal of the target frame for the first frequency band based on pitch information from each of the reference and second speech packets.

Figure 21:
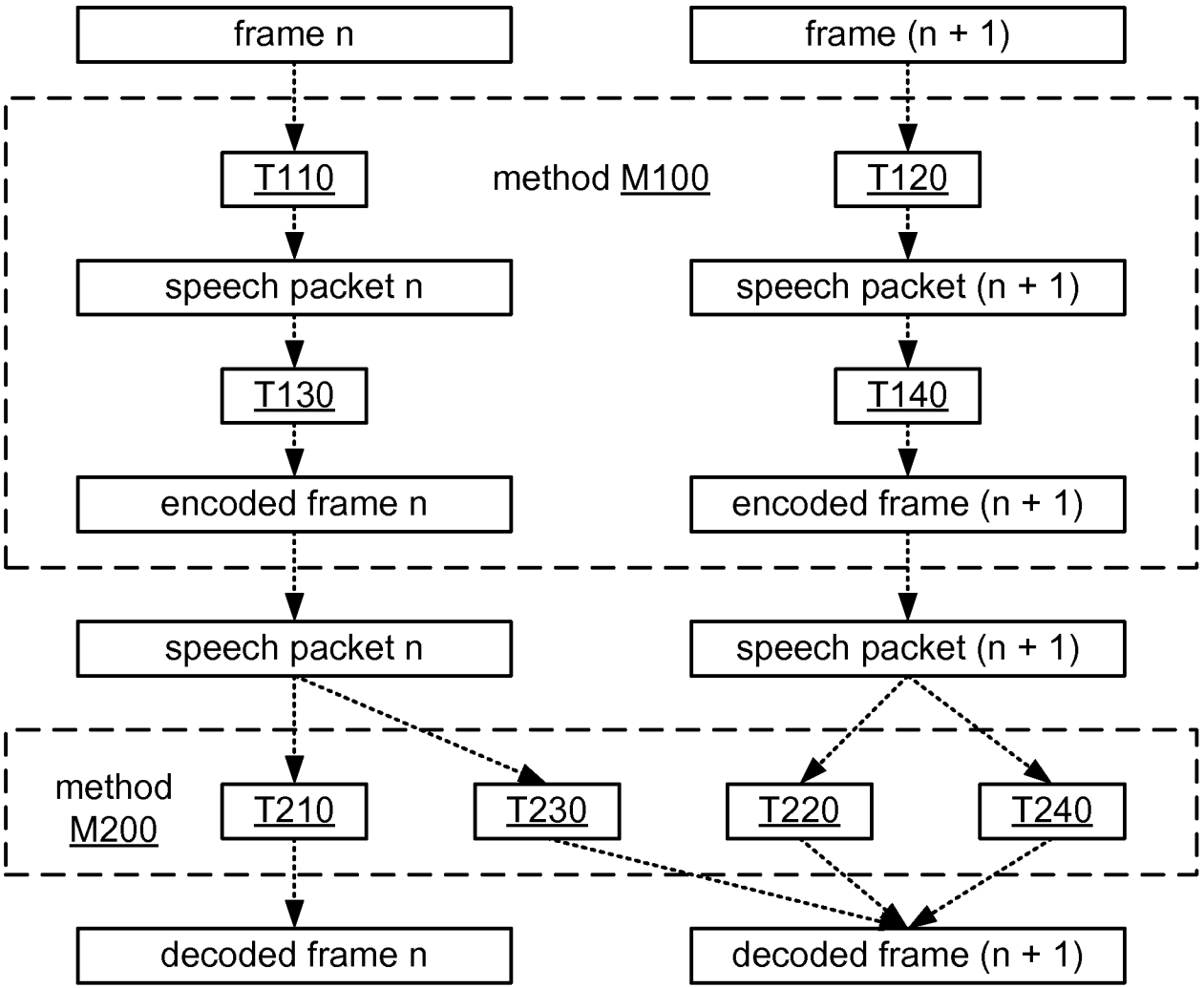
FIG. 21 illustrates a relation between methods M100 and M200.

Method M200 is typically performed as part of a larger method of speech decoding, and speech decoders and methods of speech decoding that are configured to perform method M200 are expressly contemplated and hereby disclosed. A speech coder may be configured to perform an implementation of method M100 at the encoder and to perform an implementation of method M200 at the decoder. In such case, the "first speech packet" as encoded by task T110 corresponds to the reference speech packet which supplies information to tasks T210 and T230, and the "second speech packet" as encoded by task T120 corresponds to the speech packet which supplies information to tasks T220 and T240. FIG. 21 illustrates this relation between methods M100 and M200 using the example of a pair of consecutive frames encoded using method M100 and decoded using method M200. Method M200 may also be implemented to include operations that parse or otherwise obtain the reference speech packet and the second speech packet from respective encoded frames (e.g., as produced by tasks T130 and T140).

Notwithstanding the particular example of FIG. 21, it is expressly noted that, in general, applications of method M100, and applications of method M200, are not limited to processing pairs of consecutive frames. In one such other application of method M200, for example, the encoded frame that supplies a speech packet processed by tasks T210 and T230 may be separated from an encoded frame that supplies a speech packet processed by tasks T220 and T240 by one or more intervening frames that were lost in transmission (i.e., erased frames).

Task T220 is configured to obtain the description of a spectral envelope of the target frame over the first frequency band based at least primarily on information from the second speech packet. For example, task T220 may be configured to obtain the description of a spectral envelope of the target frame over the first frequency band based entirely on information from the second speech packet. Alternatively, task T220 may be configured to obtain the description of a spectral envelope of the target frame over the first frequency band based on other information as well, such as information from speech packets from one or more previous encoded frames. In such case, task T220 is configured to weight the information from the second speech packet more heavily than the other information. For example, such an implementation of task T220 may be configured to calculate the description of a spectral envelope of the target frame over the first frequency band as an average of the information from the second speech packet and information from a speech packet from a previous encoded frame (e.g., the reference encoded frame), in which the information from the second speech packet is weighted more heavily than the information from the other speech packet. Likewise, task T220 may be configured to obtain a description of temporal information of the target frame for the first frequency band based at least primarily on information from the second speech packet.

Figure 23:
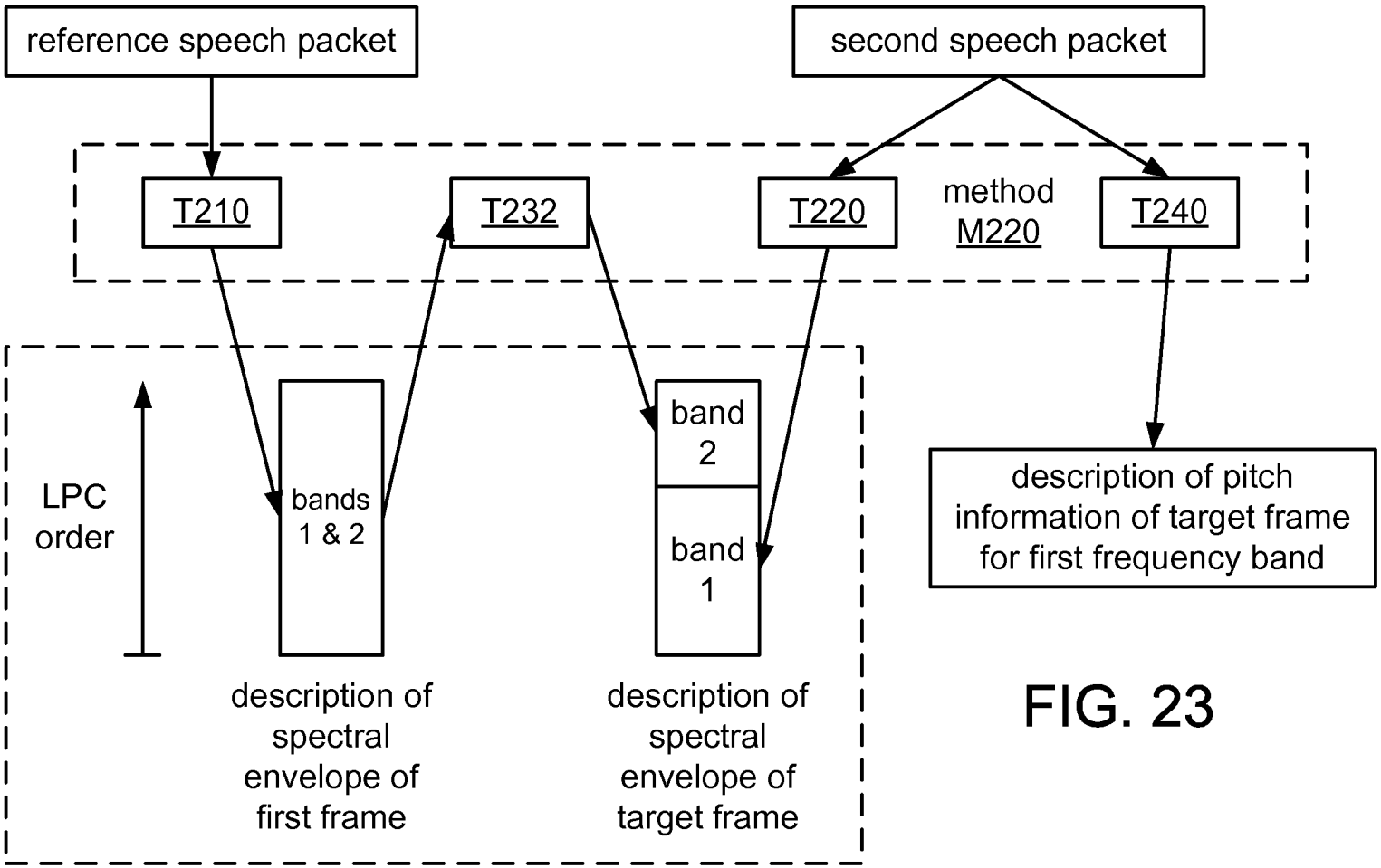
FIG. 23 shows an application of method M220.

Based on information from the reference speech packet (also called herein "reference spectral information"), task T230 obtains a description of a spectral envelope of the target frame over the second frequency band. FIG. 19B shows a flowchart of an implementation M220 of method M200 that includes an implementation T232 of task T230. As an implementation of task T230, task T232 obtains a description of a spectral envelope of the target frame over the second frequency band, based on the reference spectral information. In this case, the reference spectral information is included within a description of a spectral envelope of a first frame of the speech signal. FIG. 23 shows an example of an application of method M220.

Task T230 is configured to obtain the description of a spectral envelope of the target frame over the second frequency band based at least primarily on the reference spectral information. For example, task T230 may be configured to obtain the description of a spectral envelope of the target frame over the second frequency band based entirely on the reference spectral information. Alternatively, task T230 may be configured to obtain the description of a spectral envelope of the target frame over the second frequency band based on (A) a description of a spectral envelope over the second frequency band that is based on the reference spectral information and (B) a description of a spectral envelope over the second frequency band that is based on information from the second speech packet.

In such case, task T230 may be configured to weight the description based on the reference spectral information more heavily than the description based on information from the second speech packet. For example, such an implementation of task T230 may be configured to calculate the description of a spectral envelope of the target frame over the second frequency band as an average of descriptions based on the reference spectral information and information from the second speech packet, in which the description based on the reference spectral information is weighted more heavily than the description based on information from the second speech packet. In another case, an LPC order of the description based on the reference spectral information may be greater than an LPC order of the description based on information from the second speech packet. For example, the LPC order of the description based on information from the second speech packet may be one (e.g., the description may be a spectral tilt value, such as a value of the first reflection coefficient). Likewise, task T230 may be configured to obtain a description of temporal information of the target frame for the second frequency band based at least primarily on the reference temporal information (e.g., based entirely on the reference temporal information, or based also and in lesser part on information from the second speech packet).

Task T210 may be implemented to obtain, from the reference speech packet, a description of a spectral envelope that is a single full-band representation over both of the first and second frequency bands. It is more typical, however, to implement task T210 to obtain this description as separate descriptions of a spectral envelope over the first frequency band and over the second frequency band. For example, task T210 may be configured to obtain the separate descriptions from a reference speech packet that has been encoded using a split-band coding scheme as described herein (e.g., coding scheme 1 in the example of FIG. 12).

FIG. 19C shows a flowchart of an implementation M230 of method M220 in which task T210 is implemented as two subtasks T212*a* and T212*b*. Based on information from the reference speech packet, task T212*a* obtains a description of a spectral envelope of the first frame over the first frequency band. Based on information from the reference speech packet, task T212*b* obtains a description of a spectral envelope of the first frame over the second frequency band. Task T212*a* and/or T212*b* may include parsing a quantized description of a spectral envelope from the respective speech packet and/or dequantizing a quantized description of a spectral envelope.

Task T212*a* and/or T212*b* may also be implemented to produce a description of temporal information based on information from the respective speech packet. For example, one or both of these tasks may be configured to obtain, based on information from the respective speech packet, a description of a temporal envelope, a description of an excitation signal, and/or a description of pitch information. As in obtaining the description of a spectral envelope, such a task may include parsing a quantized description of temporal information from the speech packet and/or dequantizing a quantized description of temporal information.

Method M230 also includes an implementation T234 of task T232. As an implementation of task T230, task T234 obtains a description of a spectral envelope of the target frame over the second frequency band that is based on the reference spectral information. As in task T232, the reference spectral information is included within a description of a spectral envelope of a first frame of the speech signal. In the particular case of task T234, the reference spectral information is included within (and is possibly the same as) a description of a spectral envelope of the first frame over the second frequency band. Task T234 may also be configured to obtain a description of temporal information of the target frame for the second frequency band that is based on information included within (and possibly the same as) a description of temporal information of the first frame for the second frequency band.

Figure 24:
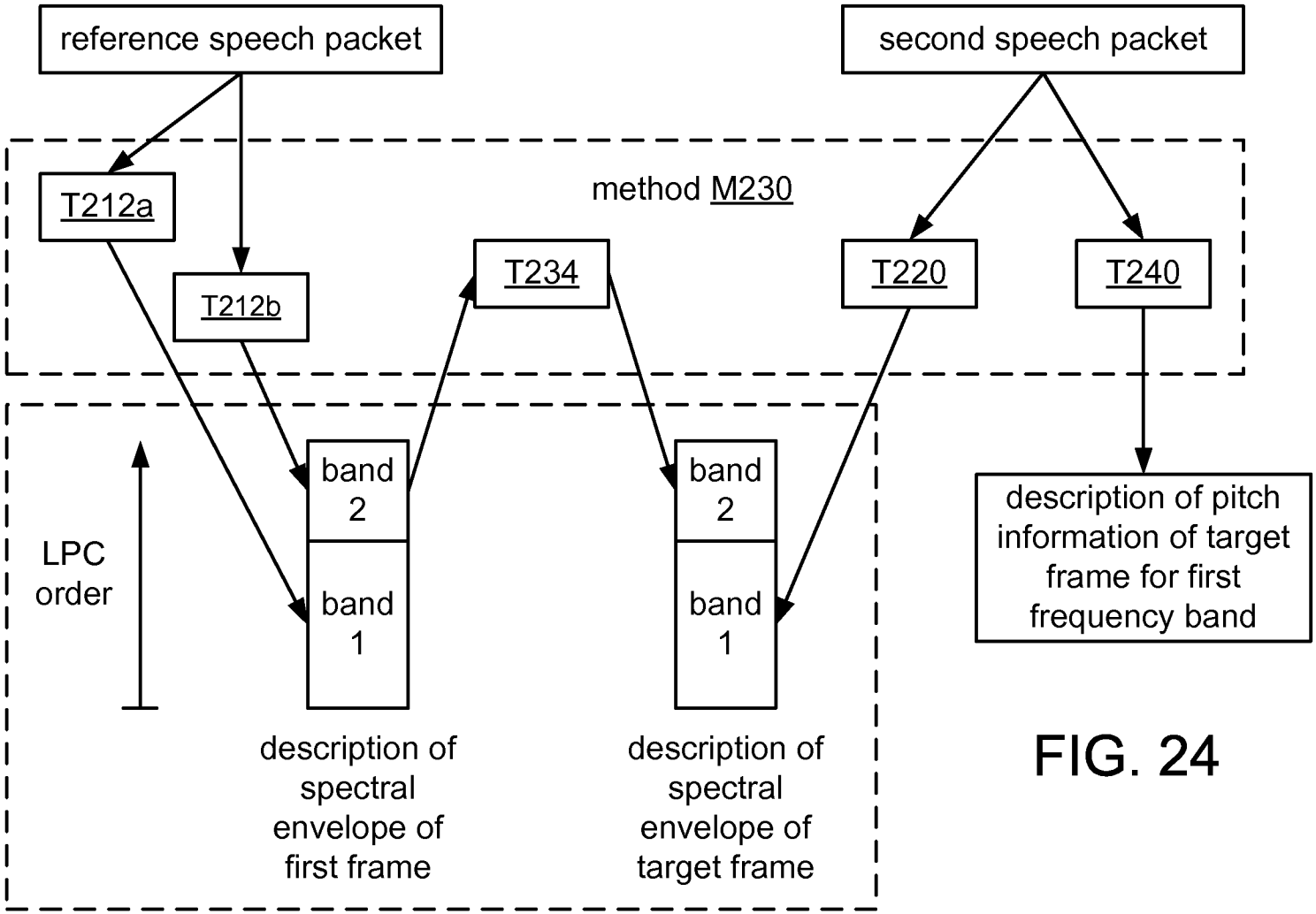
FIG. 24 shows an application of method M230.

FIG. 24 shows an application of method M230 that receives information from two speech packets and produces descriptions of spectral envelopes of two corresponding frames of a speech signal. In this example, the descriptions of the spectral envelopes have LPC orders, and the LPC orders of the descriptions of spectral envelopes of the first frame over the first and second frequency bands are equal to the LPC orders of the descriptions of spectral envelopes of the target frame over the respective frequency bands. Other examples include cases in which one or both of the descriptions of spectral envelopes of the first frame over the first and second frequency bands are greater than the corresponding description of a spectral envelope of the target frame over the respective frequency band.

The reference speech packet may include a quantized description of a spectral envelope over the first frequency band and a quantized description of a spectral envelope over the second frequency band. In one particular example, a quantized description of a spectral envelope over the first frequency band included in the reference speech packet has a length of twenty-eight bits, and a quantized description of a spectral envelope over the second frequency band included in the reference speech packet has a length of eight bits. In other examples, the length of the quantized description of a spectral envelope over the second frequency band included in the reference speech packet is not greater than thirty, forty, fifty, or sixty percent of the length of the quantized description of a spectral envelope over the first frequency band included in the reference speech packet.

The reference speech packet may include a quantized description of temporal information for the first frequency band and a quantized description of temporal information for the second frequency band. In one particular example, a quantized description of temporal information for the first frequency band included in the reference speech packet has a length of 125 bits, and a quantized description of temporal information for the second frequency band included in the reference speech packet has a length of eight bits. In other examples, the length of the quantized description of temporal information for the second frequency band included in the reference speech packet is not greater than ten, twenty, twenty-five, or thirty percent of the length of the quantized description of temporal information for the first frequency band included in the reference speech packet.

The second speech packet may include a quantized description of a spectral envelope over the first frequency band and/or a quantized description of temporal information for the first frequency band. In one particular example, a quantized description of a spectral envelope over the first frequency band included in the second encoded frame has a length of twenty-two bits. In other examples, the length of the quantized description of a spectral envelope over the first frequency band included in the second speech packet is not less than forty, fifty, sixty, seventy, or seventy-five percent of the length of the quantized description of a spectral envelope over the first frequency band included in the reference speech packet. In one particular example, a quantized description of temporal information for the first frequency band included in the second speech packet has a length of fifty-eight bits. In other examples, the length of the quantized description of temporal information for the first frequency band included in the second speech packet is at least twenty-five, thirty, forty, or forty-five percent, and/or at most fifty, sixty, or seventy percent, of the length of the quantized description of a spectral envelope over the first frequency band included in the reference speech packet.

In a typical implementation of method M200, the reference spectral information is a description of a spectral envelope over the second frequency band. This description may include a set of model parameters, such as one or more LSP, LSF, ISP, ISF, or LPC coefficient vectors. Generally this description is a description of a spectral envelope of the first frame over the second frequency band as obtained from the reference speech packet by task T210. It is also possible for the reference spectral information to include a description of a spectral envelope (e.g., of the first frame) over the first frequency band and/or over another frequency band.

Figure 25:
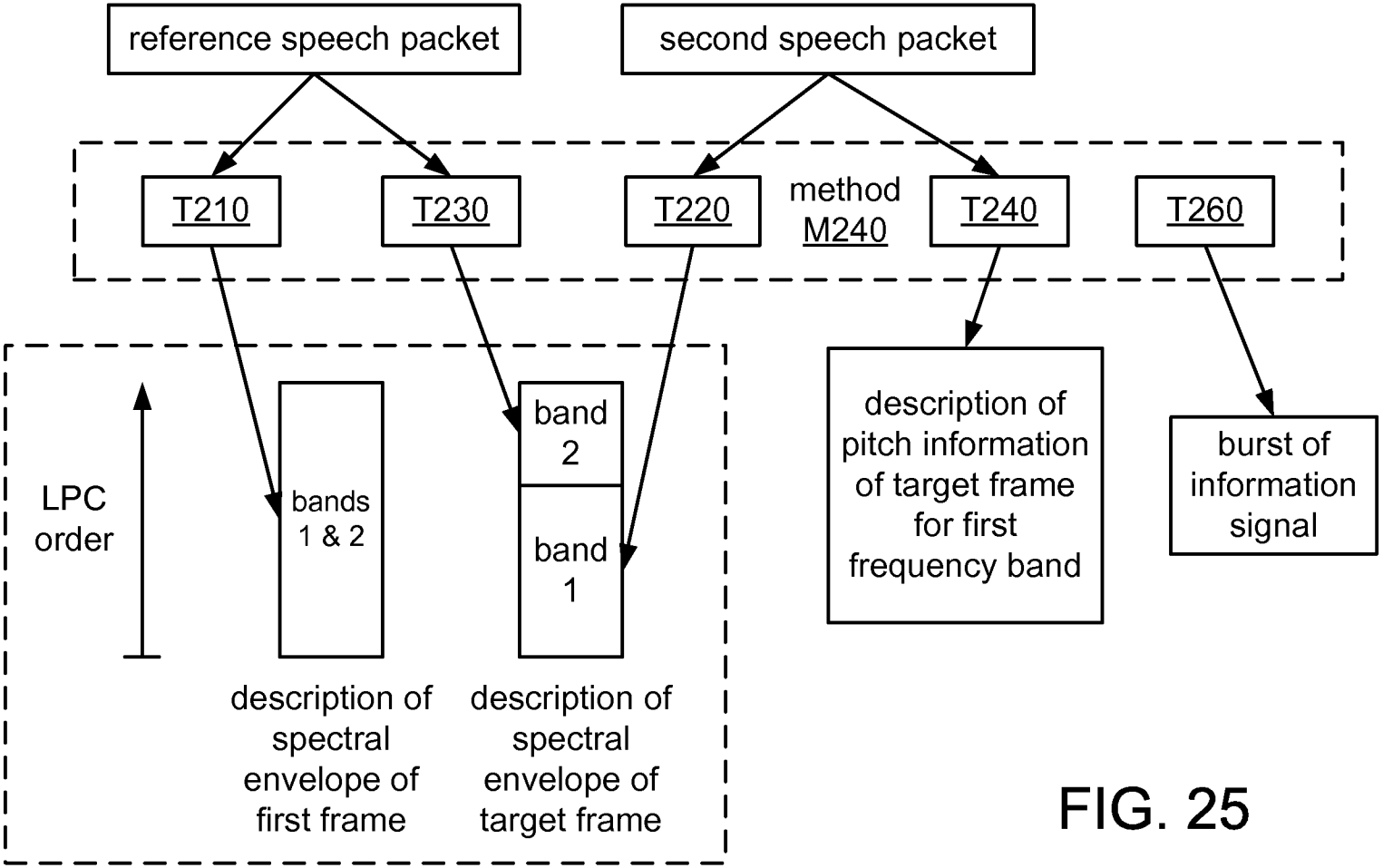
FIG. 25 shows an application of an implementation M240 of method M200.

FIG. 25 shows an application of an implementation M240 of method M200 that includes a task T260. Task T260 is configured to produce, based on information from an encoded frame that includes the second speech packet, a burst of an information signal that is separate from the speech signal. For example, task T260 may be configured to output a particular portion of the encoded frame as a burst of a signaling or secondary traffic signal as described above. Such a burst may have a length in bits that is at least forty, forty-five, or fifty percent of the length of the encoded frame. Alternatively or additionally, such a burst may have a length in bits that is at least ninety percent of the length of the second speech packet, or such a burst may have a length that is equal to or longer than the length of the second speech packet. In one particular example, the burst has a length of 86 bits (in another example, 87 bits), the second speech packet has a length of 80 bits, and the encoded frame has a length of 171 bits. Methods M210, M220, and M230 may also be implemented to include task T260.

Task T230 typically includes an operation to retrieve the reference spectral information from an array of storage elements such as semiconductor memory (also called herein a "buffer"). For a case in which the reference spectral information includes a description of a spectral envelope over the second frequency band, the act of retrieving the reference spectral information may be sufficient to complete task T230. Alternatively, it may be desirable to configure task T230 to calculate the description of a spectral envelope of the target frame over the second frequency band (also called herein the "target spectral description") rather than simply to retrieve it. For example, task T230 may be configured to calculate the target spectral description by adding random noise to the reference spectral information and/or to calculate the target spectral description based on spectral information from at least one additional speech packet (e.g., based on information from more than one reference speech packet). For example, task T230 may be configured to calculate the target spectral description as an average of descriptions of spectral envelopes over the second frequency band from two or more reference speech packets, and such calculation may include adding random noise to the calculated average.

Task T230 may be configured to calculate the target spectral description by extrapolating in time from the reference spectral information or by interpolating in time between descriptions of spectral envelopes over the second frequency band from two or more reference speech packets. Alternatively or additionally, task T230 may be configured to calculate the target spectral description by extrapolating in frequency from a description of a spectral envelope of the target frame over another frequency band (e.g., over the first frequency band) and/or by interpolating in frequency between descriptions of spectral envelopes over other frequency bands.

Typically the reference spectral information and the target spectral description are vectors of spectral parameter values (or "spectral vectors"). In one such example, both of the target and reference spectral vectors are LSP vectors. In another example, both of the target and reference spectral vectors are LPC coefficient vectors. In a further example, both of the target and reference spectral vectors are reflection coefficient vectors. Task T230 may be configured to copy the target spectral description from the reference spectral information according to an expression such as $s_{ti}=s_{ri}\ \forall i \in \{1, 2, \ldots, n\}$, where $s_t$ is the target spectral vector, $s_r$ is the reference spectral vector (whose values are typically in the range of from −1 to +1), i is a vector element index, and n is the length of vector $s_t$. In a variation of this operation, task T230 is configured to apply a weighting factor (or a vector of weighting factors) to the reference spectral vector. In another variation of this operation, task T230 is configured to calculate the target spectral vector by adding random noise to the reference spectral vector according to an expression such as $s_{ti}=s_{ri}+z_i\ \forall i \in \{1, 2, \ldots, n\}$, where z is a vector of random values. In such case, each element of z may be a random variable whose values are distributed (e.g., uniformly) over a desired range.

It may be desirable to ensure that the values of the target spectral description are bounded (e.g., within the range of from −1 to +1). In such case, task T230 may be configured to calculate the target spectral description according to an expression such as $s_{ti}=ws_{ri}+z_i\ \forall i \in \{1, 2, \ldots, n\}$, where w has a value between zero and one (e.g., in the range of from 0.3 to 0.9) and the values of each element of z are distributed (e.g., uniformly) over the range of from −(1−w) to +(1−w).

In another example, task T230 is configured to calculate the target spectral description based on a description of a spectral envelope over the second frequency band from each of more than one reference speech packet (e.g., as an average of descriptions of spectral envelopes over the second frequency band from each of the two most recent reference speech packets). In such a case, it may be desirable to weight the reference vectors differently from each other (e.g., a vector from a more recent reference speech packet may be more heavily weighted).

It may be desirable to perform task T230 as an instance of a more general operation for handling an erasure of the highband portion of a split-band-encoded speech packet. For example, a speech decoder or method of speech decoding may be configured to execute such an operation upon receiving a speech packet in which at least the highband portion is erased (i.e., is absent or is found to have too many errors to be recovered reliably).

In a typical example, task T230 is configured to calculate the target spectral description based on a weighted version of the reference spectral information. The weight w may be a scalar as in the following expression: $s_{ti}=ws_{ri}\ \forall i \in \{1, 2, \ldots, n\}$. Alternatively, the weight w may be a vector of elements that have possibly different values, as the following expression: $s_{ti}=w_i s_{ri}\ \forall i \in \{1, 2, \ldots, n\}$.

For a case in which task T230 is an instance of a more general operation for erasure handling, it may be desirable to implement the weight as an attenuation factor α. It may also be desirable to implement this operation such that the value (or values) of attenuation factor α decrease with each in a consecutive series of highband erasures. For example, attenuation factor α may have a value of 0.9 for the first packet in the series, 0.7 for the second packet in the series, and 0.5 for subsequent packets in the series. (In such a case, it may be desirable to use the same reference spectral vector for each packet in the series of erasures.) In another such example, task T230 is configured to calculate the target spectral description based on an additive constant v, which may be a scalar as in the expression $s_{ti}=\alpha s_{ri}+v\ \forall i \in \{1, 2, \ldots, n\}$ or a vector as in the expression $s_{ti}=\alpha s_{ri}+v_i\ \forall i \in \{1, 2, \ldots, n\}$. This constant v may be implemented as an initial spectral vector so, as in the expression $s_{ti}=\alpha s_{ri}+s_{0i}\ \forall i \in \{1, 2, \ldots, n\}$. In such case, the values of the elements of the initial spectral vector so may be a function of i (e.g., $s_{0i}=bi$, where b is a constant). In one particular example, $s_{0i}=0.048i\ \forall i \in \{1, 2, \ldots, n\}$.

Task T230 may also be implemented to calculate the target spectral description based on, in addition to the reference spectral information, the spectral envelope of one or more frames over another frequency band. For example, such an implementation of task T230 may be configured to calculate the target spectral description by extrapolating in frequency from the spectral envelope of the current frame, and/or of one or more previous frames, over another frequency band (e.g., the first frequency band).

Task T230 may be configured to obtain a description of temporal information of the target frame over the second frequency band, based on information from the reference speech packet (also called herein "reference temporal information"). The reference temporal information is typically a description of temporal information over the second frequency band. This description may include one or more gain frame values, gain profile values, pitch parameter values, and/or codebook indices. Generally this description is a description of temporal information of the first frame over the second frequency band as obtained from the reference speech packet by task T210. It is also possible for the reference temporal information to include a description of temporal information (e.g., of the first frame) over the first frequency band and/or over another frequency band.

Task T230 may be configured to obtain a description of temporal information of the target frame over the second frequency band (also called herein the "target temporal description") by copying the reference temporal information. Alternatively, it may be desirable to configure task T230 to obtain the target temporal description by calculating it based on the reference temporal information. For example, task T230 may be configured to calculate the target temporal description by adding random noise to the reference temporal information. Task T230 may also be configured to calculate the target temporal description based on information from more than one reference speech packet. For example, task T230 may be configured to calculate the target temporal description as an average of descriptions of temporal information over the second frequency band from two or more reference speech packets, and such calculation may include adding random noise to the calculated average. It may be desirable for task T230 to obtain a description of temporal information of the target frame over the second frequency band as part of an instance of a more general operation for handling an erasure of the highband portion of a split-band-encoded speech packet, as described above.

The target temporal description and reference temporal information may each include a description of a temporal envelope. As noted above, a description of a temporal envelope may include a gain frame value and/or a set of gain shape values. Alternatively or additionally, the target temporal description and reference temporal information may each include a description of an excitation signal. A description of an excitation signal may include a description of a pitch component (e.g., pitch lag or delay, pitch gain, and/or a description of a prototype).

Task T230 is typically configured to set a gain shape of the target temporal description to be flat. For example, task T230 may be configured to set gain shape values of the target temporal description to be equal to each other. One such implementation of task T230 is configured to set all of the gain shape values to a factor of one (e.g., zero dB). Another such implementation of task T230 is configured to set all of the gain shape values to a factor of 1/n, where n is the number of gain shape values in the target temporal description.

Task T230 may be configured to calculate a gain frame value $g_t$ of the target temporal description according to an expression such as $g_t=zg_r$ or $g_t=wg_r+(1-w)z$, where $g_r$ is a gain frame value from the reference temporal information, z is a random value, and w is a weighting factor. Typical ranges for values of z include from 0 to 1 and from −1 to +1. Typical ranges of values for w include 0.5 (or 0.6) to 0.9 (or 1.0).

In a typical example, task T230 is configured to calculate a gain frame value of the target temporal description based on a weighted version of a gain frame value of the reference temporal information, as in the expression $g_t=wg_r$. For a case in which task T230 is an instance of a more general operation for erasure handling, it may be desirable to implement the weight as an attenuation factor β. It may also be desirable to implement this operation such that the value of attenuation factor β decreases with each in a consecutive series of high-band erasures. For example, attenuation factor β may have a value of 0.9 for the first packet in the series, 0.7 for the second packet in the series, and 0.5 for subsequent packets in the series. (In such a case, it may be desirable to use the same reference gain frame value for each packet in the series of erasures.) In another such example, task T230 is configured to calculate a gain frame value of the target temporal description based on one or more gain shape values $h_{ri}$ from the reference temporal information, as in the expression $$g_t = \beta g_r \times \sum_{i=1}^{n} h_{ri},$$

where n is the number of gain shape values in the reference speech packet.

Task T230 may be configured to calculate a gain frame value for a target frame based on gain frame values from the two or three most recent reference speech packets. In one such example, task T230 is configured to calculate a gain frame value of the target temporal description as an average according to an expression such as $$g_t = \frac{g_{r1} + g_{r2}}{2},$$

where $g_{r1}$ is a gain frame value from the most recent reference speech packet and $g_{r2}$ is a gain frame value from the next most recent reference speech packet. In a related example, the reference gain frame values are weighted differently from each other (e.g., a more recent value may be more heavily weighted). In a further example, task T230 is configured to apply an attenuation factor β to the calculated average and/or to include a factor based on one or more gain shape values from the reference temporal information.

Implementations of method M200 (including methods M210, M220, and M230) are typically configured to include an operation that stores the reference spectral information to a buffer. Such an implementation of method M200 may also include an operation that stores the reference temporal information to a buffer. Alternatively, such an implementation of method M200 may include an operation that stores both of the reference spectral information and the reference temporal information to a buffer.

An implementation of method M200 may be configured to store information based on the current speech packet as reference spectral information if the speech packet contains a description of a spectral envelope over the second frequency band. In the context of a set of coding schemes as shown in FIG. 12, for example, such an implementation of method M200 may be configured to store reference spectral information if the coding index of the speech packet indicates any of coding schemes 1 and 3 (i.e., rather than coding schemes 2 or 4). More generally, such an implementation of method M200 may be configured to store reference spectral information if the coding index of the speech packet indicates a wideband coding scheme rather than a narrowband coding scheme. Such implementations of method M200 may be configured to store reference temporal information according to the same criteria.

It may be desirable to implement method M200 such that stored reference spectral information is available for more than one reference speech packet at a time. For example, task T230 may be configured to calculate a target spectral description that is based on information from more than one reference speech packet. In such cases, method M200 may be configured to maintain in storage, at any one time, reference spectral information from the most recent reference speech packet, information from the second most recent reference speech packet, and possibly information from one or more less recent reference speech packets as well. Such a method may also be configured to maintain the same history, or a different history, for reference temporal information. For example, method M200 may be configured to retain a description of a spectral envelope from each of the two most recent reference speech packets and a description of temporal information from only the most recent reference speech packet.

In a typical application of an implementation of method M200, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of method M200 may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive encoded frames.

Figure 26A:
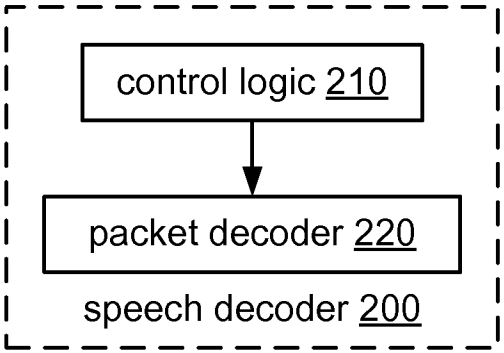
FIG. 26A shows a block diagram of a speech decoder 200 according to a general configuration.

FIG. 26A shows a block diagram of a speech decoder 200 for processing an encoded speech signal according to a general configuration. For example, speech decoder 200 may be configured to perform a method of speech decoding that includes an implementation of method M200 as described herein. Speech decoder 200 includes control logic 210 that is configured to generate a control signal having a sequence of values. Speech decoder 200 also includes a packet decoder 220 that is configured to calculate decoded frames of a speech signal based on values of the control signal and on corresponding speech packets of the encoded speech signal.

A communications device that includes speech decoder 200, such as a cellular telephone, may be configured to receive the encoded speech signal from a wired, wireless, or optical transmission channel. Such a device may be configured to perform preprocessing operations on the encoded speech signal, such as decoding of error-correction and/or redundancy codes. Such a device may also include implementations of both of speech encoder 100 and speech decoder 200 (e.g., in a transceiver).

Control logic 210 is configured to generate a control signal including a sequence of values that is based on coding indices of speech packets of the encoded speech signal. Each value of the sequence corresponds to a speech packet of the encoded speech signal (except in the case of an erased frame as discussed below) and has one of a plurality of states. In some implementations of speech decoder 200 as described below, the sequence is binary-valued (i.e., a sequence of high and low values). In other implementations of speech decoder 200 as described below, the values of the sequence may have more than two states.

Control logic 210 may be configured to determine the coding index for each speech packet. For example, control logic 210 may be configured to read at least part of the coding index from the speech packet, to determine a bit rate of the speech packet from one or more parameters such as frame energy, and/or to determine the appropriate coding mode from a format of the speech packet. Alternatively, speech decoder 200 may be implemented to include another element that is configured to determine the coding index for each speech packet and provide it to control logic 210, or speech decoder 200 may be configured to receive the coding index from another module of an apparatus that includes speech decoder 200.

A speech packet that is not received as expected, or is received having too many errors to be recovered, is called a frame erasure. Speech decoder 200 may be configured such that one or more states of the coding index are used to indicate a frame erasure or a partial frame erasure, such as the absence of a portion of the speech packet that carries spectral and temporal information for the second frequency band. For example, speech decoder 200 may be configured such that the coding index for a speech packet that has been encoded using coding scheme 2 (as in FIG. 12) indicates an erasure of the highband portion of the frame. In such a case, speech decoder 200 may be configured to perform an implementation of method M200 as an instance of a general method of erasure handling. Speech decoder 200 may also be configured such that the coding index for a speech packet that has been encoded using either of coding schemes 2 and 4 (as in FIG. 12) indicates an erasure of the highband portion of the frame.

Packet decoder 220 is configured to calculate decoded frames based on values of the control signal and corresponding speech packets of the encoded speech signal. When the value of the control signal has a first state, packet decoder 220 calculates a decoded frame based on a description of a spectral envelope over the first and second frequency bands, where the description is based on information from the corresponding speech packet. When the value of the control signal has a second state, packet decoder 220 retrieves a description of a spectral envelope over the second frequency band and calculates a decoded frame based on the retrieved description and on a description of a spectral envelope over the first frequency band, where the description over the first frequency band is based on information from the corresponding speech packet.

Figure 26B:
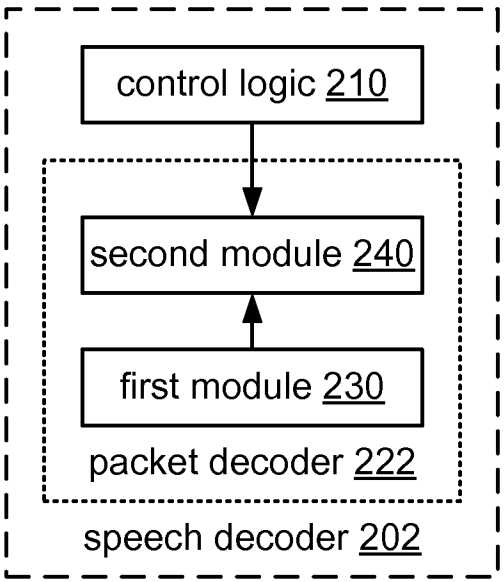
FIG. 26B shows a block diagram of an implementation 202 of speech decoder 200.

FIG. 26B shows a block diagram of an implementation 202 of speech decoder 200. Speech decoder 202 includes an implementation 222 of packet decoder 220 that includes a first module 230 and a second module 240. Modules 230 and 240 are configured to calculate respective subband portions of decoded frames. Specifically, first module 230 is configured to calculate a decoded portion of a frame over the first frequency band (e.g., a narrowband signal), and second module 240 is configured to calculate, based on a value of the control signal, a decoded portion of the frame over the second frequency band (e.g., a highband signal).

Figure 26C:
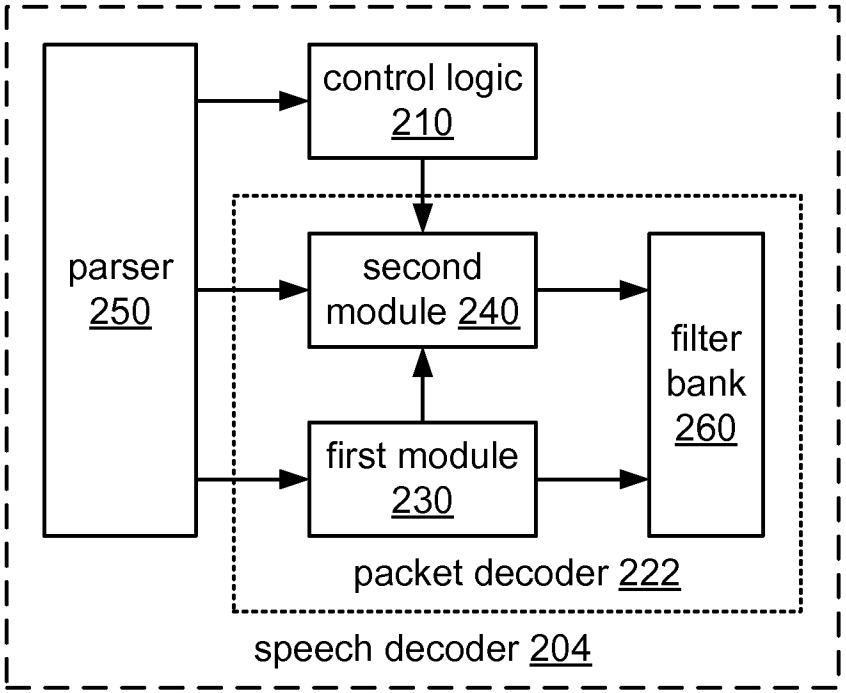
FIG. 26C shows a block diagram of an implementation 204 of speech decoder 200

FIG. 26C shows a block diagram of an implementation 204 of speech decoder 200. Parser 250 is configured to parse the bits of a speech packet to provide a coding index to control logic 210 and at least one description of a spectral envelope to packet decoder 220. In this example, speech decoder 204 is also an implementation of speech decoder 202, such that parser 250 is configured to provide descriptions of spectral envelopes over respective frequency bands (when available) to modules 230 and 240. Parser 250 may also be configured to provide at least one description of temporal information to speech decoder 220. For example, parser 250 may be implemented to provide descriptions of temporal information for respective frequency bands (when available) to modules 230 and 240.

Parser 250 may also be configured to parse the bits of an encoded frame that contains the speech packet to produce a burst of an information signal that is separate from the speech signal (e.g., a burst of signaling or secondary traffic as discussed above). Alternatively, speech decoder 204, or an apparatus containing speech decoder 204, may be otherwise configured to parse the encoded frame to produce the speech packet (e.g., as input to parser 250) and the burst.

Packet decoder 222 also includes a filter bank 260 that is configured to combine the decoded portions of the frames over the first and second frequency bands to produce a wideband speech signal. Particular examples of such filter banks are described in, e.g., U.S. Pat. Appl. Publ. No. 2007/088558 (Vos et al.), "SYSTEMS, METHODS, AND APPARATUS FOR SPEECH SIGNAL FILTERING," published Apr. 19, 2007. For example, filter bank 260 may include a lowpass filter configured to filter the narrowband signal to produce a first passband signal and a highpass filter configured to filter the highband signal to produce a second passband signal. Filter bank 260 may also include an upsampler configured to increase the sampling rate of the narrowband signal and/or of the highband signal according to a desired corresponding interpolation factor, as described in, e.g., U.S. Pat. Appl. Publ. No. 2007/088558 (Vos et al.).

Figure 27A:
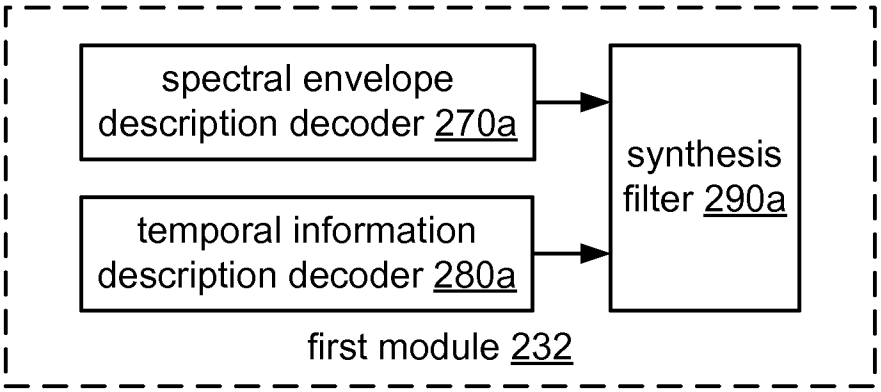
FIG. 27A shows a block diagram of an implementation 232 of first module 230.

FIG. 27A shows a block diagram of an implementation 232 of first module 230 that includes an instance 270*a* of a spectral envelope description decoder 270 and an instance 280*a* of a temporal information description decoder 280. Spectral envelope description decoder 270*a* is configured to decode a description of a spectral envelope over the first frequency band (e.g., as received from parser 250). Temporal information description decoder 280*a* is configured to decode a description of temporal information for the first frequency band (e.g., as received from parser 250). For example, temporal information description decoder 280*a* may be configured to decode pitch information for the first frequency band. Temporal information description decoder 280*a* may also be configured to calculate an excitation signal for the first frequency band based on the decoded description (and possibly on temporal information from one or more previous frames). An instance 290*a* of synthesis filter 290 is configured to generate a decoded portion of the frame over the first frequency band (e.g., a narrowband signal) that is based on the decoded descriptions of a spectral envelope and temporal information. For example, synthesis filter 290*a* may be configured according to a set of values within the description of a spectral envelope over the first frequency band (e.g., one or more LSP or LPC coefficient vectors) to produce the decoded portion in response to an excitation signal for the first frequency band.

Figure 27B:
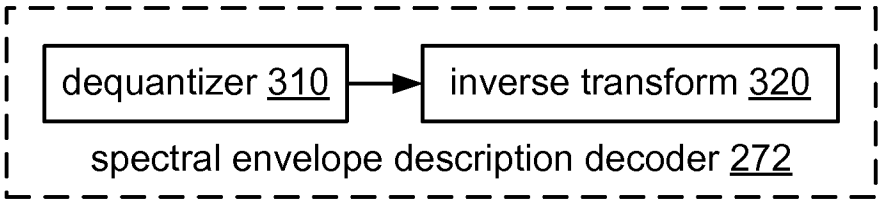
FIG. 27B shows a block diagram of an implementation 272 of spectral envelope description decoder 270.

FIG. 27B shows a block diagram of an implementation 272 of spectral envelope description decoder 270. Dequantizer 310 is configured to dequantize the description, and inverse transform block 320 is configured to apply an inverse transform to the dequantized description to obtain a set of LPC coefficients. Temporal information description decoder 280 is also typically configured to include a dequantizer.

Figure 28A:
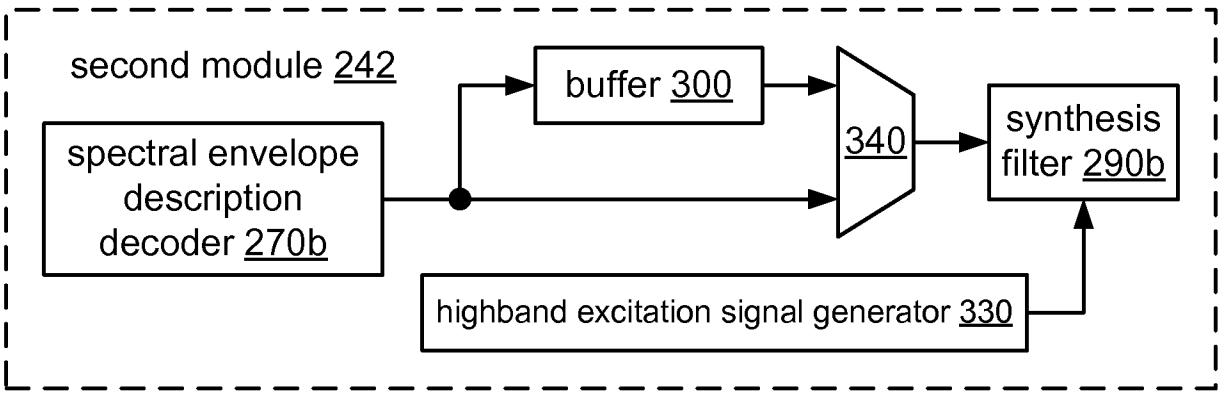
FIG. 28A shows a block diagram of an implementation 242 of second module 240.

FIG. 28A shows a block diagram of an implementation 242 of second module 240. Second module 242 includes an instance 270*b* of spectral envelope description decoder 270, a buffer 300, and a selector 340. Spectral envelope description decoder 270*b* is configured to decode a description of a spectral envelope over the second frequency band (e.g., as received from parser 250). Buffer 300 is configured to store one or more descriptions of a spectral envelope over the second frequency band as reference spectral information, and selector 340 is configured to select, according to the state of a corresponding value of the control signal generated by control logic 210, a decoded description of a spectral envelope from either (A) buffer 300 or (B) decoder 270*b*.

Second module 242 also includes a highband excitation signal generator 330 and an instance 290*b* of synthesis filter 290 that is configured to generate a decoded portion of the frame over the second frequency band (e.g., a highband signal) based on the decoded description of a spectral envelope received via selector 340. Highband excitation signal generator 330 is configured to generate an excitation signal for the second frequency band, based on an excitation signal for the first frequency band (e.g., as produced by temporal information description decoder 280*a*). Additionally or in the alternative, generator 330 may be configured to perform spectral and/or amplitude shaping of random noise to generate the highband excitation signal. Generator 330 may be implemented as an instance of highband excitation signal generator A60 as described above. Synthesis filter 290*b* is configured according to a set of values within the description of a spectral envelope over the second frequency band (e.g., one or more LSP or LPC coefficient vectors) to produce the decoded portion of the frame over the second frequency band in response to the highband excitation signal.

In one example of an implementation of speech decoder 202 that includes an implementation 242 of second module 240, control logic 210 is configured to output a binary signal to selector 340, such that each value of the sequence has a state A or a state B. In this case, if the coding index of the current frame indicates that it is inactive, control logic 210 generates a value having a state A, which causes selector 340 to select the output of buffer 300 (i.e., selection A). Otherwise, control logic 210 generates a value having a state B, which causes selector 340 to select the output of decoder 270*b* (i.e., selection B).

Speech decoder 202 may be arranged such that control logic 210 controls an operation of buffer 300. For example, buffer 300 may be arranged such that a value of the control signal that has state B causes buffer 300 to store the corresponding output of decoder 270*b*. Such control may be implemented by applying the control signal to a write enable input of buffer 300, where the input is configured such that state B corresponds to its active state. Alternatively, control logic 210 may be implemented to generate a second control signal, also including a sequence of values that is based on coding indices of speech packets of the encoded speech signal, to control an operation of buffer 300.

Figure 28B:
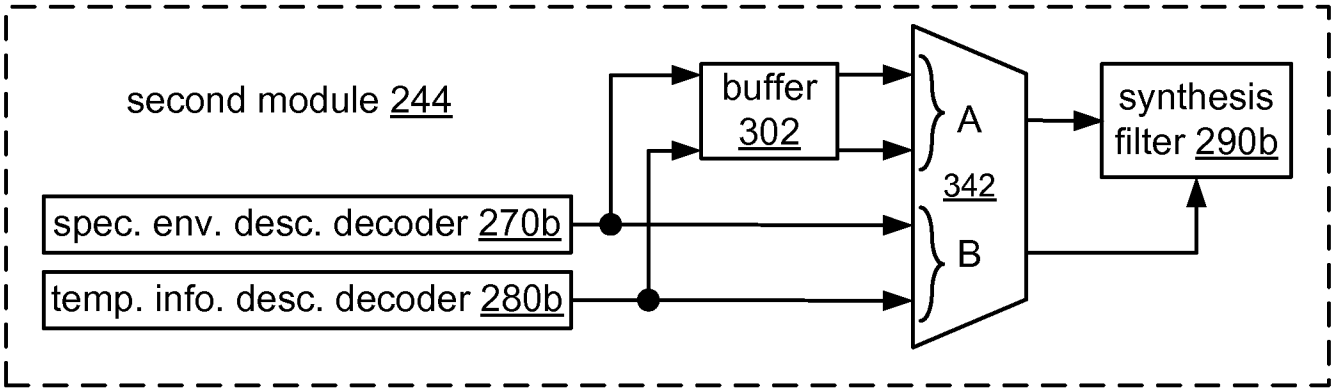
FIG. 28B shows a block diagram of an implementation 244 of second module 240.

FIG. 28B shows a block diagram of an implementation 244 of second module 240. Second module 244 includes spectral envelope description decoder 270*b* and an instance 280*b* of temporal information description decoder 280 that is configured to decode a description of temporal information for the second frequency band (e.g., as received from parser 250). Second module 244 also includes an implementation 302 of a buffer 300 that is also configured to store one or more descriptions of temporal information over the second frequency band as reference temporal information.

Second module 244 includes an implementation 342 of selector 340 that is configured to select, according to the state of a corresponding value of the control signal generated by control logic 210, a decoded description of a spectral envelope and a decoded description of temporal information from either (A) buffer 302 or (B) decoders 270*b*, 280*b*. An instance 290*b* of synthesis filter 290 is configured to generate a decoded portion of the frame over the second frequency band (e.g., a highband signal) that is based on the decoded descriptions of a spectral envelope and temporal information received via selector 342. In a typical implementation of speech decoder 202 that includes second module 244, temporal information description decoder 280*b* is configured to produce a decoded description of temporal information that includes an excitation signal for the second frequency band, and synthesis filter 290*b* is configured according to a set of values within the description of a spectral envelope over the second frequency band (e.g., one or more LSP or LPC coefficient vectors) to produce the decoded portion of the frame over the second frequency band in response to the excitation signal.

Figure 28C:
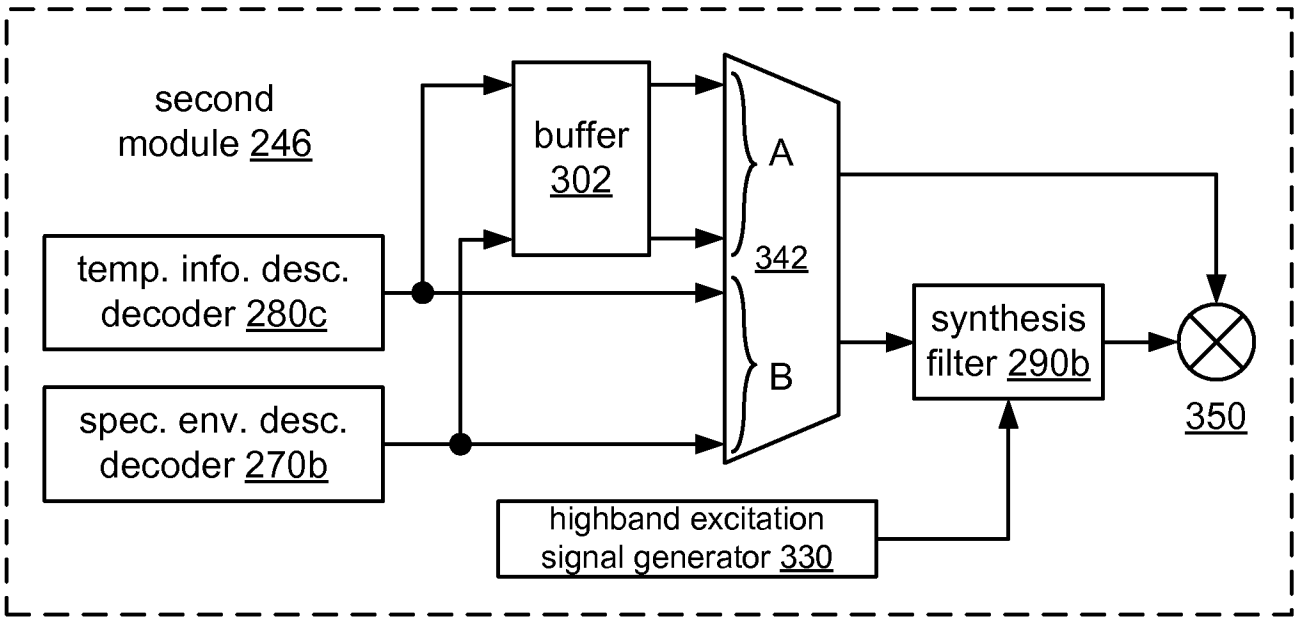
FIG. 28C shows a block diagram of an implementation 246 of second module 242.

FIG. 28C shows a block diagram of an implementation 246 of second module 242 that includes buffer 302 and selector 342. Second module 246 also includes an instance 280*c* of temporal information description decoder 280, which is configured to decode a description of a temporal envelope for the second frequency band, and a gain control element 350 (e.g., a multiplier or amplifier) that is configured to apply a description of a temporal envelope received via selector 342 to the decoded portion of the frame over the second frequency band. For a case in which the decoded description of a temporal envelope includes gain shape values, gain control element 350 may include logic configured to apply the gain shape values to respective subframes of the decoded portion.

FIGS. 28A-28C show implementations of second module 240 in which buffer 300 receives fully decoded descriptions of spectral envelopes (and, in some cases, of temporal information). Similar implementations may be arranged such that buffer 300 receives descriptions that are not fully decoded. For example, it may be desirable to reduce storage requirements by storing the description in quantized form (e.g., as received from parser 250). In such cases, the signal path from buffer 300 to selector 340 may be configured to include decoding logic, such as a dequantizer and/or an inverse transform block.

Control logic 210 may be implemented to produce a single control signal to control the operation of selector 340 and buffer 300. Alternatively, control logic 210 may be implemented to produce (1) a control signal, whose values have at least two possible states, to control an operation of selector 340 and (2) a second control signal, including a sequence of values that is based on coding indices of encoded frames of the encoded speech signal and whose values have at least two possible states, to control an operation of buffer 300.

It may be desirable to implement speech decoder 200 to support decoding of both narrowband and wideband speech signals. As noted above, it may be desirable for the coder to use a narrowband coding scheme (e.g., coding scheme 2 in the example of FIG. 12) for dimmed frames. In such case, the coding index alone of such a speech packet may not be sufficient to indicate whether the speech packet is to be decoded as narrowband speech or as wideband speech. If the coder is configured to use dim-and-burst techniques on narrowband encoded frames as well, then even the presence of a burst in the same encoded frame also may not help to indicate whether the speech packet is to be decoded as narrowband speech or as wideband speech.

Therefore it may be desirable to configure an element of speech decoder 200 (e.g., control logic 210 or an additional control element) to maintain an operational value that has at least two states corresponding to, respectively, narrowband operation and wideband operation. Such an element may be configured to enable or disable second module 240, or to enable or disable the output of a highband portion of a decoded signal from second module 240, based on a current state of the operational value. The element may be configured to calculate the state of the operational value based on such information as the presence of an information burst in the speech packet, the coding indices of one or more recent speech packets from the encoded speech signal, and/or the coding indices of one or more subsequent speech packets from the encoded speech signal.

For example, such an element may be configured to set the current state of the operational value to indicate wideband operation if the coding scheme for the most recent speech packet indicates a wideband coding scheme. In another example, such an element may be configured to set the current state of the operational value to indicate wideband operation if the coding index of the current speech packet indicates a coding scheme that is used for wideband dimming. In another example, such an element may be configured to set the current state of the operational value to indicate wideband operation if (A) the coding index of the current speech packet indicates a wideband coding scheme or (B) the coding index of the current speech packet indicates a coding scheme that may be used for wideband dimming, the current encoded frame includes an information burst, and the coding scheme for the most recent speech packet (alternatively, at least one of the two most recent speech packets) indicates a wideband coding scheme. In a further example, such an element may also be configured to set the current state of the operational value to indicate wideband operation if (C) the coding index of the current speech packet indicates a coding scheme that may be used for wideband dimming, the current encoded frame includes an information burst, the coding scheme for the most recent speech packet indicates a frame erasure, and the coding scheme of the second most recent speech packet indicates a wideband coding scheme.

The various elements of an implementation of speech decoder 200 may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of speech decoder 200 as described herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of speech decoder 200 may also be embodied as one or more computers (e.g., machines including one or more arrays programmed to execute one or more sets or sequences of instructions, also called "processors"), and any two or more, or even all, of these elements may be implemented within the same such computer or computers.

The various elements of an implementation of speech decoder 200 may be included within a device for wireless communications such as a cellular telephone or other device having such communications capability. Such a device may be configured to communicate with circuit-switched and/or packet-switched networks (e.g., using one or more protocols such as VoIP). Such a device may be configured to perform operations on a signal carrying the encoded frames such as de-interleaving, de-puncturing, decoding of one or more convolution codes, decoding of one or more error correction codes, decoding of one or more layers of network protocol (e.g., Ethernet, TCP/IP, cdma2000), radio-frequency (RF) demodulation, and/or RF reception.

It is possible for one or more elements of an implementation of speech decoder 200 to be used to perform tasks or execute other sets of instructions that are not directly related to an operation of the speech decoder, such as a task relating to another operation of a device or system in which the speech decoder is embedded. It is also possible for one or more elements of an implementation of speech decoder 200 to have structure in common (e.g., a processor used to execute portions of code corresponding to different elements at different times, a set of instructions executed to perform tasks corresponding to different elements at different times, or an arrangement of electronic and/or optical devices performing operations for different elements at different times). In one such example, control logic 210, first module 230, and second module 240 are implemented as sets of instructions arranged to execute on the same processor. In another such example, spectral envelope description decoders 270*a* and 270*b* are implemented as the same set of instructions executing at different times.

A device for wireless communications, such as a cellular telephone or other device having such communications capability, may be configured to include implementations of both of speech encoder 100 and speech decoder 200. In such case, it is possible for speech encoder 100 and speech decoder 200 to have structure in common. In one such example, speech encoder 100 and speech decoder 200 are implemented to include sets of instructions that are arranged to execute on the same processor.

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. For example, the various elements and tasks described herein for processing a highband portion of a speech signal that includes frequencies above the range of a narrowband portion of the speech signal may be applied alternatively or additionally, and in an analogous manner, for processing a lowband portion of a speech signal that includes frequencies below the range of a narrowband portion of the speech signal. In such a case, the disclosed techniques and structures for deriving a highband excitation signal from the narrowband excitation signal may be used to derive a lowband excitation signal from the narrowband excitation signal. Thus, the present disclosure is not intended to be limited to the configurations shown above but rather is to be accorded the widest scope consistent with the principles and novel features disclosed in any fashion herein, including in the attached claims as filed, which form a part of the original disclosure.

Examples of codecs that may be used with, or adapted for use with, speech encoders, methods of speech encoding, speech decoders, and/or methods of speech decoding as described herein include an Enhanced Variable Rate Codec (EVRC) as described in the document 3GPP2 C.S0014-C version 1.0, "Enhanced Variable Rate Codec, Speech Service Options 3, 68, and 70 for Wideband Spread Spectrum Digital Systems" (Third Generation Partnership Project 2, Arlington, Va., January 2007); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004).

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof. Although the signal from which the speech packets are derived is called a "speech signal," and although these packets are called "speech packets," it is also contemplated and hereby disclosed that this signal may carry music or other non-speech information content during active frames.

Those of skill would further appreciate that the various illustrative logical blocks, modules, circuits, and operations described in connection with the configurations disclosed herein may be implemented as electronic hardware, computer software, or combinations of both. Such logical blocks, modules, circuits, and operations may be implemented or performed with a general purpose processor, a digital signal processor (DSP), an ASIC, an FPGA or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The tasks of the methods and algorithms described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

Each of the configurations described herein may be implemented at least in part as a hard-wired circuit, as a circuit configuration fabricated into an application-specific integrated circuit, or as a firmware program loaded into nonvolatile storage or a software program loaded from or into a data storage medium (e.g., a non-transitory computer-readable medium) as machine-readable code, such code being instructions executable by an array of logic elements such as a microprocessor or other digital signal processing unit. The non-transitory computer-readable medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

What is claimed is:

1. A method of processing a speech signal, said method comprising:

based on a first active frame of the speech signal, producing a first speech packet that includes a description of a spectral envelope, over (A) a first frequency band and (B) a second frequency band that extends above the first frequency band, of a portion of the speech signal that includes the first active frame;

based on a second active frame of the speech signal that occurs in the speech signal immediately after said first active frame, producing a second speech packet that includes a description of a spectral envelope, over the first frequency band, of a portion of the speech signal that includes the second active frame; and producing an encoded frame that contains (A) the second speech packet and (B) a burst of an information signal that is separate from the speech signal, wherein the second speech packet does not include a description of a spectral envelope over the second frequency band.

2. The method of processing a speech signal according to claim 1, wherein said method comprises, based on a third active frame of the speech signal, producing a third speech packet that includes a description of a spectral envelope, over the first frequency band and the second frequency band, of a portion of the speech signal that includes the third active frame, wherein said third active frame occurs in the speech signal immediately after said second active frame.

3. The method of processing a speech signal according to claim 1, wherein the description of a spectral envelope of a portion of the speech signal that includes the first active frame includes separate first and second descriptions, wherein the first description is a description of a spectral envelope, over the first frequency band, of a portion of the speech signal that includes the first active frame, and wherein the second description is a description of a spectral envelope, over the second frequency band, of a portion of the speech signal that includes the first active frame.

4. The method of processing a speech signal according to claim 1, wherein the first and second frequency bands overlap by at least two hundred Hertz.

5. The method of processing a speech signal according to claim 4, wherein said overlap occurs in the range of from 3.5 to 7 kilohertz.

6. The method of processing a speech signal according to claim 1, wherein the length of the burst is less than the length of the second speech packet.

7. The method of processing a speech signal according to claim 1, wherein the length of the burst is equal to the length of the second speech packet.

8. The method of processing a speech signal according to claim 1, wherein the length of the burst is greater than the length of the second speech packet.

9. The method of processing a speech signal according to claim 1, wherein said producing the first speech packet is performed in response to a first state of a rate control signal, and wherein said producing the second speech packet is performed in response to a second state of the rate control signal that is different than said first state.

10. The method of processing a speech signal according to claim 1, wherein said method comprises:

generating a dimming control signal, based on information from a mask file;

in response to a first state of said dimming control signal, producing a first encoded frame that includes the first speech packet; and in response to a second state of said dimming control signal that is different than said first state, producing a second encoded frame that includes the second speech packet and does not include a description of a spectral envelope over the second frequency band.

11. A speech encoder, said speech encoder comprising:

a packet encoder configured to produce (A), based on a first active frame of a speech signal and in response to a first state of a rate control signal, a first speech packet that includes a description of a spectral envelope over (1) a first frequency band and (2) a second frequency band that extends above the first frequency band and (B), based on a second active frame of the speech signal and in response to a second state of the rate control signal different than the first state, a second speech packet that includes a description of a spectral envelope over the first frequency band; and a frame formatter arranged to receive the first and second speech packets and configured to produce (A), in response to a first state of a dimming control signal, a first encoded frame that contains the first speech packet and (B), in response to a second state of the dimming control signal different than the first state, a second encoded frame that contains the second speech packet and a burst of an information signal that is separate from the speech signal, wherein the first and second encoded frames have the same length, the first speech packet occupies at least eighty percent of the first encoded frame, and the second speech packet occupies not more than half of the second encoded frame, and wherein said second active frame occurs immediately after said first active frame in the speech signal, and wherein the second speech packet does not include a description of a spectral envelope over the second frequency band, and wherein at least one among said packet encoder and said frame formatter includes a processor.

12. The speech encoder according to claim 11, wherein an overlap of the first and second frequency bands occurs in the range of from 3.5 to 4 kilohertz.

13. An apparatus for processing a speech signal, said apparatus comprising:

means for producing, based on a first active frame of the speech signal, a first speech packet that includes a description of a spectral envelope, over (A) a first frequency band and (B) a second frequency band that extends above the first frequency band, of a portion of the speech signal that includes the first active frame;

means for producing, based on a second active frame of the speech signal that occurs in the speech signal immediately after said first active frame, a second speech packet that includes a description of a spectral envelope, over the first frequency band, of a portion of the speech signal that includes the second active frame; and means for producing an encoded frame that contains (A) the second speech packet and (B) a burst of an information signal that is separate from the speech signal, wherein the second speech packet does not include a description of a spectral envelope over the second frequency band.

14. The apparatus for processing a speech signal according to claim 13, wherein an overlap of the first and second frequency bands occurs in the range of from 3.5 to 4 kilohertz.

15. The apparatus for processing a speech signal according to claim 13, wherein said apparatus comprises means for producing a third speech packet, based on a third active frame of the speech signal, that includes a description of a spectral envelope, over the first frequency band and the second frequency band, of a portion of the speech signal that includes the third active frame, wherein said third active frame occurs in the speech signal immediately after said second active frame.

16. A non-transitory computer-readable medium, said medium comprising:

code for causing at least one computer to produce, based on a first active frame of the speech signal, a first speech packet that includes a description of a spectral envelope, over (A) a first frequency band and (B) a second frequency band that extends above the first frequency band, of a portion of the speech signal that includes the first active frame;

code for causing at least one computer to produce, based on a second active frame of the speech signal that occurs in the speech signal immediately after said first active frame, a second speech packet that includes a description of a spectral envelope, over the first frequency band, of a portion of the speech signal that includes the second active frame; and code for causing at least one computer to produce an encoded frame that contains (A) the second speech packet and (B) a burst of an information signal that is separate from the speech signal, wherein the second speech packet does not include a description of a spectral envelope over the second frequency band.

17. The medium according to claim 16, wherein an overlap of the first and second frequency bands occurs in the range of from 3.5 to 4 kilohertz.

18. A method of processing speech packets, said method comprising:

based on information from a first speech packet from an encoded speech signal, obtaining a description of a spectral envelope of a first frame of a speech signal over (A) a first frequency band and (B) a second frequency band different than the first frequency band;

based on information from a second speech packet from the encoded speech signal, obtaining a description of a spectral envelope of a second frame of the speech signal over the first frequency band;

obtaining, from an encoded frame of the encoded speech signal, a burst of an information signal that is separate from the speech signal, wherein the encoded frame includes the second speech packet; and based on a presence of the burst in the encoded frame, and based on information from the first speech packet, obtaining a description of a spectral envelope of the second frame over the second frequency band; and based on information from the second speech packet, obtaining information relating to a pitch component of the second frame for the first frequency band.

19. The method of processing speech packets according to claim 18, wherein the description of a spectral envelope of a first frame of a speech signal comprises a description of a spectral envelope of the first frame over the first frequency band and a description of a spectral envelope of the first frame over the second frequency band.

20. The method of processing speech packets according to claim 18, wherein the information relating to a pitch component of the second frame for the first frequency band includes a pitch lag value.

21. The method of processing speech packets according to claim 18, wherein said method comprises calculating, based on the information relating to a pitch component of the second frame for the first frequency band, an excitation signal of the second frame for the first frequency band.

22. The method of processing speech packets according to claim 21, wherein said calculating an excitation signal is based on information relating to a second pitch component for the first frequency band, and wherein the information relating to a second pitch component is based on information from the first speech packet.

23. The method of processing speech packets according to claim 21, wherein said method comprises calculating, based on the excitation signal of the second frame for the first frequency band, an excitation signal of the second frame for the second frequency band.

24. The method of processing speech packets according to claim 18, wherein said obtained description of the spectral envelope of the second frame over the second frequency band is based on said description of the spectral envelope of the first frame over the second frequency band.

25. The method of processing speech packets according to claim 18, wherein the first and second frequency bands overlap by at least two hundred Hertz, and wherein said overlap occurs in the range of from 3.5 to 7 kilohertz.

26. The method of processing speech packets according to claim 18, wherein said obtaining a description of a spectral envelope of the second frame over the second frequency band is based on an indication of a narrowband coding scheme for the second frame.

27. An apparatus for processing speech packets, said apparatus comprising:

means for obtaining, based on information from a first speech packet from an encoded speech signal, a description of a spectral envelope of a first frame of a speech signal over (A) a first frequency band and (B) a second frequency band different than the first frequency band;

means for obtaining, based on information from a second speech packet from the encoded speech signal, a description of a spectral envelope of a second frame of the speech signal over the first frequency band;

means for obtaining, based on information from an encoded frame of the encoded speech signal, a burst of an information signal that is separate from the speech signal, wherein the encoded frame includes the second speech packet; and means for obtaining, based on a presence of the burst in the encoded frame, and based on information from the first speech packet, a description of a spectral envelope of the second frame over the second frequency band; and means for obtaining, based on information from the second speech packet, information relating to a pitch component of the second frame for the first frequency band.

28. The apparatus for processing speech packets according to claim 27, wherein the description of a spectral envelope of a first frame of a speech signal comprises separate first and second descriptions, wherein the first description is a description of a spectral envelope of the first frame over the first frequency band, and wherein the second description is a description of a spectral envelope of the first frame over the second frequency band.

29. The apparatus for processing speech packets according to claim 27, wherein the information relating to a pitch component of the second frame for the first frequency band includes a pitch lag value.

30. The apparatus for processing speech packets according to claim 27, wherein said apparatus comprises means for calculating, based on the information relating to a pitch component of the second frame for the first frequency band, an excitation signal of the second frame for the first frequency band, and wherein said apparatus comprises means for calculating, based on the excitation signal of the second frame for the first frequency band, an excitation signal of the second frame for the second frequency band.

31. The apparatus for processing speech packets according to claim 27, wherein an overlap of the first and second frequency bands occurs in the range of from 3.5 to 4 kilohertz.

32. The apparatus for processing speech packets according to claim 27, wherein said means for obtaining a description of a spectral envelope of the second frame over the second frequency band is configured to obtain said description if a narrowband coding scheme is indicated for the second frame.

33. A non-transitory computer-readable medium, said medium comprising:

code for causing at least one computer to obtain, based on information from a first speech packet from an encoded speech signal, a description of a spectral envelope of a first frame of a speech signal over (A) a first frequency band and (B) a second frequency band different than the first frequency band;

code for causing at least one computer to obtain, based on information from a second speech packet from the encoded speech signal, a description of a spectral envelope of a second frame of the speech signal over the first frequency band;

code for causing at least one computer to calculate, based on information from an encoded frame of the encoded speech signal, a burst of an information signal that is separate from the speech signal, wherein the encoded frame includes the second speech packet; and code for causing at least one computer to obtain, based on a presence of the burst in the encoded frame, and based on information from the first speech packet, a description of a spectral envelope of the second frame over the second frequency band; and code for causing at least one computer to obtain, based on information from the second speech packet, information relating to a pitch component of the second frame for the first frequency band.

34. The computer program product according to claim 33, wherein the description of a spectral envelope of a first frame of a speech signal comprises separate first and second descriptions, wherein the first description is a description of a spectral envelope of the first frame over the first frequency band, and wherein the second description is a description of a spectral envelope of the first frame over the second frequency band.

35. The computer program product according to claim 33, wherein the information relating to a pitch component of the second frame for the first frequency band includes a pitch lag value.

36. The computer program product according to claim 33, wherein said medium comprises code for causing at least one computer to calculate, based on the information relating to a pitch component of the second frame for the first frequency band, an excitation signal of the second frame for the first frequency band, and wherein said medium comprises code for causing at least one computer to calculate, based on the excitation signal of the second frame for the first frequency band, an excitation signal of the second frame for the second frequency band.

37. A speech decoder configured to calculate a decoded speech signal based on an encoded speech signal, said speech decoder comprising:

control logic configured to generate a control signal comprising a sequence of values that is based on coding indices of speech packets from the encoded speech signal, each value of the sequence corresponding to a frame period of the decoded speech signal; and a packet decoder configured (A) to calculate, in response to a value of the control signal having a first state, a corresponding decoded frame based on a description of a spectral envelope of the decoded frame over (1) a first frequency band and (2) a second frequency band that extends above the first frequency band, the description being based on information from a speech packet from the encoded speech signal, and (B) to calculate, in response to a value of the control signal having a second state different than the first state, a corresponding decoded frame based on (1) a description of a spectral envelope of the decoded frame over the first frequency band, the description being based on information from a speech packet from the encoded speech signal, and (2) a description of a spectral envelope of the decoded frame over the second frequency band, the description being based on information from at least one speech packet that occurs in the encoded speech signal before the speech packet, wherein said control logic is configured to set a value of the control signal to have the second state if a corresponding frame of the encoded speech signal includes a burst of an information signal that is separate from the decoded speech signal, and wherein at least one among said control logic and said packet decoder includes a processor.

38. The speech decoder according to claim 37, wherein the description of a spectral envelope of the decoded frame over (1) a first frequency band and (2) a second frequency band that extends above the first frequency band comprises separate first and second descriptions, wherein the first description is a description of a spectral envelope of the decoded frame over the first frequency band, and wherein the second description is a description of a spectral envelope of the decoded frame over the second frequency band.

39. The speech decoder according to claim 37, wherein the information relating to a pitch component of the second frame for the first frequency band includes a pitch lag value.

40. The speech decoder according to claim 37, wherein said packet decoder is configured to calculate, in response to a value of the control signal having a second state, and based on the information relating to a pitch component of the second frame for the first frequency band, an excitation signal of the second frame for the first frequency band, and wherein said apparatus comprises means for calculating, based on the excitation signal of the second frame for the first frequency band, an excitation signal of the second frame for the second frequency band.

41. The speech decoder according to claim 37, wherein said description of the spectral envelope of the decoded frame over the second frequency band is based on a description, from said at least one speech packet that occurs in the encoded speech signal before the speech packet, of a spectral envelope over the second frequency band.

42. The speech decoder according to claim 37, wherein an overlap of the first and second frequency bands occurs in the range of from 3.5 to 4 kilohertz.

43. The speech decoder according to claim 37, wherein said control logic is configured to set the value of the control signal to have the second state if a narrowband coding scheme is indicated for the frame.

44. A method of processing a speech signal, said method comprising:

based on a first frame of the speech signal, generating a rate selection signal that indicates a wideband coding scheme;

based on information from a mask file, generating a dimming control signal;

based on a state of the dimming control signal that corresponds to the first frame, overriding the wideband coding scheme selection to select a narrowband coding scheme; and encoding the first frame according to the narrowband coding scheme.

45. The method of processing a speech signal according to claim 44, wherein said encoding the first frame according to the narrowband coding scheme comprises encoding the first frame into a first speech packet, and wherein said method comprises producing an encoded frame that includes the first speech packet and a burst of an information signal separate from the speech signal.

46. The method of processing a speech signal according to claim 44, wherein said method comprises encoding a second frame of the speech signal according to the wideband coding scheme, wherein said second frame immediately follows said first frame in the speech signal.

47. The method of processing a speech signal according to claim 44, wherein said method comprises encoding a previous frame of the speech signal according to the wideband coding scheme, wherein said previous frame immediately precedes said first frame in the speech signal.

* * * * *